United States Patent [19]

Ueda et al.

[11] Patent Number: 4,818,664

[45] Date of Patent: Apr. 4, 1989

[54] PROCESSING OF SILVER HALIDE COLOR PHOTOGRAPHIC MATERIALS CONTAINING A COMPOUND RELEASING A SPECIFIED DEVELOPMENT INHIBITOR

[75] Inventors: Shinji Ueda; Keiji Mihayashi; Seiji Ichijima, all of Minami-ashigara, Japan

[73] Assignee: Fuji Photo Film Co., Ltd., Kanagawa, Japan

[21] Appl. No.: 52,085

[22] Filed: May 20, 1987

[30] Foreign Application Priority Data

May 20, 1986 [JP] Japan ..... 61-115793

[51] Int. Cl.[4] ..... G03C 5/44; G03C 7/00; G03C 1/08; G03C 7/26

[52] U.S. Cl. ..... 430/430; 430/218; 430/219; 430/343; 430/445; 430/503; 430/505; 430/552; 430/553; 430/555; 430/955; 430/957

[58] Field of Search ..... 430/430, 445, 393, 218, 430/219, 552, 553, 558, 957, 955, 503, 505

[56] References Cited

U.S. PATENT DOCUMENTS

| | | | |
|---|---|---|---|
| 4,409,323 | 10/1983 | Sato et al. | 430/553 |
| 4,434,225 | 2/1984 | Sugita et al. | 430/552 |
| 4,438,193 | 3/1984 | Uemura et al. | 430/505 |
| 4,528,263 | 7/1985 | Sugita et al. | 430/552 |
| 4,618,571 | 10/1986 | Ichijima et al. | 430/505 |
| 4,621,047 | 11/1986 | Kishimoto et al. | 430/430 |
| 4,629,683 | 12/1986 | Itoh et al. | 430/430 |
| 4,695,529 | 9/1987 | Abe et al. | 430/430 |

*Primary Examiner*—Mukund J. Shah

*Attorney, Agent, or Firm*—Sughrue, Mion, Zinn, Macpeak & Seas

[57] ABSTRACT

A process for processing a silver halide color photographic material which comprises processing, after color development, a silver halide color photographic material with a processing solution having a bleaching faculty using an aminopolycarboxylic acid ferric complex salt as an oxidizing agent, said color photographic material comprising a support having thereon at least one light-sensitive silver halide emulsion layer and at least one compound releasing by the reaction with an oxidation product of a developing agent a group releasing or forming development inhibitor by the reaction with another molecule of an oxidation product of a developing agent.

19 Claims, No Drawings

PROCESSING OF SILVER HALIDE COLOR PHOTOGRAPHIC MATERIALS CONTAINING A COMPOUND RELEASING A SPECIFIED DEVELOPMENT INHIBITOR

FIELD OF THE INVENTION

This invention relates to a process for processing color photographic light-sensitive materials, and more particularly to a processing process for silver halide color photographic materials capable of improving the color reproduction by sufficiently desilvering the color-developed color photographic materials in a short period of time.

BACKGROUND OF THE INVENTION

The fundamental processing steps for color photographic materials are generally a color development step and a desilvering step. In the color development step, the light-exposed silver halide in the color photographic material is reduced by a color-developing agent to form silver and at the same time the oxidized color-developing agent reacts with the color-forming couplers in the color photographic materials to form dye images. The silver formed is oxidized by a bleaching agent in the subsequent desilvering step and further converted by the action of a fixing agent into a soluble silver complex, which is dissolved away. Acutal processing steps for color photographic materials further include various auxiliary steps such as a hardening step, a stop step, an image-stabilizing step, a water wash step, etc., for keeping good photographic and physical qualities of the color images formed and improving the storage stability of the color images.

Recently, it has been keenly desired to quicken the processing of color photographic materials, that is, to shorten the processing time. To accomplish this, it is particularly important to try to shorten the processing time for the desilvering step because this step takes about half of the total processing time of the aforesaid processing steps.

For meeting such a need, a bleach-fix (blix) solution containing an aminopolycarboxylic acid ferric complex salt and a thiosulfate as described in German Patent 866,605 is known as a means for shortening the processing time for the desilvering step. However, when an aminopolycarboxylic acid ferric complex salt originally having weak oxidative power (bleaching power) coexists with a thiosulfate having reducing power, the bleaching power of the complex salt is reduced so much that desilvering of a high speed and high silver-containing color photographic material for photographing (in camera use) cannot be sufficiently performed, and thus the blix solution as described above is unsuitable for practical use.

On the other hand, as a method for increasing the bleaching power, it has been proposed to add a bleach accelerator such as the mercapto compound, etc., as described, for example, in U.S. Pat. No. 3,893,858, etc., to a bleach or blix bath or the prebath thereof but the effect of the bleach accelerator is not always sufficient in the processing using a conventional bleach bath and fix bath.

Also, a method of quickening desilvering of color photograhic light-sensitive materials by performing a blix step after a bleach step is described in Japanese Patent Application (OPI) No. 75352/86 (the term "OPI" as used herein refers to a "published unexamined Japanese patent application") (corresponding to European Patent Publication No. A176,056).

However, in the case of quickening the desilvering step for color photographic materials, the desilvering property of a bleach bath or blix bath is reduced by development inhibitor-releasing (DIR) couplers contained in color photographic light-sensitive materials.

SUMMARY OF THE INVENTION

Accordingly, a first object of this invention is to provide a processing process suitable for quickening the desilvering step for color photographic materials and forming excellent color images in such quickened processing.

A second object of this invention is to provide a processing process wherein color photographic materials suitable for shortened photographic processing are used.

A third object of this invention is to provide an image-forming process capable of giving color images having excellent fastness by quick processing.

As a result of various investigations, the inventors have found that these objects can be accomplished according to this invention by processing, after color development, a silver halide color photographic material with a processing solution having a bleaching faculty and containing an aminopolycarboxylic acid ferric complex salt as an oxidizing agent, the color photographic material comprising a support having thereon at least one light-sensitive silver halide emulsion layer and at least one compound releasing by the reaction with an oxidation product of a developing agent a group which releases or forms a development inhibitor by the reaction with another molecule of an oxidation product of a developing agent.

DETAILED DESCRIPTION OF THE INVENTION

The invention is described below in detail.

The color photographic material processed by the processing process of this invention contains a compound releasing by the reaction with a molecule of an oxidation product of a developing agent a group which releases or forms a development inhibitor by the reaction with another molecule of an oxidation product of a developing agent and the aforesaid compound contained in the color photographic material is preferably represented by the following formula (I):

$$A—PDI \qquad (I)$$

wherein A represents a group releasing PDI by the reaction with an oxidation product of a developing agent, and PDI represents a group which forms, after being cleaved from A, a development inhibitor (DI) by the reaction with an oxidation product of a developing agent.

Preferred compounds of the compounds shown by formula (I) described above are represented by formula (II)

$$A\text{-}(L_1)_v B\text{-}(L_2)_w DI \qquad (II)$$

wherein A represents a group releasing $(L_1)_v B\text{-}(L_2)_w DI$ by the reaction with an oxidation product of a developing agent; $L_1$ represents a group releasing, after being cleaved from A, $B\text{-}(L_2)_w DI$; B represents a group releasing, after being cleaved from $(L_1)_v$, $(L_2)_w DI$ by the reaction with another molecule of an oxidation product of a developing agent; $L_2$ represents a group which forms, after being cleaved from B, DI; DI represents a development inhibitor; and v and w each represents 0 or 1.

The reaction course by which the compound shown by formula (II) described above releases DI at development is shown by the following reaction formula:

$$A\text{-}(L_1)_v B\text{-}(L_2)_w DI \xrightarrow{T^{\oplus}} (L_1)_v B\text{-}(L_2)_w DI \longrightarrow$$

$$B\text{-}(L_2)_w DI \xrightarrow{T^{\oplus}} (L_2)_w DI \longrightarrow DI$$

wherein A, $L_1$, B, $L_2$, DI, v and w have the same significance as defined above for formula (II) and $T^{\oplus}$ represents an oxidation product of a developing agent.

In the aforesaid reaction formula, the reaction of forming $(L_2)_w DI$ from $B—L_2)_w DI$ characterizes the excellent effect of this invention. That is, the reaction is a secondary reaction of $T^{\oplus}$ and $B\text{-}(L_2)_w DI$. In other words, the reaction rate depends upon the concentration of each reactant. Accordingly, when a large amount of $T^{\oplus}$ is formed, $B\text{-}(L_2)_w DI$ immediately forms $(L_2)_w DI$, while when a small amount of $T^{\oplus}$ is formed, $B\text{-}(L_2)_w DI$ slowly forms $(L_2)_w DI$. Such a reaction course effectively promotes the action of DI with the above-mentioned reaction course.

The compounds shown by formula (II) described above are now explained in detail.

Specifically, A in formula (II) represents a coupler residue or a redox residue.

When A represents a coupler residue, known couplers can be utilized. For example, as such coupler residues shown by A, there are yellow coupler residues (e.g., open chain ketomethylene type coupler residues, etc.), magenta coupler residues (e.g., 5-pyrazolone type coupler residues, pyrazoloimidazole type coupler residues, pyrazolotriazole type coupler residues, etc.), cayn coupler residues (e.g., phenol type coupler residues, naphthol type coupler residues, etc.), non-coloring coupler residues (e.g., indanone type coupler residues, acetophenone type coupler residues, etc.), and the coupler residues described in U.S. Pat. Nos. 4,315,070, 4,183,752, 4,171,223, 4,226,934, etc.

When A represents a redox residue, the redox residue is represented by formula (III):

$$A_1—P\text{-}(X=Y)_n Q—A_2 \qquad \text{(III)}$$

wherein P and Q each independently represents an oxygen atom or a substituted or unsubstituted imino group; at least one of n Xs and Ys represents a methine group having $\text{-}(L_1)_v B\text{-}(L_2)_w DI$ as a substituent, and the other X and Y represent a substituted or unsubstituted methine group or a nitrogen atom; n represents an integer of from 1 to 3 (n Xs and n Ys each may be the same or different); and $A_1$ and $A_2$ each represents a hydrogen atom or a group capable of being removed by alkali. The redox residue shown by formula (III) includes the case wherein two of P, X, Y, Q, $A_1$ and $A_2$ may combine with each other as divalent groups to form a cyclic structure, for example, the case wherein $(X=Y)_n$ forms a benzene ring or a pyridine ring.

In the compound shown by formula (II) described above, the groups shown by $L_1$ and $L_2$ may or may not be used in this invention and are properly selected according to purposes.

As the groups represented by $L_1$ and $L_2$, there are, for example, the following linkage groups:

(1) Groups utilizing the cleavage reaction of a hemiacetal:

Examples of these groups are the groups shown by the formula (T-1) described in U.S. Pat. No. 4,146,396 and Japanese Patent Application (OPI) Nos. 249148/85 and 249149/85.

$$*\text{-}(W—\underset{R_2}{\overset{R_1}{C}})_t\text{-}** \qquad \text{(T-1)}$$

wherein the mark * represents a position bonding the left side of the group in formula (II); the mark ** represents a position bonding the right side of the group in formula (II); W represents an oxygen atom, a sulfur atom, or $$—\underset{R_3}{N}—$$

(wherein $R_3$ represents an organic substituent); $R_1$ and $R_2$ each represents a hydrogen atom or a substituent; and t represents 1 or 2; when t is 2, the two $R_1$s and $R_2$s each may be the same or different and the group shown by formula (T-1) includes the case wherein two of the $R_1$, $R_2$ and $R_3$ combine with each other to form a cyclic structure.

Specific examples of the group shown by formula (T-1) described above are illustrated below:

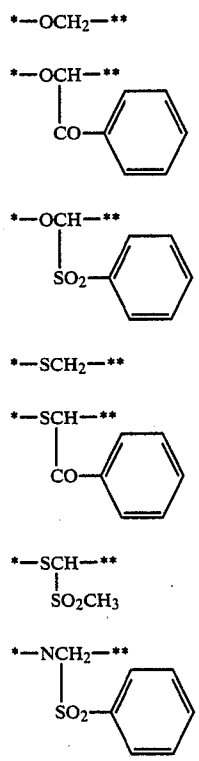

-continued

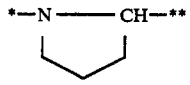

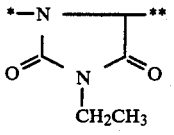

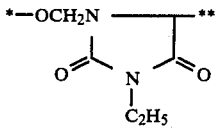

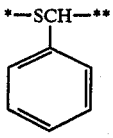

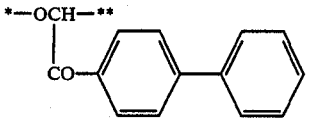

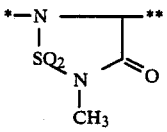

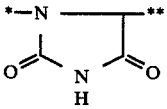

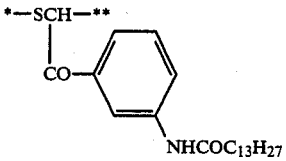

(2) Groups causing a cleavage reaction by utilizing an intramolecular nucleophilic reaction:

Examples of the groups are the timing groups described in U.S. Pat. No. 4,248,962 and are represented by the formula (T-2):

*-Nu-Link-E-** (T-2)

wherein the mark * represents a position bonding the left side of the group in formula (II); the mark  represents a position bonding the right side of the group in formula (II); Nu represents a nucleophilic group such as an oxygen atom and a sulfur atom; E represents an electrophilic group which can cleave the linkage to  by the nucleophilic attack from Nu; and Link represents a linkage group sterically connecting Nu and E so that they can cause an intramolecular nucleophilic reaction.

Specific examples of the groups shown by formula (T-2) are illustrated below.

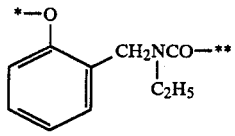

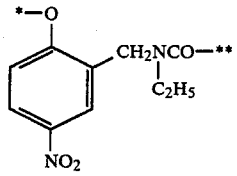

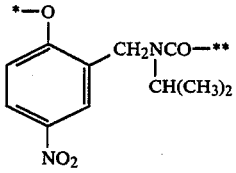

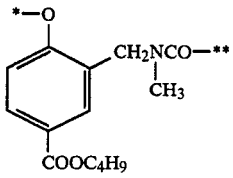

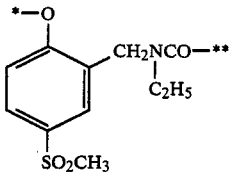

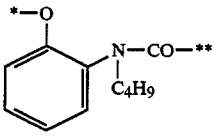

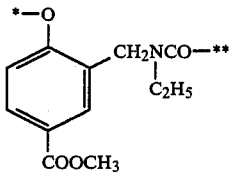

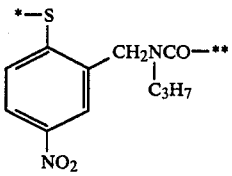

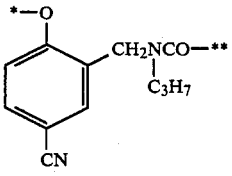

-continued

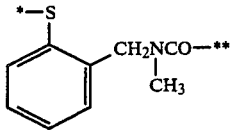

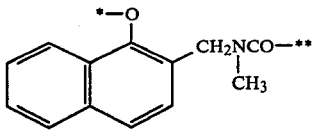

(3) Groups causing a cleavage reaction by utilizing an electron transfer reaction along the conjugated system:

Examples of the groups are described in U.S. Pat. Nos. 4,409,323 and 4,421,845 and are represented by the formula (T-3):

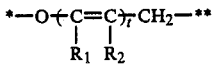

(T-3)

wherein the mark *, the mark **, $R_1$, $R_2$ and t have the same significance as defined above for formula (T-1).

Specific examples of the groups are illustrated below.

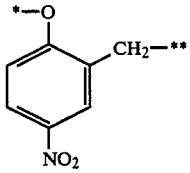

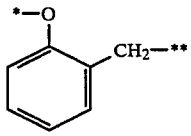

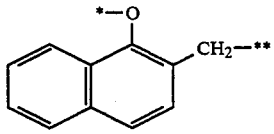

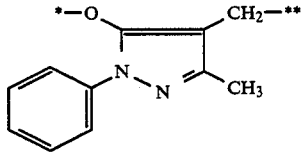

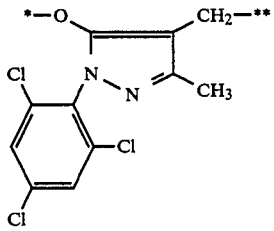

-continued

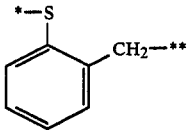

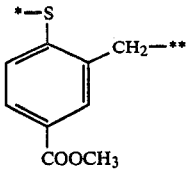

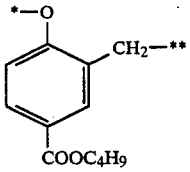

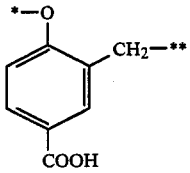

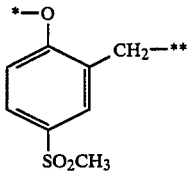

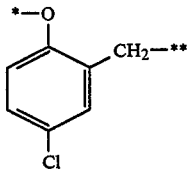

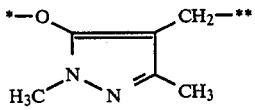

(4) Groups utilizing a cleavage reaction by the hydrolysis of an ester:

Examples of the groups are the linkage groups described in West German Patent Application (OLS) No. 2,626,315 (OLS: Offenlegunsshrift) (corresponding to British Pat. No. 1,531,927), such as those represented by the formulae (T-4):

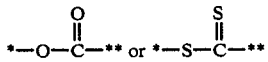

(T-4)

wherein the mark * and the mark ** have the same significance as defined above for formula (T-1).

B shown by formula (II) described above is a group which becomes a coupler after being cleaved from $(L_1)_v$ or a group which becomes a redox residue after being cleaved from $(L_1)_v$.

As the aforesaid group which becomes a coupler, there is a group bonded to $A\text{-}(L_1)_v$ at the oxygen atom formed by removing the hydrogen atom of the hydroxy group in the case of a pheol type coupler. Also, in the case of a 5-pyrazolone type coupler, the aforesaid group is a group bonded to $A\text{-}(L_1)_v$ at the oxygen atom formed by removing the hydrogen atom from the hydroxy group of a type tautomerized to 5-hydroxypyrazole. In these examples, B becomes a phenol type coupler or a 5-pyrazolone type coupler after being released from $(L_1)_v$. B has $(L_2)_w$DI at the coupling position.

When B represents a redox residue, the redox residue is preferably shown by the following formula (B-1):

$$*\text{-}P\text{-}(X'=Y')_n Q\text{—}A_2 \qquad \text{(B-1)}$$

wherein the mark * represents a position bonding $A\text{—}L_1)_v$; $A_2$, P, Q and n have the same significance as defined above for formula (III); at least one of n X's and n Y's represents a methine group having $(L_2)_w$DI as a substituent and the other X's and Y's represent a substituted or unsbustituted methine group or a nitrogen atom; the group shown by formula (B-1) includes the case wherein two of the $A_2$, P, Q, X' and Y' form a cyclic structure as divalent groups.

Specific examples of DI in formula (II) described above are a tetrazolylthio group, a benzimidazolylthio group, a benzothiadiazolylthio group, a benzoxazolylthio group, a benzotriazolyl group, a benzindazolyl group, a triazolylthio group, an imidazolylthio group, a thiadiazolylthio group, a thioethersubstituted triazolyl group (e.g., the development inhibitors described in U.S. Pat. Nos. 4,579,816), and an oxadiazolyl group. These groups may have a proper substituent. Specific examples of the proper substituent are a halogen atom, an aliphatic group, a nitro group, an acylamino group, an aliphatic oxycarbonyl group, an aromtic oxycarbonyl group, an imido group, a sulfonamido group, an aliphatic oxy group, an aromatic oxy group, an amino group, an imino group, a cyano group, an aromatic group, an acyloxy group, a sulfonyloxy group, an aliphatic thio group, an aromatic thio group, an aromatic oxysulfonyl group, an aliphatic oxysulfonyl group, an aliphatic oxycarbonylamino group, an aromatic oxycarbonylamino group, an aliphatic oxycarbonyloxy group, a heterocyclic oxycarbonyl group, a heterocyclic oxy group, a sulfonyl group, an acyl group, a ureido group, a heterocyclic group, and a hyroxy group. In the examples shown above, the total carbon atom number of the group illustrated is preferably 20 or less.

This invention also includes the case wherein optionally two groups of those shown by A, $L_1$, B, $L_2$, and DI formula (II) each has a bond in addition to the bond shown by formula (II) and are bonded to each other by the second bonds. In this case, when the second bonds are not cleaved at development, the effect of this invention is obtained. Examples of these bondings are as follows:

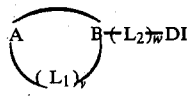

-continued

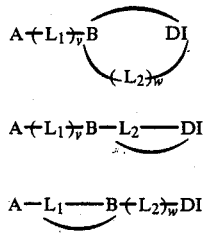

The compound shown by formula (II) in this invention also includes the case wherein the compound is a polymer. That is, there are, for example, a polymer formed from the monomer compound shown by the following formula (P-1) and having the recurring unit shown by the following formula (P-2), and a copolymer of the compound shown by formula (II) and at least one non-coloring monomer having an ethylene group which does not have the ability to cause coupling with oxidation product of an aromatic primary amine developing agent. In this case, two or more monomers may be simultaneously copolymerized.

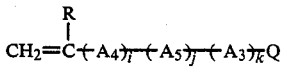

(P-1)

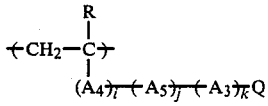

(P-2)

wherein R represents a hydrogen atom, a lower alkyl group having 1 to 4 carbon atoms, or a chlorine atom; $A_3$ represents —CONH—, —NHCONH—, —NHCOO—, —COO—, —$SO_2$—, —CO—, —NHCO—, —$SO_2$NH—, —NH$SO_2$—, —OCO—, —OCONH—, —S—, —NH—, or —O—; $A_4$ represents —CONH— or —COO—; $A_5$ represents a substituted or unsubstituted alkylene group having 1 to 10 carbon atoms which may be a straight chain or branched alkylene group, a substituted or unsubstituted aralkylene group, or a substituted or unsubstituted arylene group (examples of the alkylene group are a methylene group, a methylmethylene group, a dimethylmethylene group, a dimethylene group, a trimethylene group, a tetramethylene group, a pentamethylene group, a hexamethylene group, and a decylmethylene group; examples of the aralkylene group are a benzylidene group, etc.; and examples of the arylene group are a phenylene group and a naphthylene group); Q represents a residue as defined for formula (II) described above and may be bonded to any moiety represented by A, $L_1$, B or $L_2$ in formula (III); and i, j, and k represent 0 or 1 excluding the case that i, j and k are simultaneously 0.

The alkylene group, aralkylene group and arylene group represented by $A_5$ each may have a substituent as described above and examples of the substituent are an aryl group (e.g., a phenyl group), a nitro group, a hydroxy group, a cyano group, a sulfo group, an alkoxy group (e.g., a methoxy group), an aryloxy group (e.g., a phenoxy group), an acyloxy group (e.g., an acetoxy group), an acylamino group (e.g., an acetylamino group), a sulfonamido group (e.g., a methanesulfonamido group), a sulfamoyl group (e.g., a methylsulfamoyl group), a halogen atom (e.g., a fluorine atom, a chlorine atom, and a bromine atom), a carboxy group, a carbamoyl group (e.g., a methylcarbamoyl group), an alkoxycarbonyl group (e.g., a methoxycarbonyl group), and a sulfonyl group (e.g., a methylsulfonyl group). When the aforesaid group shown by $A_5$ has two or more substituents, the substituents may be the same or different.

When the compound shown by formula (II) described above forms a copolymer with a non-coloring ethylenically unsaturated monomer in this invention as described above, examples of the non-coloring ethylenical monomer are acrylic acid, α-chloroacrylic acid, α-alkylacrylic acid, the esters or amides formed from these acrylic acids, methylene bisacrylamide, vinyl esters, acrylonitrile, aromatic vinyl compounds, maleic acid derivatives, and vinylpyridines. In this case, the non-coloring ethylenically unsaturated monomers may be used solely or as a combination thereof.

More preferred examples of the compounds shown by formulae (I) or (II) described above will now be explained.

Preferred examples of A in formulae (I) or (II) are the coupler residues shown by the following formulae (Cp-1), (Cp-2), (Cp-3), (Cp-4), (Cp-5), (Cp-6), (Cp-7), (Cp-8), or (Cp-9). The couplers having these coupler residues show high coupling speed and thus are preferably used in this invention.

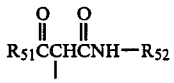
(Cp-1)

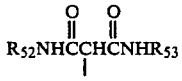
(Cp-2)

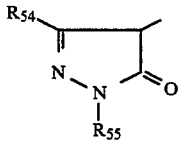
(Cp-3)

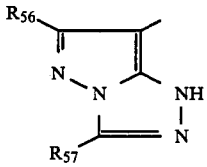
(Cp-4)

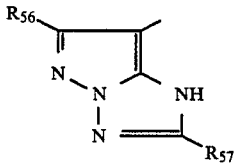
(Cp-5)

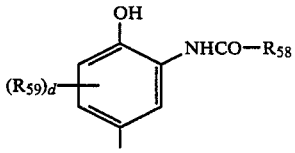
(Cp-6)

-continued

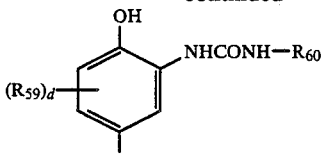
(Cp-7)

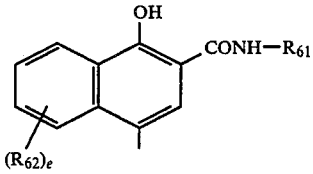
(Cp-8)

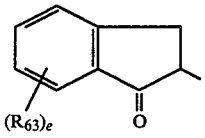
(Cp-9)

In the above formulae, each free bond at the coupling position represents a bonding position of a coupling releasing group.

When $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, or $R_{63}$ contains a nondiffusible group, each group is selected so that the total carbon atom number of each group is from 8 to 40, preferably from 10 to 30 and when each group described above does not contain a nondiffusible group, each group is preferably selected so that the total carbon number becomes at most 15. When the coupler shown by formulae (I) or (II) is a bis type, telomer, or polymer type coupler, one of the groups described above bonded to each coupler residue represents a divalent group and connects thereby recurring units, etc., to the coupler residue. In this case, the range of carbon atom number may be outside the range defined above.

Now, $R_{51}$ to $R_{63}$, d and e in the aforesaid formulae are explained in detail. In addition, in the following formulae, $R_{41}$ represents an aliphatic group, an aromatic group, or a heterocyclic group; $R_{42}$ represents an aromatic group or a heterocyclic group; and $R_{43}$, $R_{44}$ and $R_{45}$ each represents a hydrogen atom, an aliphatic group, an aromatic group, or a heterocyclic group.

$R_{51}$ has the same significance as defined above for $R_{41}$, and $R_{52}$ and $R_{53}$ each has the same significance as defined above for $R_{42}$.

$R_{54}$ represents the group defined for $R_{41}$, $$R_{41}\underset{\underset{R_{43}}{|}}{CON}-,\ R_{41}\underset{\underset{R_{43}}{|}}{N}-,\ R_{41}SO_2\underset{\underset{R_{43}}{|}}{N}-,\ R_{41}S-,\ R_{43}O-,$$

$$R_{45}-\underset{\underset{R_{43}}{|}}{N}-CO-\underset{\underset{R_{44}}{|}}{N}-,\ R_{41}OOC-,\ R_{41}\underset{\underset{R_{43}}{|}}{N}CO-,\ \text{or}\ N\equiv C-.$$

$R_{55}$ has the same significance as defined above for $R_{41}$.

$R_{56}$ and $R_{57}$ each represents the group defined for $R_{43}$, $R_{41}S-$, $R_{43}O-$, $$R_{41}\underset{\underset{R_{43}}{|}}{CON}-,\ R_{41}\underset{\underset{R_{43}}{|}}{N}-,\ R_{43}-\underset{\underset{R_{44}}{|}}{N}-CO-\underset{\underset{R_{45}}{|}}{N}-,\ \text{or}\ R_{41}SO_2\underset{\underset{R_{43}}{|}}{N}-.$$

$R_{58}$ has the same significance as defined above for $R_{41}$.

$R_{59}$ represents the group defined for $R_{41}$, $R_{41}CON(R_{43})-$, $R_{41}OCON(R_{43})-$, $R_{41}SO_2N(R_{43})-$, $R_{43}-N(R_{44})-CO-N(R_{45})-$, $R_{43}NSO_2N(R_{44})(R_{45})-$, $R_{41}O-$, $R_{41}S-$, a halogen atom, or $R_{41}N(R_{43})-$.

Also, d represents an integer of 0 to 3 and when d is plural, the plural $R_{59}$s may be the same or different. Also, in this case, the $R_{59}$s become divalent groups and form a cyclic structure by the linkage thereof. Examples of the divalent groups forming the cyclic structure are the groups shown by the following formulae:

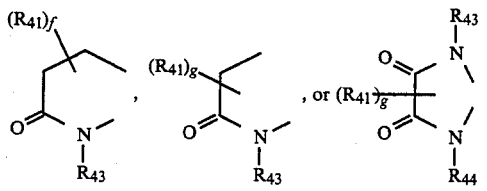

wherein f represents an integer of from 0 to 4, and g represents an integer of from 0 to 2.

$R_{60}$ has the same significance as defined above for $R_{41}$, and $R_{61}$ has the same significance as defined above for $R_{41}$.

$R_{62}$ represents the group defined above for $R_{41}$, $R_{41}CONH-$, $R_{41}OCONH-$, $R_{41}SO_2NH-$, $R_{43}-N(R_{44})-CO-N(R_{45})-$, $R_{43}-N(R_{44})-SO_2-N(R_{45})-$, $R_{43}O-$, $R_{41}S-$, a halogen atom, or $R_{41}N(R_{43})-$.

$R_{63}$ represents the group defined above for $R_{41}$, $R_{43}CON(R_{44})-$, $R_{43}NCO(R_{44})-$, $R_{41}SO_2N(R_{44})-$, $R_{43}NSO_2(R_{44})-$, $R_{41}SO_2-$, $R_{43}OCO-$, $R_{43}O-SO_2-$, a halogen atom, a nitro group, a cyano group, or $R_{43}CO-$.

Also, e represents an integer of from 0 to 4 and when e is plural, the plural $R_{62}$s or $R_{63}$s may be the same or different.

In the above-mentioned formulae, the aliphatic group is a saturated or unsaturated, chain or cyclic, straight or branched, substituted or unsubstituted aliphatic hydrocarbon group having 1 to 32, preferably 1 to 22, carbon atoms. Specific examples of these aliphatic groups are a methyl group, an ethyl group, a propyl group, an isopropyl group, a butyl group, a t-butyl group, an i-butyl group, a t-amyl group, a hexyl group, a cyclohexyl group, a 2-ethylhexyl group, an octyl group, a 1,1,3,3-tetramethylbutyl group, a decyl group, a dodecyl group, a hexadecyl group, and an octadecyl group.

The aromatic group in the aforesaid formulae has 6 to 20 carbon atoms, and the preferred examples thereof include a sustituted or unsubstituted phenyl group or a substituted or unsubstituted naphthyl group.

The heterocyclic group in the aforesaid formulae is preferably a 3-membered to 8-membered, substituted or unsaturated heterocyclic group having 1 to 20, preferably 1 to 7, carbon atoms, the hetero atom being selected from a nitrogen atom, an oxygen atom, and a sulfur atom. Specific examples of the heterocyclic group are a 2-pyridyl group, a 4-pyridyl group, a 2-thienyl group, a 2-furyl group, a 2-imidazolyl group, a pyradinyl group, a 2-pyrimidinyl group, a 1-imidazolyl group, a 1-indolyl group, a phthalimido group, a 1,3,4-thiadiazol-2-yl group, a benzoxazol-2-yl group, a 2-quinolyl group, a 2,4-dioxo-1,3-imidazolidin-5-yl group, a 2,4-dioxo-1,3-imidazolidin-3-yl group, a succinimido group, a phthalimido group, a 1,2,4-triazol-2-yl group, and a 1-pyrazolyl group.

When the above-described aliphatic hydrocarbon group, aromatic group or heterocyclic group has a substituent, specific examples of the substituent are a halogen atom, $R_{47}O-$, $R_{46}S-$, $R_{47}CON(R_{48})-$, $R_{47}NCO(R_{48})-$, $R_{46}OCON(R_{47})-$, $R_{46}SO_2N(R_{47})-$, $R_{47}NSO_2(R_{48})-$, $R_{46}SO_2-$, $R_{47}OCO-$, $R_{47}-N(R_{48})-CO-N(R_{49})-$, the group defined for $R_{46}$,

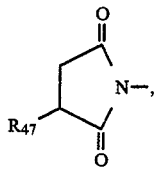

$R_{46}COO-$, $R_{47}OSO_2-$, a cyano group, and a nitro group. (Wherein $R_{46}$ represents an aliphatic group, an aromatic group or a heterocyclic group; and $R_{47}$, $R_{48}$, and $R_{49}$ each represents an aliphatic group, an aromatic group, a heterocyclic group or a hydrogen atom. The aliphatic group, aromatic group, and heterocyclic group have the same significance as defined above.)

Preferred examples of $R_{51}$ to $R_{63}$, d, and e in formulae (Cp-1) to (Cp-9) are explained below.

$R_{51}$ is preferably an aliphatic group or an aromatic group. $R_{52}$, $R_{53}$ and $R_{55}$ each is preferably an aromatic group. $R_{54}$ is preferably $R_{41}CONH-$ or $R_{41}-N(R_{43})-$.

$R_{56}$ and $R_{57}$ each is preferably an aliphatic group, $R_{41}O-$, or $R_{41}S-$. $R_{58}$ is preferably an aliphatic group or an aromatic group.

In formula (Cp-6), $R_{59}$ is preferably a chlorine atom, an aliphatic group, or $R_{41}CONH-$. In formulae (Cp-6)

and (Cp-7), d is preferably 1 or 2. $R_{60}$ is preferably an aromatic group.

In formula (Cp-7), $R_{59}$ is preferably $R_{41}CONH$—. Also, in formula (Cp-7), d is preferably 1.

$R_{61}$ is preferably an aliphatic group or an aromatic group.

In formula (Cp-8), e is preferably 0 or 1.

$R_{62}$ is preferably $R_{41}OCONH$—, $R_{41}CONH$—, or $R_{41}SO_2NH$— and also is preferably substituted at the 5-position of the naphthol ring.

$R_{63}$ is preferably $R_{41}CONH$—, $R_{41}SO_2NH$—, $$R_{41}\underset{\underset{R_{43}}{|}}{N}SO_2-,$$

$R_{41}SO_2$—, $$R_{41}\underset{\underset{R_{43}}{|}}{N}CO-,$$

a nitro group, or a cyano group.

Specific examples of the groups represented by $R_{51}$ to $R_{63}$ in formulae (Cp-1) to (Cp-9) are explained below.

Specific examples of the group represented by $R_{51}$ are a t-butyl group, a 4-methoxyphenyl group, a phenyl group, a 3-[2-(2,4-di-t-amylphenoxy)butanamido]phenyl group, a 4-octadecyloxyphenyl group, and a methyl group.

Specific examples of the groups represented by $R_{52}$ and $R_{53}$ are a 2-chloro-5-dodecyloxycarbonylphenyl group, a 2-chloro-5-hexadecylsulfonamidophenyl group, a 2-chloro-5-tetradecanamidophenyl group, a 2-chloro-5-[4-(2,4-di-t-amylphenoxy)butanamido]phenyl group, a 2-chloro-5-[2,4-di-t-amylphenoxy)-butanamido]phenyl group, a 2-methoxyphenyl group, a 2-methoxy-5-tetradecyloxycarbonylphenyl group, a 2-chloro-5-(1-ethoxycarbonylethoxycarbonyl)phenyl group, a 2-pyridyl group, a 2-chloro-5-octyloxycarbonylphenyl group, a 2,4-dichlorophenyl group, a 2-chloro-5-(1-dodecyloxycarbonylethoxycarbonyl)phenyl group, a 2-chlorophenyl group, and a 2-ethoxyphenyl group.

Specific examples of the group represented by $R_{54}$ are a 3-[2-(2,4-di-t-amylphenoxy)butanamido]benzamido group, a 3-[4-(2,4-di-t-amylphenoxy)butanamido]benzamido group, a 2-chloro-5-tetradecanamidoanilino group, a 5-(2,4-di-t-amylphenoxyacetamido)benzamido group, a 2-chloro-5-dodecenylsuccinimidoanilino group, a 2-chloro-5-[2-(3-t-butyl-4-hydroxyphenoxy)-tetradecanamido]anilino group, a 2,2-dimethylpropanimido group, a 2-(3-pentadecylphenoxy)-butanamido group, a pyrrolidino group and an N,N-dibutylamino group.

Specific examples of the group represented by $R_{55}$ are a 2,4,6-trichlorophenyl group, a 2-chlorophenyl group, a 2,5-dichlorophenyl group, a 2,3-dichlorophenyl group, a 2,6-dichloro-4-methoxyphenyl group, a 4-[2-(2,4-di-t-amylphenoxy)butanamido]phenyl group, and a 2,6-dichloro-4-methanesulfonylphenyl group.

Specific examples of the group represented by $R_{56}$ are a methyl group, an ethyl group, an isopropyl group, a methoxy group, an ethoxy group, a methylthio group, an ethylthio group, a 3-phenylureido group, a 3-butylureido group, and a 3-(2,4-di-t-amylphenoxy)propyl group.

Specific examples of the group represented by $R_{57}$ are a 3-(2,4-di-t-amylphenoxy)propyl group, a 3-[4-{2-[4-(4-hydroxyphenylsulfonyl)phenoxy]tetradecanamido}phenyl]propyl group, a methoxy group, an ethoxy group, a methylthio group, an ethylthio group, a methyl group, a 1-methyl-2-{2-octyloxy-5-[2-octyloxy-5-(1,1,3,3-tetramethylbutyl)phenylsulfonamido]phenylsulfonamido}ethyl group, a 3-[4-(4-dodecyloxyphenylsulfonamido)phenyl]propyl group, a 1,1-dimethyl-2-[2-octyloxy-5-(1,1,3,3-tetramethylbutyl)phenylsulfonamido]ethyl group, and a dodecylthio group.

Specific examples of the group represented by $R_{58}$ are a 2-chlorophenyl group, a pentafluorophenyl group, a heptafluoropropyl group, a 1-(2,4-di-t-amylphenoxy)-propyl group, a 3-(2,4-di-t-amylphenoxy)propyl group, a 2,4-di-t-amylmethyl group, and a furyl group.

Specific examples of the group represented by $R_{59}$ are a chlorine atom, a methyl group, an ethyl group, a propyl group, a butyl group, an isopropyl group, a 2-(2,4-di-t-amylphenoxy)butanamido group, a 2-(2,4-di-t-amylphenoxy)hexanamido group, a 2-(2,4-di-t-octylphenoxy)octanamido group, a 2-(2-chlorophenoxy)tetradecanamido group, a 2,2-dimethylpropanamido group, a 2-[4-(4-hydroxyphenylsulfonyl)phenoxy]tetradecanamido group, and a 2-[2-(2,4-di-t-amylphenoxyacetamido)phenoxy]butanamido group.

Specific examples of the group represented by $R_{60}$ are a 4-cyanophenyl group, a 2-cyanophenyl group, a 4-butylsulfonylphenyl group, a 4-propylsulfonylphenyl group, a 4-ethoxycarbonylphenyl group, a 4-N,N-diethylsulfamoylphenyl group, a 3,4-dichlorophenyl group, and a 3-methoxycarbonylphenyl group.

Specific examples of the group represented by $R_{61}$ are a dodecyl group, a hexadecyl group, a cyclohexyl group, a butyl group, a 3-(2,4-di-t-amylphenoxy)propyl group, a 4-(2,4-di-t-amylphenoxy)butyl group, a 3-dodecyloxypropyl group, a 2-tetradecyloxyphenyl group, a t-butyl group, a 2-(2-hexyldecyloxy)phenyl group, a 2-methoxy-5-dodecyloxycarbonylphenyl group, a 2-butoxyphenyl group, and a 1-naphthyl group.

Specific examples of the group represented by $R_{62}$ are an isobutyloxycarbonylamino group, an ethoxycarbonylamino group, a phenylsulfonylamino group, a methanesulfonamido group, a butanesulfonamido group, a 4-methylbenzenesulfonamido group, a benzamido group, a trifluoroacetamido group, a 3-phenylureido group, a butoxycarbonylamino group, and an acetamido group.

Specific examples of the group represented by $R_{63}$ are a 2,4-di-t-amylphenoxyacetamido group, a 2-(2,4-di-t-amylphenoxy)butanamido group, a hexadecylsulfonamido group, an N-methyl-N-octadecylsulfamoyl group, an N,N-dioctylsulfamoyl group, a dodecyloxycarbonyl group, a chlorine atom, a fluorine atom, a nitro group, a cyano group, an N-3-(2,4-di-t-amylphenoxy)propylsulfamoyl group, a methanesulfonyl group, and a hexadecylsulfonyl group.

Now, the preferred scope of the compounds represented by formula (II) described above, wherein A is as defined for formula (III) described above, is explained.

When P and Q in formula (III) represent a substituted or unsubstituted imino group, the imino group is preferably an imino group substituted by a sulfonyl group or an acyl group.

In this case, P and Q each is represented by the following formulae (N-1) or (N-2):

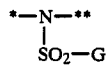

(N-1)

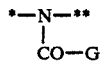

(N-2)

wherein the mark * represents a position bonding to $A_1$ or $A_2$ and the mark ** represents a position bonding to one of the free bonds of $-(X=Y)_n-$.

In the above formulae (N-1) and (N-2), preferred examples of the group shown by G are a straight or branched, chain or cyclic, saturated or unsaturated, substituted or unsubstituted aliphatic group having 1 to 32, preferably 1 to 22, carbon atoms (e.g., a methyl group, an ethyl group, a benzyl group, a phenoxybutyl group, an isopropyl group, etc.), a substituted or unsubstituted aromatic group having 6 to 10 carbon atoms (e.g., a phenyl group, a 4-methylphenyl group, a 1-naphthyl group, a 4-dodecyloxyphenyl group, etc.), and a 4-membered to 7-membered heterocyclic group having a hetero atom selected from a nitrogen atom, a sulfur atom and an oxygen atom (e.g., a 2-pyridyl group, a 1-phenyl-4-imidazolyl group, a 2-furyl group, a benzothienyl group, etc.).

When $A_1$ and $A_2$ in formula (III) described above represent a group capable of being removed by alkali (hereinafter, is referred to as precursor group), preferred examples of such a group are a hydrolyzable group such as an acyl group, an alkoxycarbonyl group, an aryloxycarbonyl group, a carbamoyl group, an imidoyl group, an oxazolyl group, a sulfonyl group, etc.; the precursor groups of a type utilizing a reverse Michel reaction described in U.S. Pat. No. 4,009,029; the precursor groups of a type utilizing an anion formed after the ring cleavage reaction as an intramolecular nucleophilic group described in U.S. Pat. No. 4,310,612; the precursor groups wherein an anion causes an electron transfer through a conjugated system and causes thereby a cleavage reaction as described in U.S. Pat. Nos. 3,674,478, 3,932,480 and 3,993,661; the precursor groups causing a cleavage reaction by the electron transfer of an anion reacted after causing ring cleavage as described in U.S. Pat. No. 4,335,200 and the precursor groups utilizing an imidomethyl group as described in U.S. Pat. Nos. 4,363,865 and 4,410,618.

In formula (III), it is preferred that P is an oxygen atom and $A_2$ is a hydrogen atom.

In formula (III), it is more preferred that X and Y are a substituted or unsubstituted methine group excluding the case that X and Y are a methine group having $-(L_1)_v-B-(L_2)_w-DI$ as the substituent.

Particularly preferred groups of the groups represented by formula (III) described above are represented by the following formulae (IV) or (V):

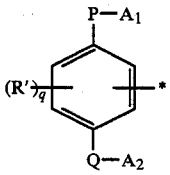

(IV)

-continued

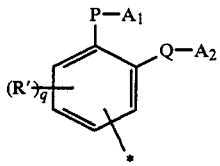

(V)

wherein the mark * represents a position bonding to $-(L_1)_v-B-(L_2)_w-DI$; P, Q, $A_1$ and $A_2$ have the same significance as defined above in regard to formula (III); R' represents a substituent; and q represents an integer of 0 to 3; when q is 2 or 3, the R's may be the same or different and also two R's may form a cyclic structure by linking to each other as divalent groups. In this case, the cyclic structure is a benzene condensed ring including, for example, naphthalenes, benzonorbornenes, chromans, indoles, benzothiophenes, quinolines, benzofurans, 2,3-dihydrobenzofurans, indanes, indenes, etc. They may further have one or more substituents.

Preferred examples of the substituent when the aforesaid condensed rings have substituent(s) and preferred examples of R' when R' does not form a condensed ring are as follows.

They can be an aliphatic group (e.g., a methyl group, an ethyl group, an allyl group, a benzyl group, a dodecyl group, etc.), an aromatic group (e.g., a phenyl group, a naphthyl group, a 4-phenoxycarbonyl group, etc.), a halogen atom (e.g., a chlorine atom, a bromine atom, etc.), an alkoxy group (e.g., a methoxy group, a hexadecyloxy group, etc.), an alkylthio group (e.g., a methylthio group, a dodecylthio group, a benzylthio group, etc.), an aryloxy group (e.g., a phenoxy group, a 4-t-octylphenoxy group, a 2,4-di-t-amylphenoxy group, etc.), an arylthio group (e.g., a phenylthio group, a 4-dodecyloxyphenylthio group, etc.), a carbamoyl group (e.g., an N-ethylcarbamoyl group, an N-propylcarbamoyl group, an N-hexadecylcarbamoyl group, an N-t-butylcarbamoyl group, an N-3-(2,4-di-t-amylphenoxy)propylcarbamoyl group, an N-methyl-N-octadecylcarbamoyl group, etc.), an alkoxycarbonyl group (e.g., a methoxycarbonyl group, a 2-cyanoethoxycarbonyl group, an ethoxycarbonyl group, a dodecyloxycarbonyl group, a 3-(2,4-di-t-amylphenoxy)propoxycarbonyl group, etc.), an aryloxycarbonyl group (e.g., a phenoxycarbonyl group, a 4-nonylphenoxycarbonyl group, etc.), a sulfonyl group (e.g., a methanesulfonyl group, a benzenesulfonyl group, a p-toluenesulfonyl group, etc.), a sulfamoyl group (e.g., an N-propylsulfamoyl group, an N-methyl-N-octadecylsulfamoyl group, an N-phenylsulfamoyl group, an N-dodecylsulfamoyl group, etc.), an acylamino group (e.g., an acetamido group, a benzamido group, a tetradecanamido group, a 4-(2,4-di-t-amylphenoxy)butanamido group, a 2-(2,4-di-t-amylphenoxy)butanamido group, a 2-(2,4-di-t-amylphenoxy)tetradecanamido group, etc.), a sulfonamido group (e.g., a methanesulfonamido group, a benzenesulfonamido group, a hexadecylsulfonamido group, etc.), an acyl group (e.g., an acetyl group, a benzoyl group, a myristoyl group, a palmitoyl group, etc.), a nitroso group, an acyloxy group (e.g., an acetoxy group, a benzoyloxy group, a lauryloxy group, etc.), a ureido group (e.g., a 3-phenylureido group, a 3-(4-cyanophenylureido group, etc.), a nitro group, a cyano group, a heterocyclic group (a 4-membered to 6-membered heterocyclic group having a hetero atom selected from a nitrogen atom, an oxygen atom, and a sulfur atom, e.g., a 2-furyl group, a 2-pyridyl group, a 1-imidazolyl group, a 1-morpholino group, etc.), a hydroxy group, a carboxy group, an alkoxycarbonylamino group (e.g., a methoxycarbonylamino group, a phenoxycarbonylamino group, a dodecyloxycarbonylamino group, etc.), a sulfo group, an amino group, an arylamino group (e.g., an anilino group, a 4-methoxycarbonylanilino group, etc.), an aliphatic amino group (e.g., an N,N-diethylamino group, a dodecylamino group, etc.), a sulfinyl group (e.g., a benzenesulfinyl group, a propylsulfinyl group, etc.), a sulfamoylamino group (e.g., a 3-phenylsulfamoylamino group, etc.), a thioacyl group (e.g., a thiobenzoyl group, etc.), a thioureido group (e.g., a 3-phenylthioureido group), a heterocyclic thio group (e.g., a thiadiazolylthio group, etc.), an imido group (e.g., a succinimido group, a phthalimido group, an octadecenylimido group, etc.), and a heterocyclic amino group (e.g., a 4-imidazolylamino group, a 4-pyridylamino group, etc.).

When the substituents illustrated above have an aliphatic group as the partial structure, the aliphatic group is a straight or branched, chain or cyclic, saturated or unsaturated, substituted or unsubstituted aliphatic group having 1 to 32, preferably 1 to 20, carbon atoms.

Also, when the substituents illustrated above have an aromatic group as the partial structure, the aromatic group has 6 to 10 carbon atoms and is preferably a substituted or unsubstituted phenyl group.

In formula (II), the group shown by B is preferably represented by formula (B-1) described above. In formula (B-1), P preferably represents an oxygen atom, and Q preferably represents an oxygen atom or a group shown by the following formulae:

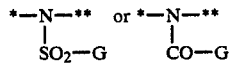

wherein *, ** and G have the same significance as defined above for the formulae (N-1) and (N-2).

Furthermore, when the group shown by B in formula (II) described above is represented by the following formulae (B-2) or (B-3), particularly preferred effects of this invention can be obtained.

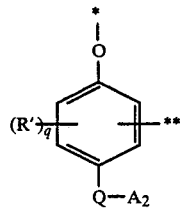

(B-2)

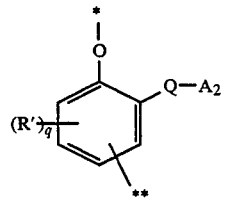

(B-3)

wherein the mark * represents a bond bonding to $A\text{-}(L_1)_v$, the mark ** represents a bond bonding to $(L_2)_w\text{-}DI$, and R', Q, $A_2$ and q have the same significance as defined above for formulae (IV) or (V).

In formulae (B-2) and (B-3), preferred examples of the groups shown by R' are as follows.

In addition, in the examples shown below, the total carbon atom number of the group illustrated is preferably 15 or less.

Preferred examples of the group shown by R' are an aliphatic group (e.g., a methyl group, an ethyl group, etc.), an alkoxy group (e.g., a methoxy group, an ethoxy group, etc.), an alkylthio group (e.g., a methylthio group, an ethylthio group, etc.), an alkoxycarbonyl group (e.g., a methoxycarbonyl group, a propoxycarbonyl group, etc.), an aryloxycarbonyl group (e.g., a phenoxycarbonyl group, etc.), a carbamoyl group (e.g., an N-propylcarbamoyl group, an N-t-butylcarbamoyl group, an N-ethylcarbamoyl group, etc.), a sulfonamido group (e.g., a methanesulfonamido group, etc.), an acylamido group (e.g., an acetamido group, etc.), a heterocyclic thio group (e.g., a tetrazolylthio group, etc.), a hydroxy group, and an aromatic group.

In formula (II) described above, it is also preferred that v and w are both 0.

Also, in formula (II), A is particularly preferably a coupler residue.

Now, more preferred embodiments of the compounds represented by formula (II) described above in this invention are explained below.

The particularly preferred DI of the compound represented by formula (II) is a development inhibitor which is a compound having a development inhibiting property when it is cleaved as DI but has a property of being decomposed (or converted) into a compound having substantially no influences on the photographic properties of the color photographic material after DI is dissolved in the color developer.

Specific examples of DI in formula (II) are the development inhibitors described in U.S. Pat. No. 4,477,563, Japanese Patent Application (OPI) Nos. 218644/85, 221750/85, 233650/85 and 11743/86. Preferred examples of DI are those represented by the following formulae (D-1), (D-2), (D-3), (D-4), (D-5), (D-6), (D-7), (D-8), (D-9), (D-10) or (D-11):

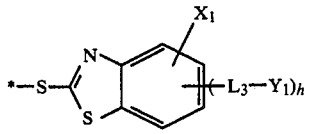

(D-1)

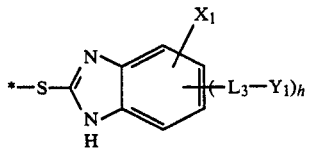

(D-2)

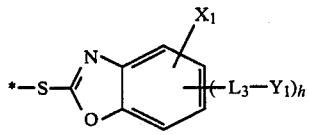

(D-3)

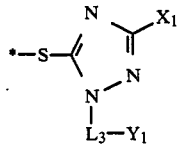

(D-4)

-continued (D-5)

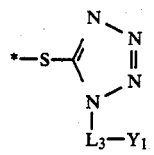

(D-6)

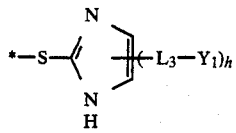

(D-7)

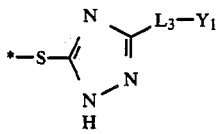

(D-8)

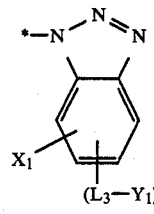

(D-9)

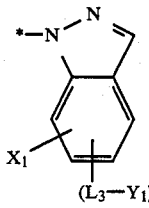

(D-10)

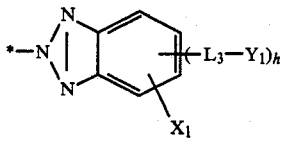

(D-11)

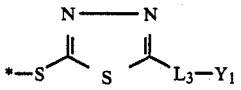

In the above formulae (D-1) to (D-11), the mark * represents a position bonding to $A\text{-}(L_1)_v\text{-}B\text{-}(L_2)_w$ in formula (II) described above; $X_1$ represents a hydrogen atom or a substituent; h represents 1 or 2; $L_3$ represents a group having a chemical bond which is cleaved in a color developer; and $Y_1$ represents a group showing a development inhibiting action, such as an aliphatic group, an aromatic group, or a heterocyclic group.

The above-described development inhibitor diffuses into photographic layers while showing a development inhibiting action after being cleaved from $A\text{-}(L_1)_v\text{-}B\text{-}(L_2)_w$ and is partially dissolved in a color developer. The development inhibitor dissolved in the processing solution reacts with a hydroxyl ion or a hydroxylamine generally contained in the processing solution to be quickly decomposed (e.g., the hydrolysis of an ester bond) to release the group shown by $Y_1$ in the aforesaid formulae and the resulting compound is converted into a compound having high water solubility and less development inhibiting property, whereby the development inhibiting action thereof substantially vanishes.

$X_1$ in the aforesaid formulae is preferably a hydrogen atom but may represent a substituent such as an aliphatic group (e.g., a methyl group, an ethyl group, etc.), an acylamido group (e.g., an acetamido group, a propionamido group, etc.), an alkoxy group (e.g., a methoxy group, an ethoxy group, etc.), a halogen atom (e.g., a chlorine atom, a bromine atom, etc.), a nitro group, and a sulfonamido group (e.g., a methanesulfonamido group, etc.).

The linkage group shown by $L_3$ in the aforesaid formulae includes a chemical bond which is cleaved in a color developer. Examples of such a chemical bond are shown in the following table. These chemical bonds are cleaved by a nucleophilic reagent such as a hydroxyl ion or a hydroxylamine existing in a color developer.

| Chemical Bond Contained in $L_3$ | Cleavage Reaction of the Chemical Bond (reaction with $^-OH$) |
|---|---|
| $-COO-$ | $-COOH- + HO-$ |
| $-NHCOO-$ | $-NH_2 + HO-$ |
| $-SO_2O-$ | $-SO_2H + HO-$ |
| $-OCH_2CH_2SO_2-$ | $-OH + CH_2 = CHSO_2-$ |
| $-OC(=O)-$ | $-OH + HO-$ |
| $-NHC(=O)C(=O)-$ | $-NH_2 + HO-$ |

One bond of the chemical bond mode shown in the above table is bonded to the heterocyclic ring directly or through an alkylene and/or a phenylene group and the other bond thereof is directly bonded to $Y_1$. When the chemical bond is bonded to the heterocyclic ring through an alkylene group or a phenylene group, the divalent group existing between the chemical bond and the heterocyclic ring may include an ether bond, an amido bond, a carbonyl bond, a thioether bond, a sulfone bond, a sulfonamido bond or a urea bond.

When $Y_1$ in the aforesaid formulae represents an aliphatic group, it is a saturated or unsaturated, straight or branched, chain or cyclic, substituted or unsubstituted hydrocarbon group having 1 to 20 carbon atoms, preferably 1 to 10 carbon atoms, and is particularly preferably a substituted hydrocarbon group.

When $Y_1$ represents an aromatic group, it is a substituted or unsubstituted phenyl group or a substituted or unsubstituted naphthyl group.

When $Y_1$ represents a heterocyclic group, it is a 4-membered to 8-membered heterocyclic ring containing a sulfur atom, an oxygen atom or a nitrogen atom as the hetero atom.

Examples of the heterocyclic group shown by $Y_1$ are a pyridyl group, an imidazolyl group, a furyl group, a pyrazolyl group, an oxazolyl group, a thiazolyl group, a thiadiazolyl group, a triazolyl group, a diazolidinyl group, and a diazinyl group.

When the aforesaid aliphatic hydrocarbon group, aromatic group, and heterocyclic group have a substituent, examples of the substituent are a halogen atom, a nitro group, an alkoxy group having 1 to 10 carbon atoms, an aryloxy group having 6 to 10 carbon atoms, an alkanesulfonyl group having 1 to 10 carbon atoms, an arylsulfonyl group having 6 to 10 carbon atoms, an alkanamido group having 1 to 10 carbon atoms, an anilino group, a benzamido group, an alkylcarbamoyl group having 1 to 10 carbon atoms, a carbamoyl group, an arylcarbamoyl group, an alkylsulfonamido group having 1 to 10 carbon atoms, an arylsulfonamido group having 6 to 10 carbon atoms, an alkylthio group having 1 to 10 carbon atoms, an arylthio group having 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having 1 to 10 carbon atoms, an alkanoyl group having 1 to 10 carbon atoms, a benzoyl group, an alkanoyloxy group having 1 to 10 carbon atoms, a benzyloxy group, a perfluoroalkyl group having 1 to 5 carbon atoms, a cyano group, a tetrazolyl group, a hydroxy group, a mercapto group, an amino group, a sulfamoyl group having 1 to 10 carbon atoms, an arylsulfamoyl group having 6 to 10 carbon atoms, a morpholino group, an aryl group having 6 to B 10 carbon atoms, a pyrrolidinyl group, a ureido group, a urethane group, an alkoxycarbonyl group having 1 to 10 carbon atoms, an aryloxycarbonyl group having 6 to 10 carbon atoms, an imidazolidinyl group, and an alkylidenamino group having 1 to 10 carbon atoms.

Examples of the compounds represented by formulae (I) or (II) described above for use in this invention are illustrated below, but the invention is not to be construed as being limited th these examples.

(1)

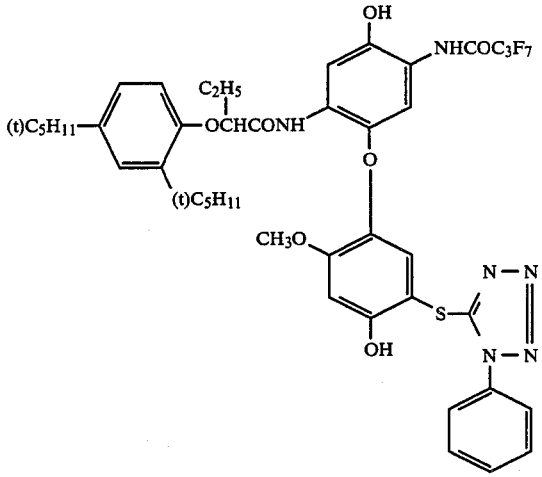

(2)

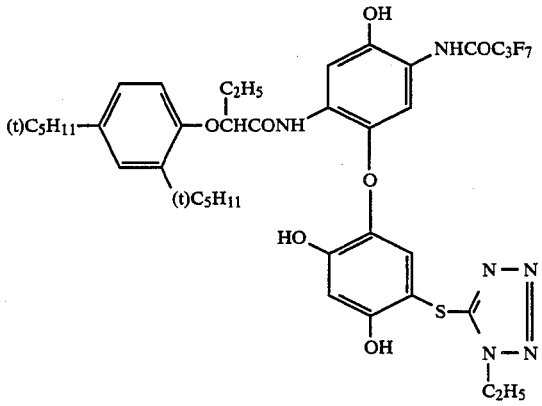

(3)

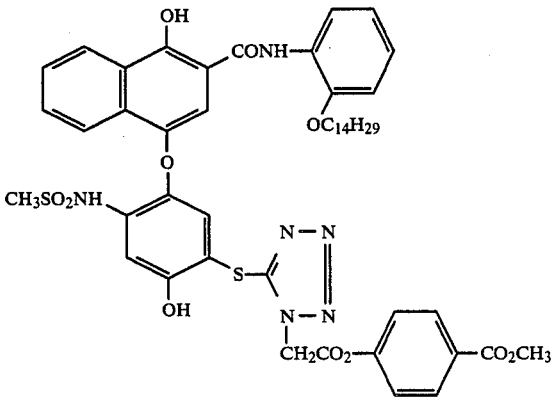

-continued
(4)
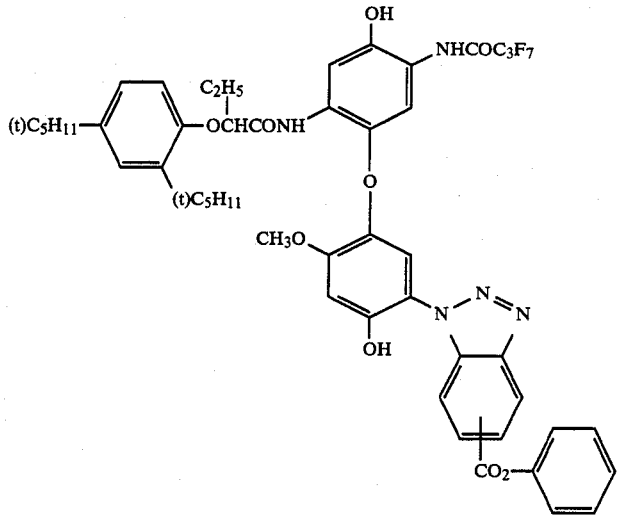
(5)
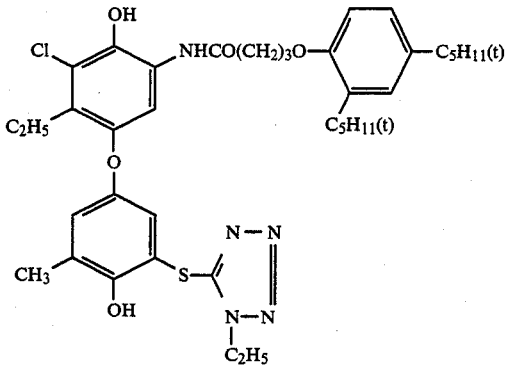
(6)
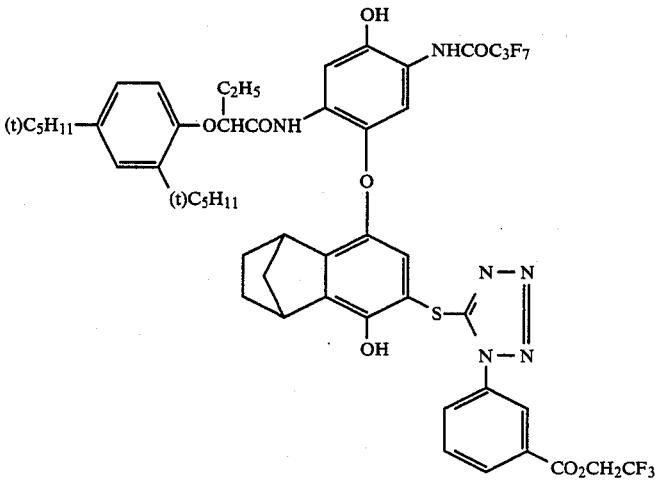

-continued
(7)
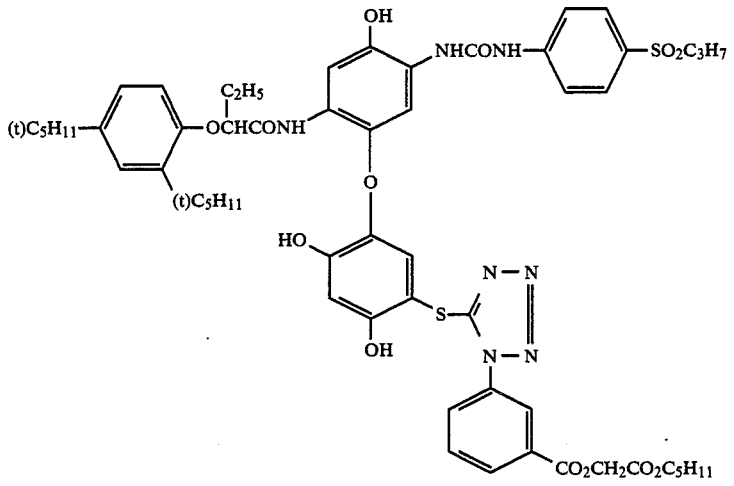
(8)
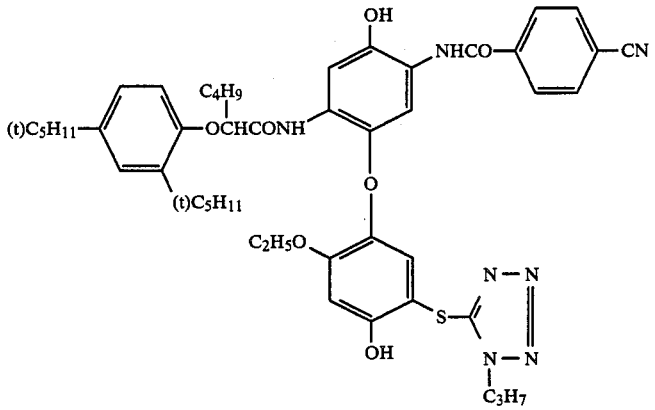
(9)
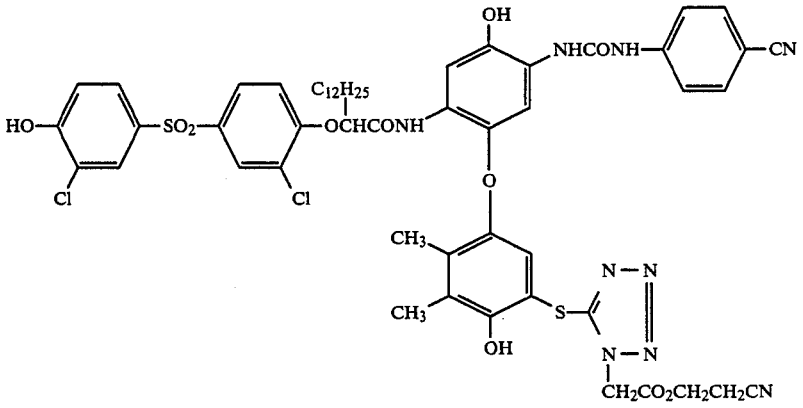

-continued
(10)
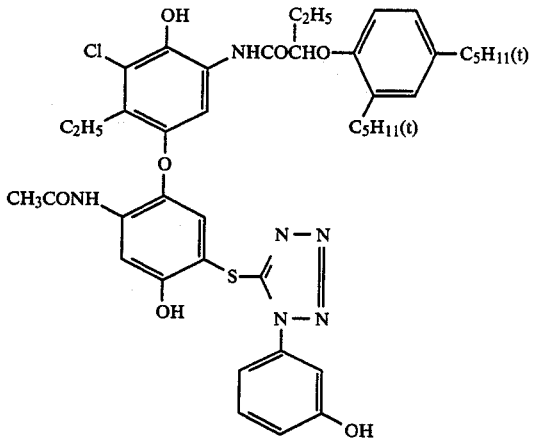
(11)
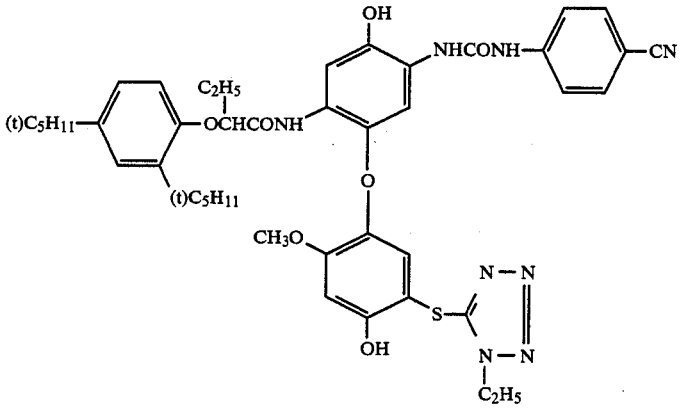
(12)
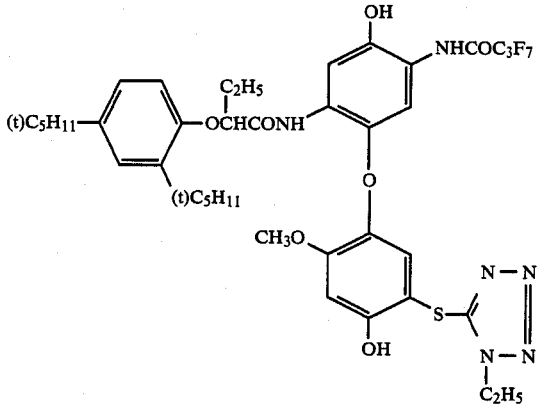
(13)
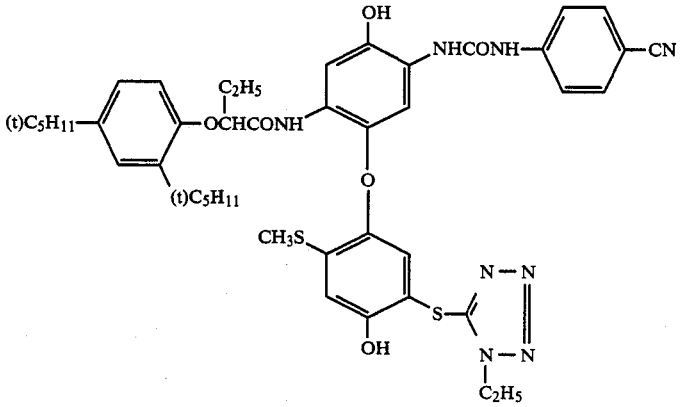

-continued
(14)
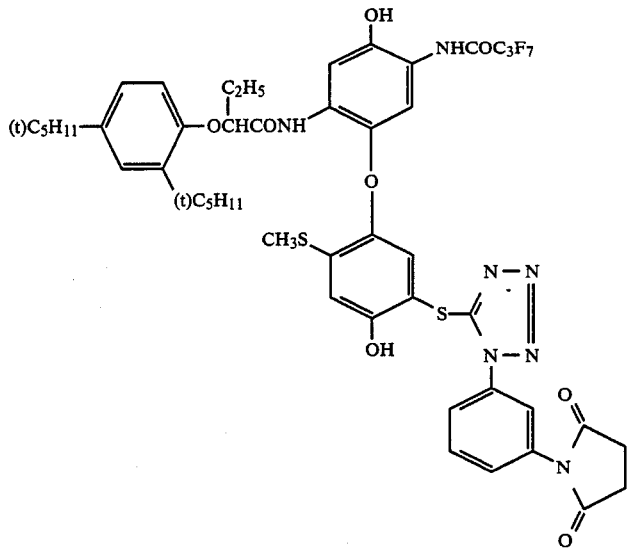
(15)
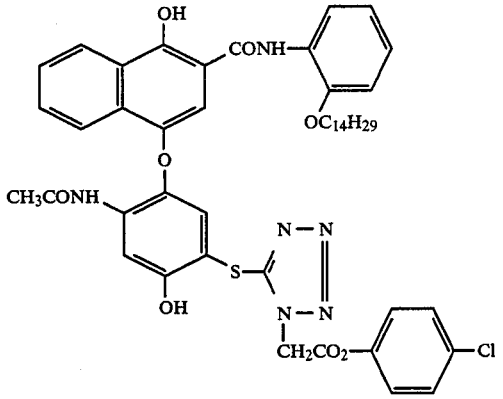
(16)
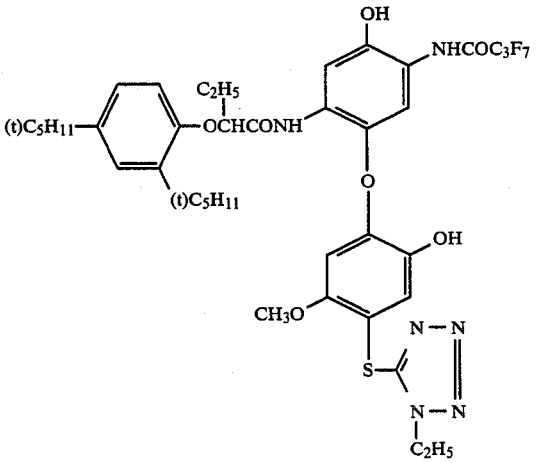

-continued
(17)
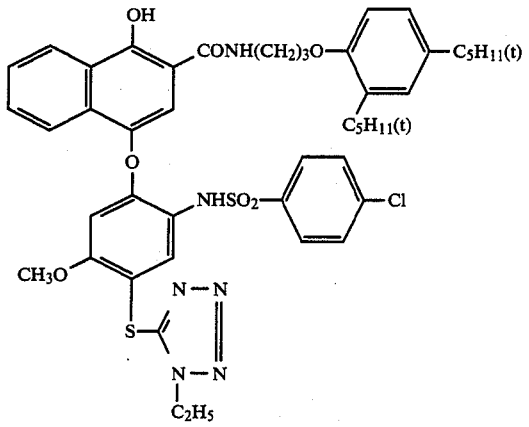
(18)
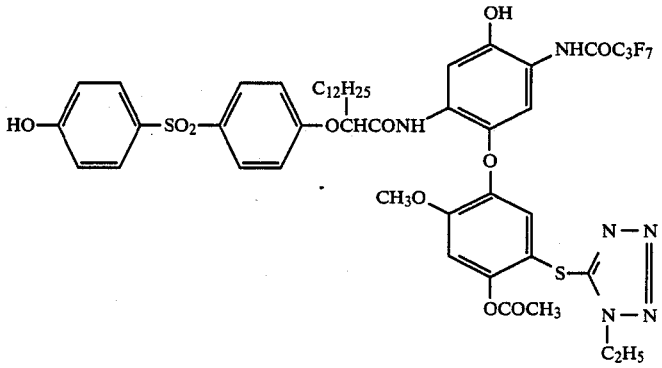
(19)
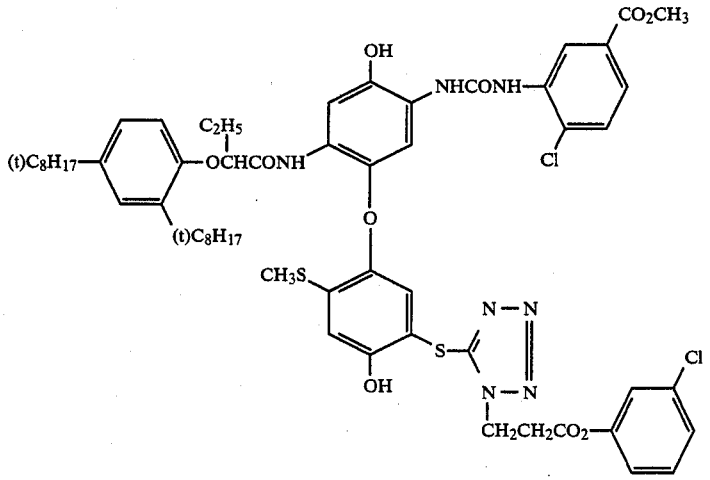
(20)
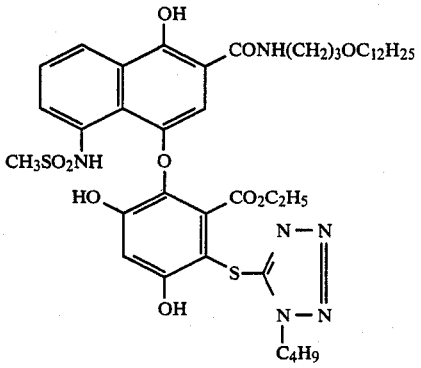

-continued
(21)
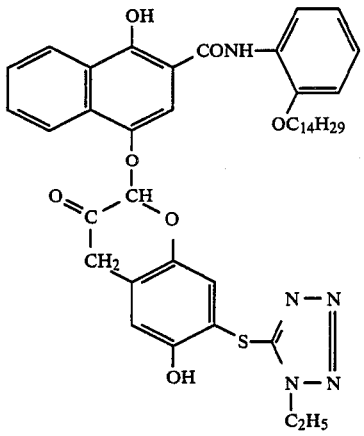
(22)
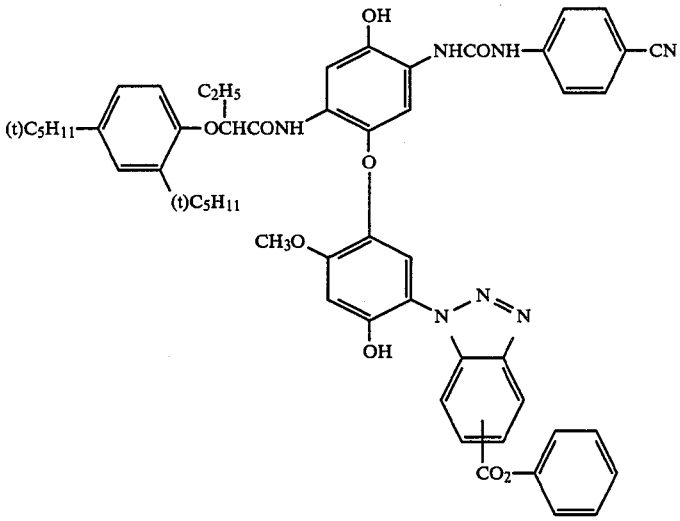
(23)
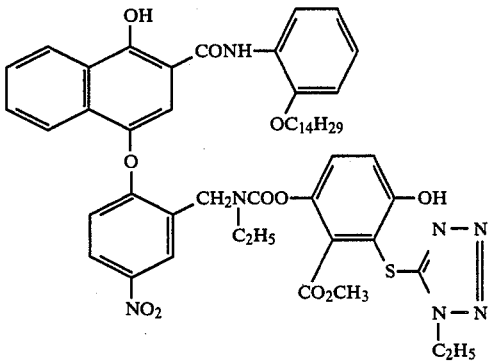

-continued
(24)
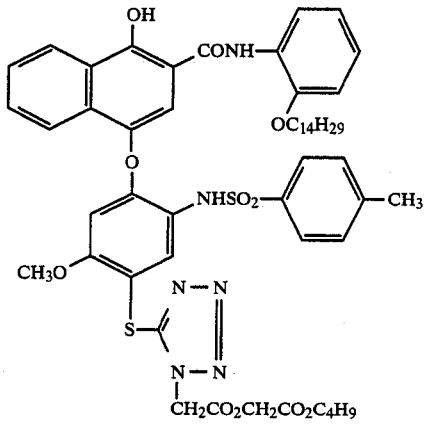
(25)
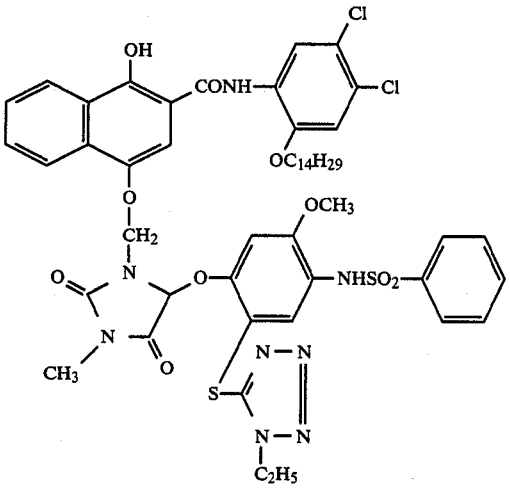
(26)
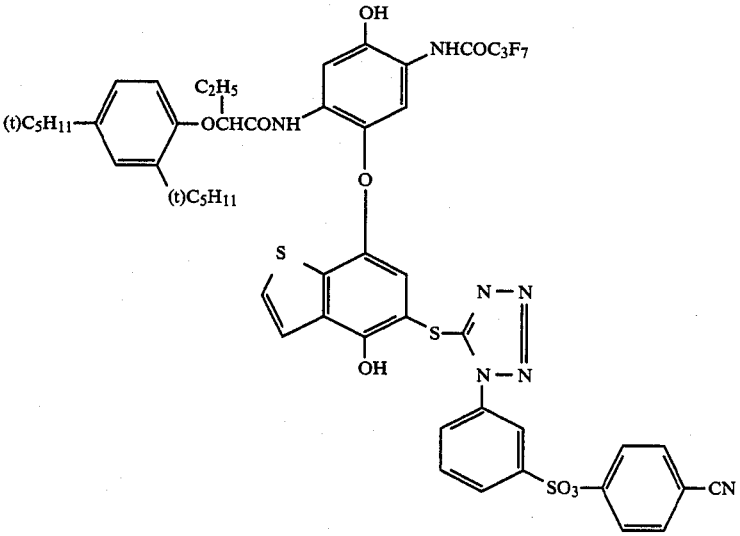

-continued
(27)
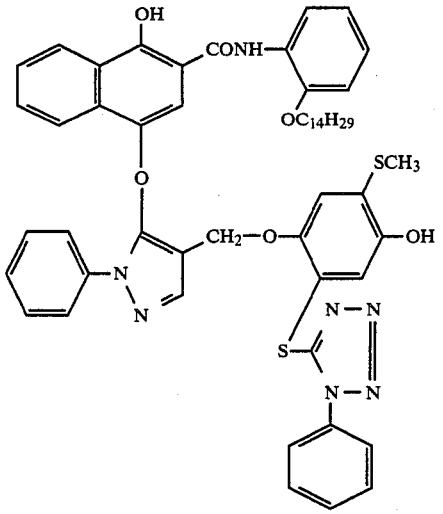
(28)
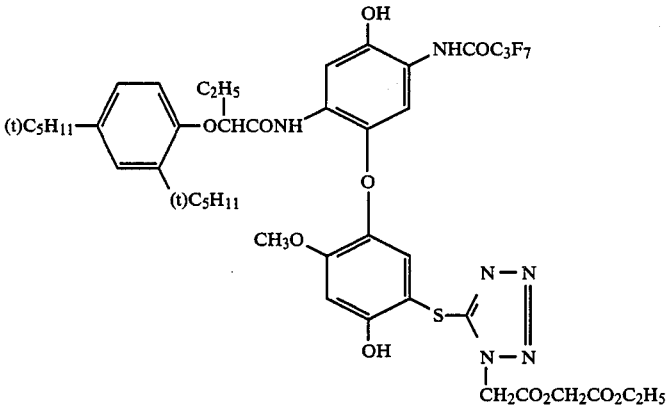
(29)
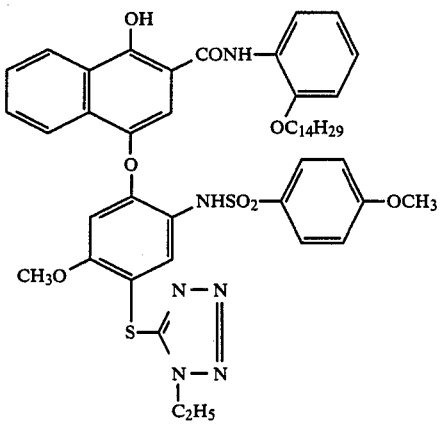

-continued
(30)
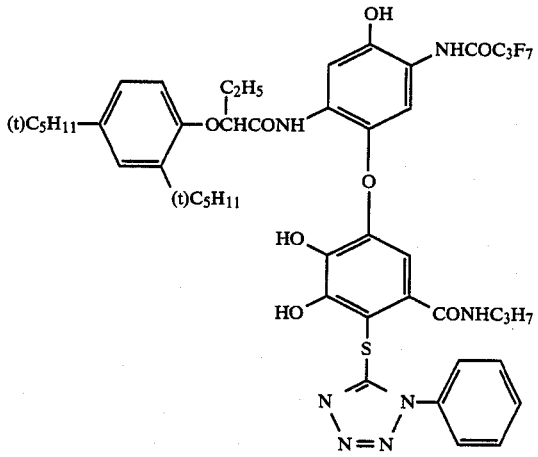
(31)
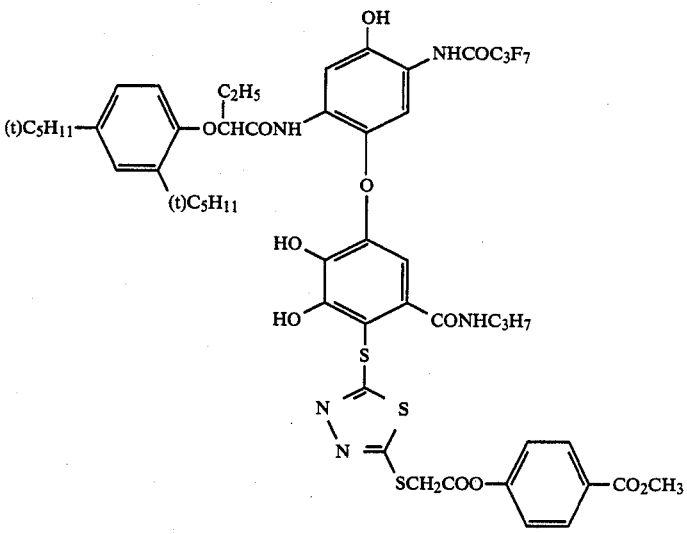
(32)
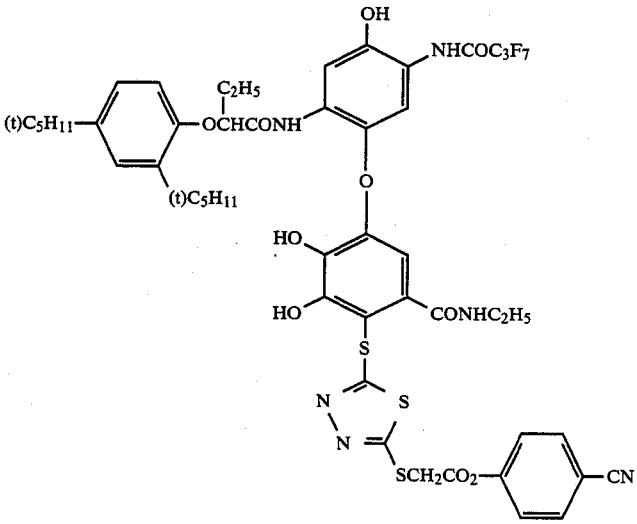

-continued
(33)
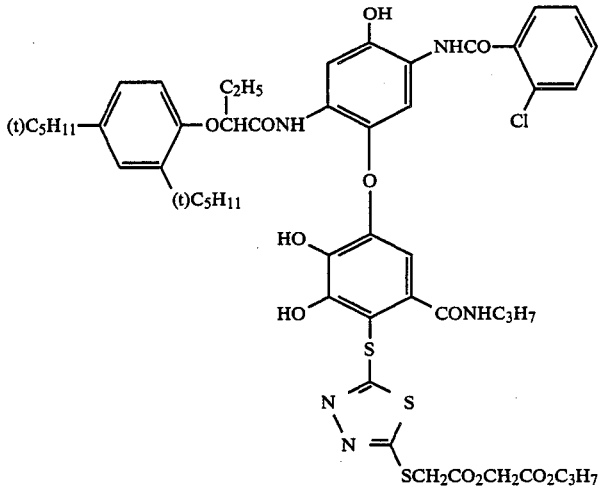
(34)
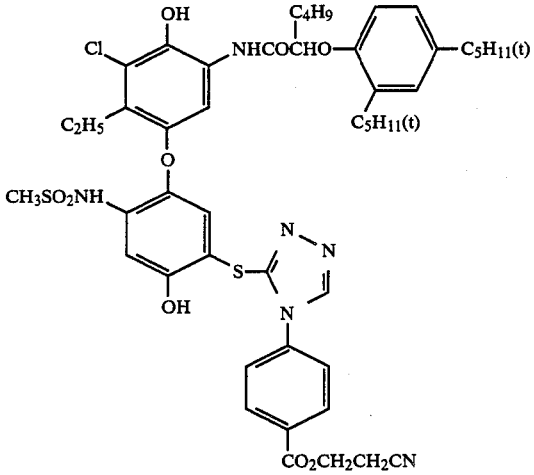
(35)
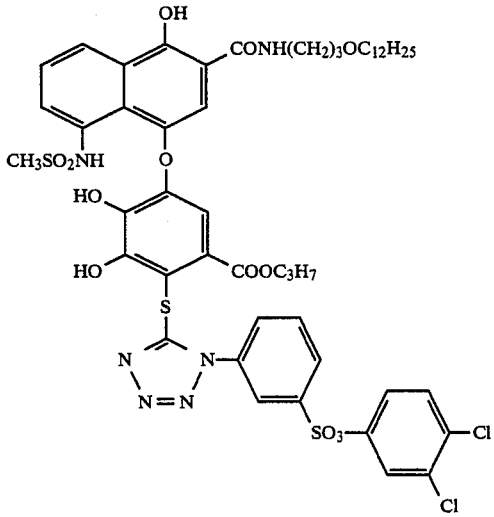

-continued
(36)
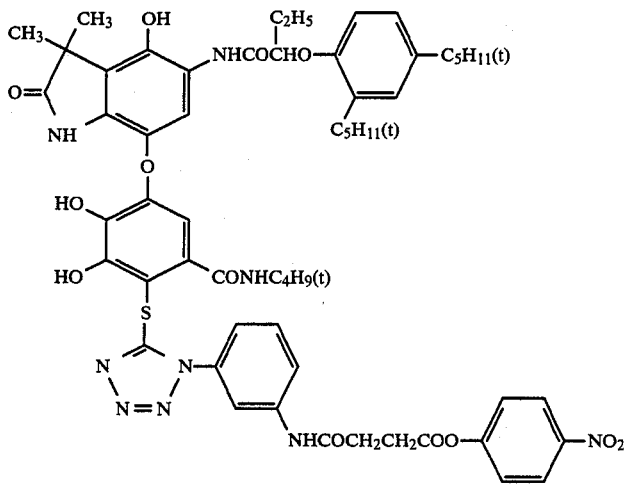
(37)
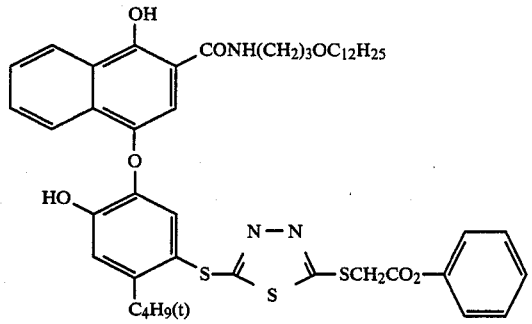
(38)
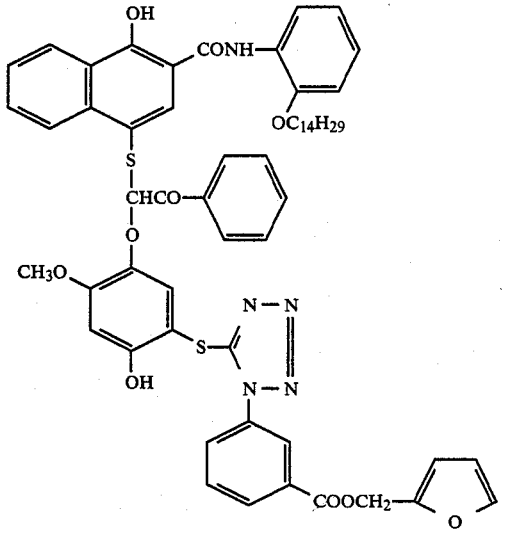

-continued
(39)
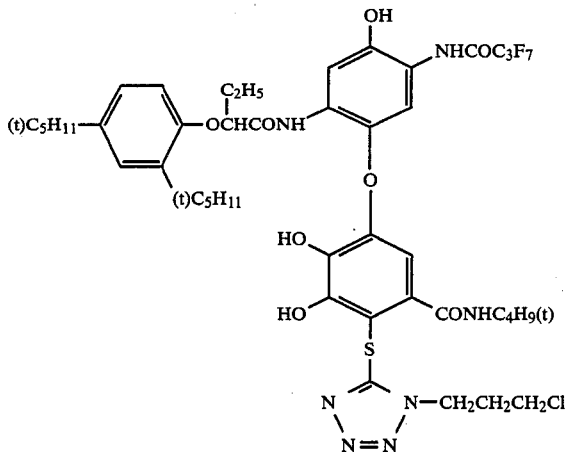
(40)
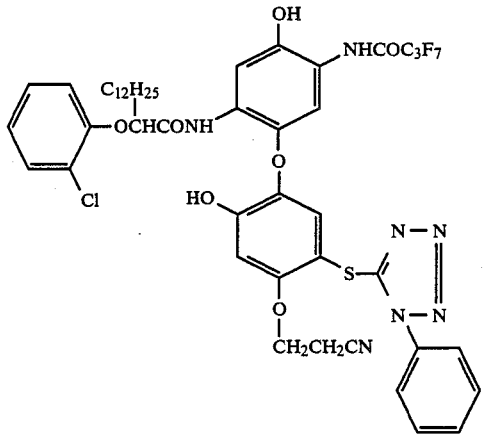
(41)
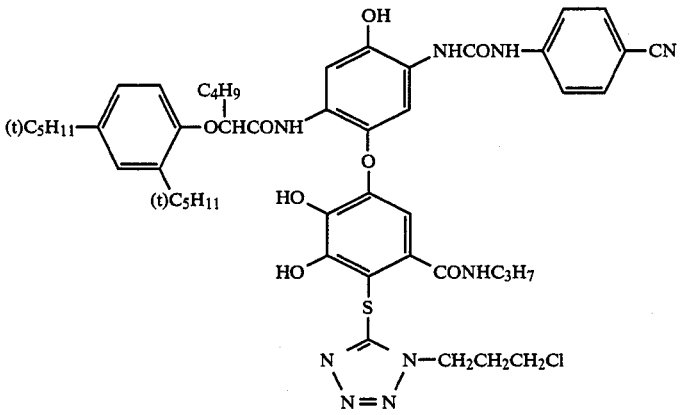
(42)
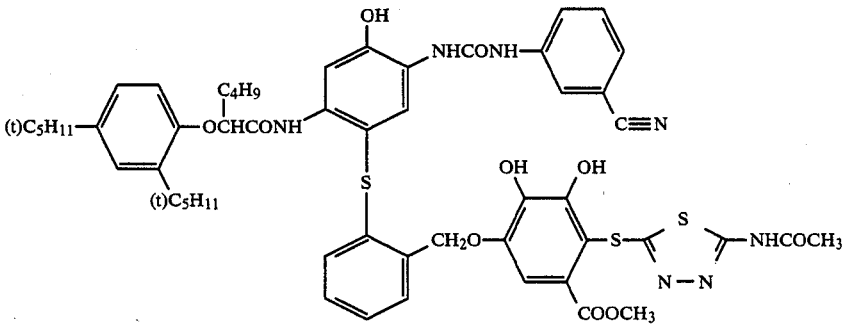

-continued
(43)
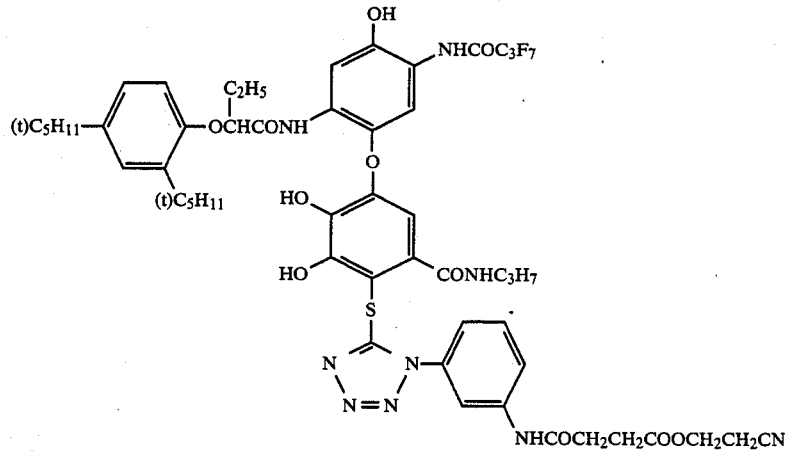
(44)
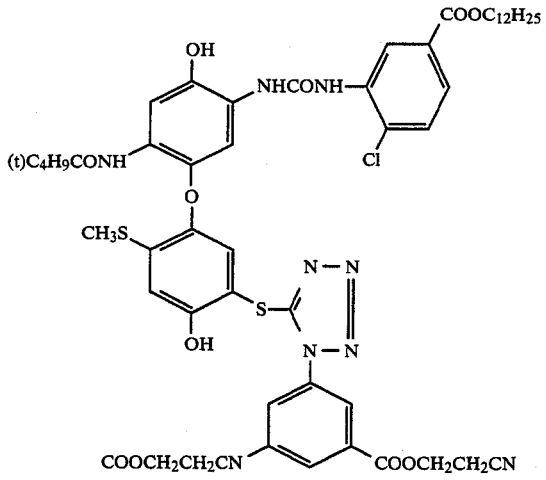
(45)
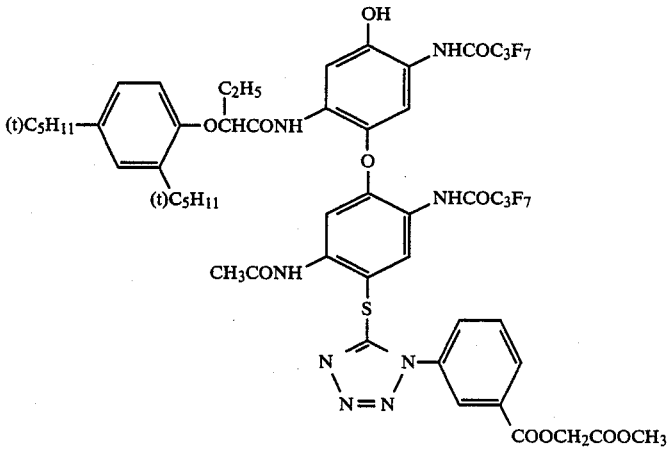

-continued
(46)
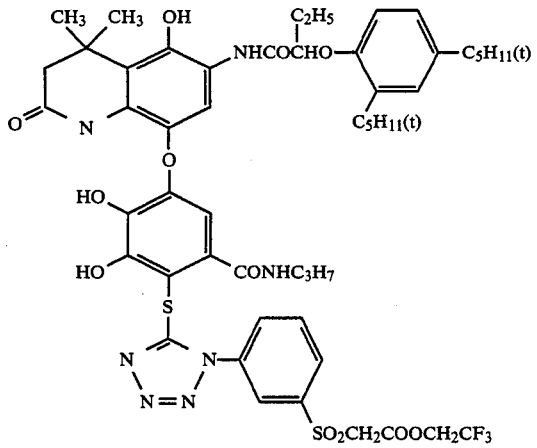
(47)
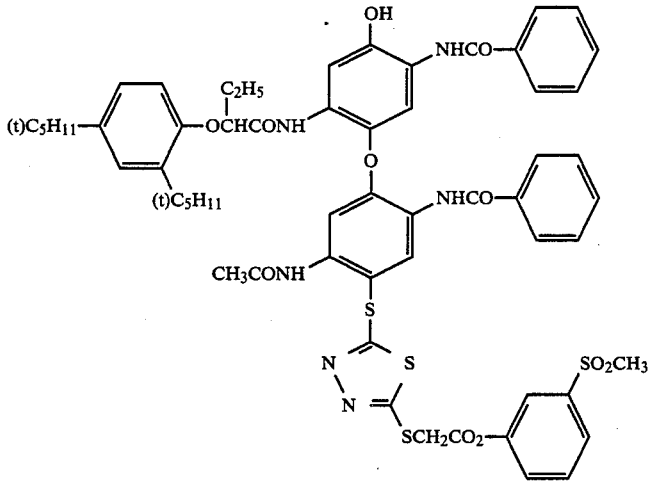
(48)
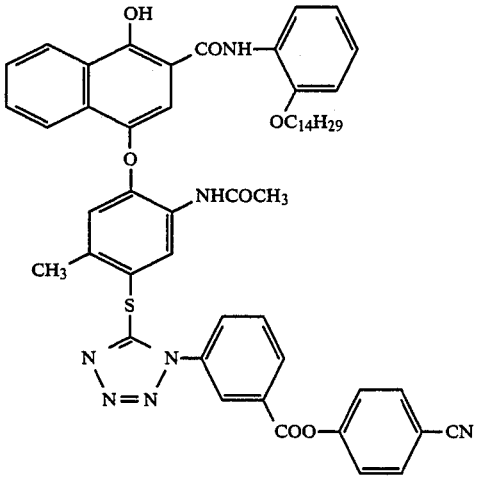

-continued
(49)
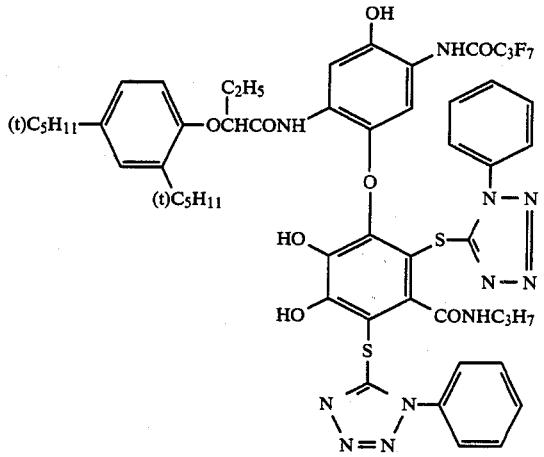
(50)
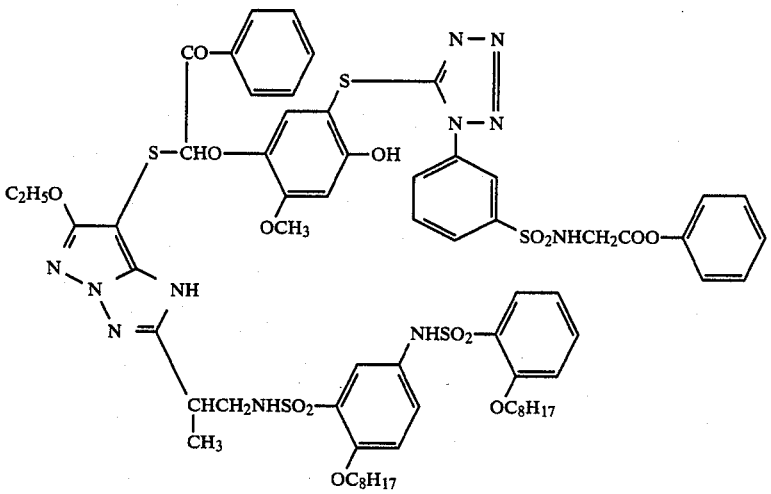
(51)
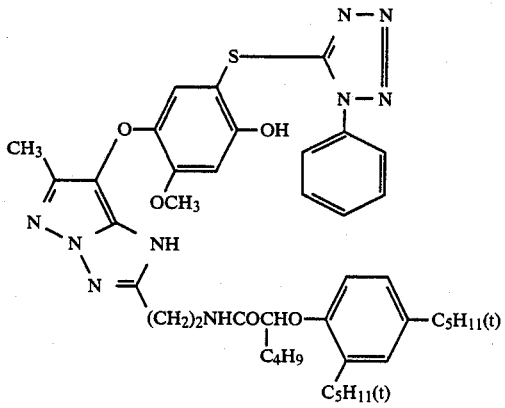

-continued
(52)
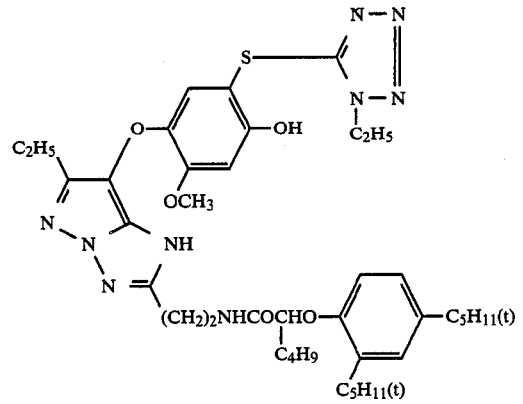
(53)
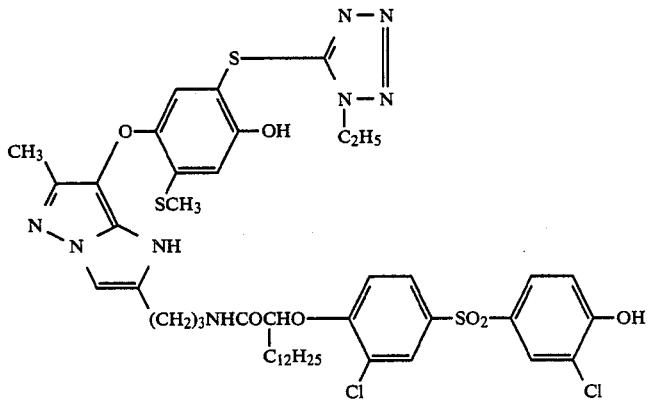
(54)
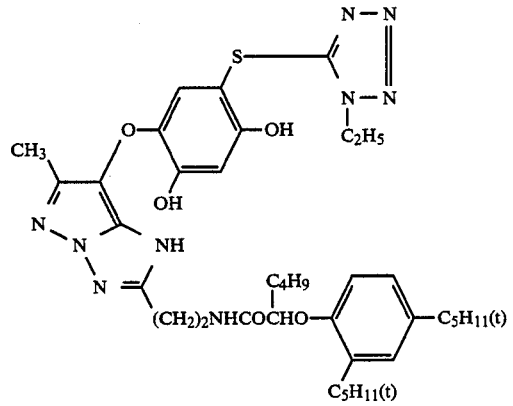
(55)
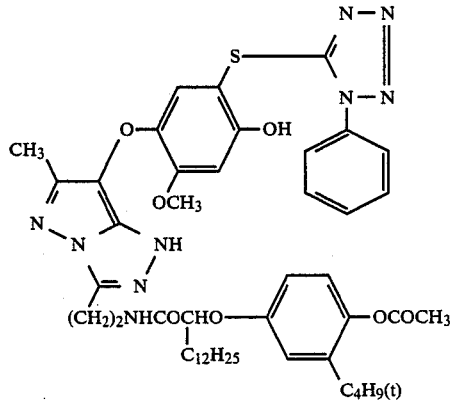

-continued
(56)
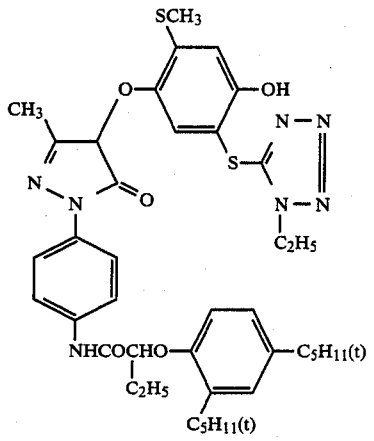
(57)
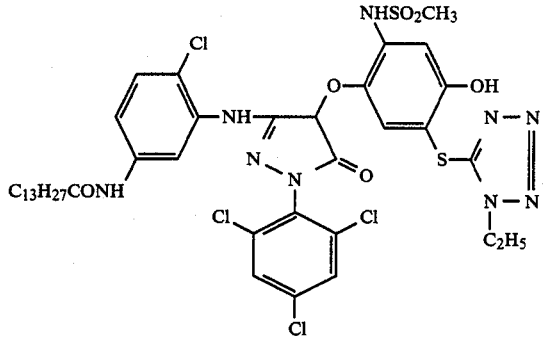
(58)
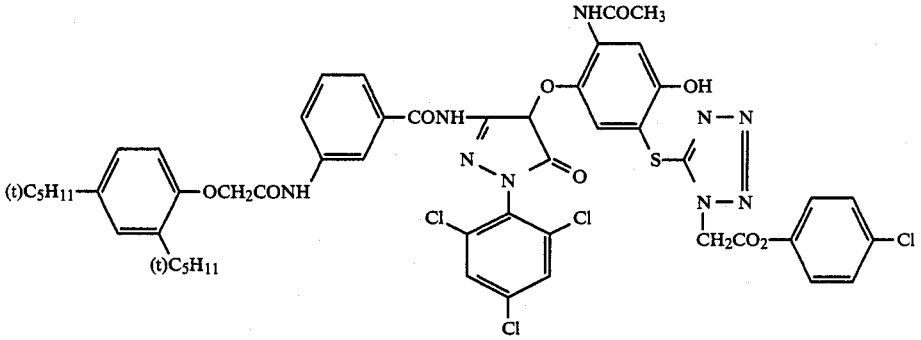
(59)
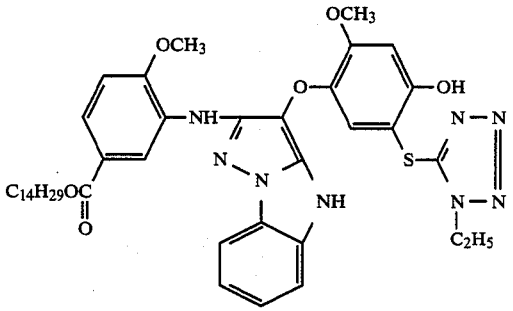

(60)
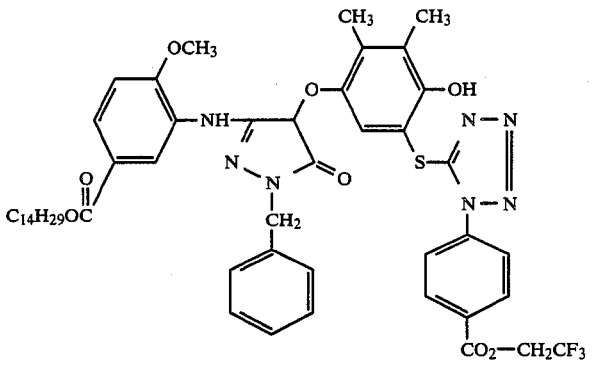
(61)
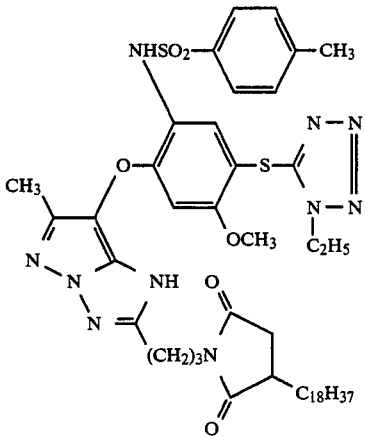
(62)
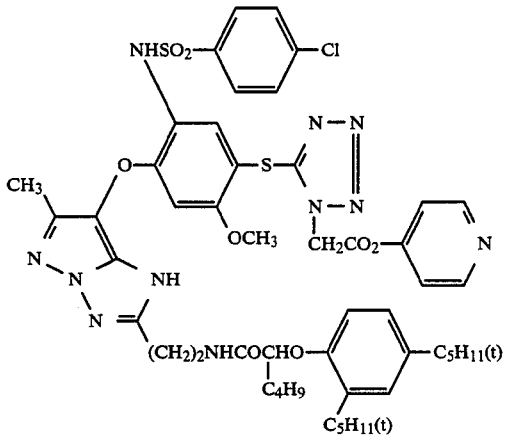
(63)
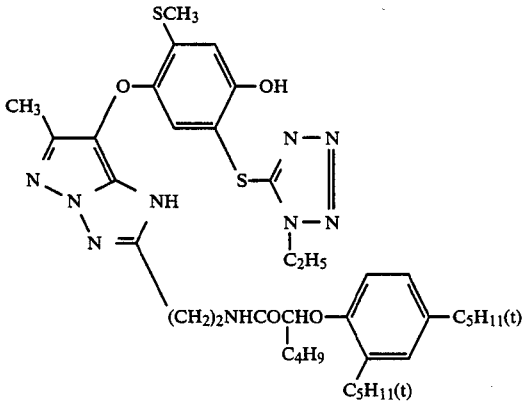

-continued
(64)
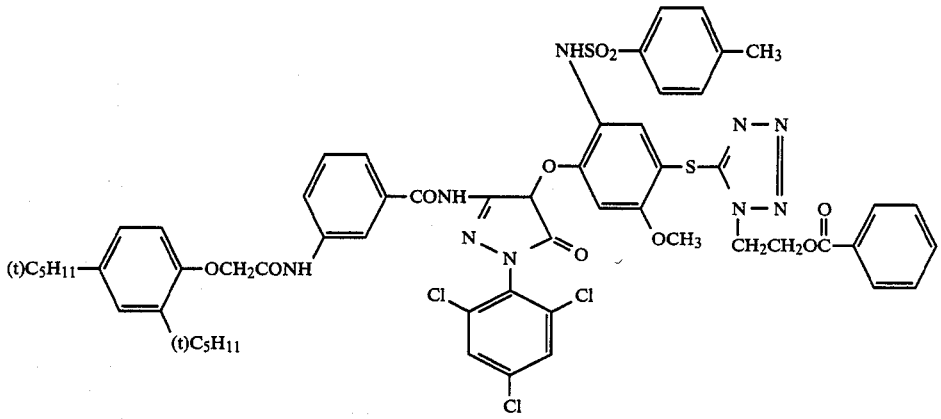
(65)
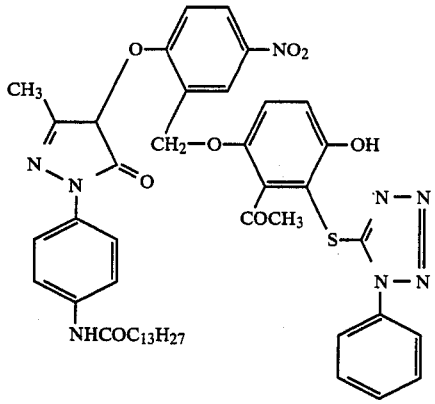
(66)
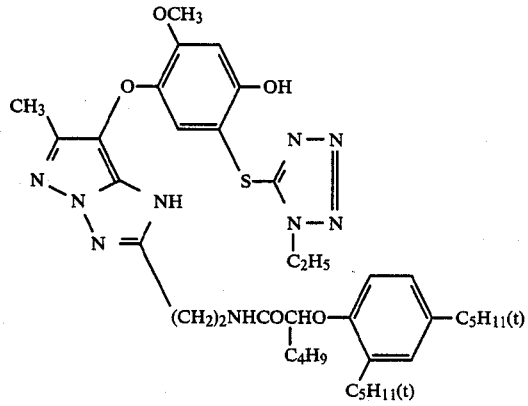

-continued
(67)
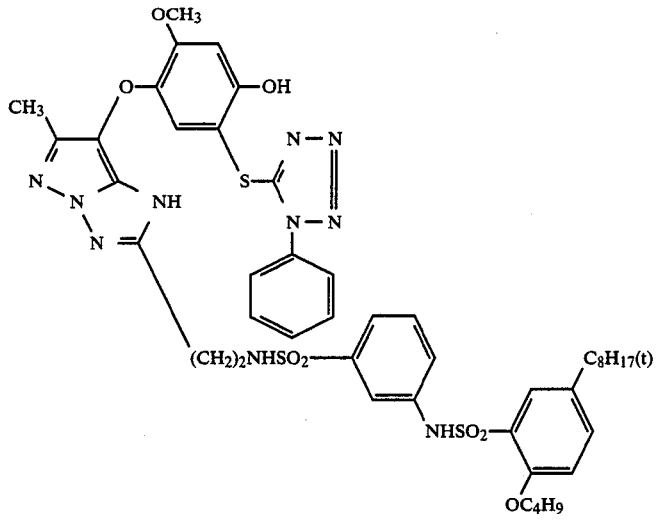
(68)
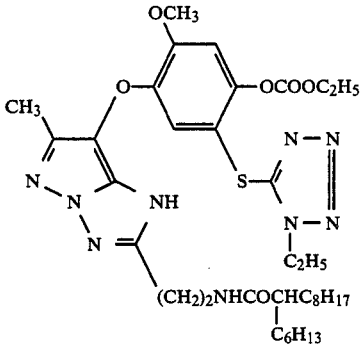
(69)
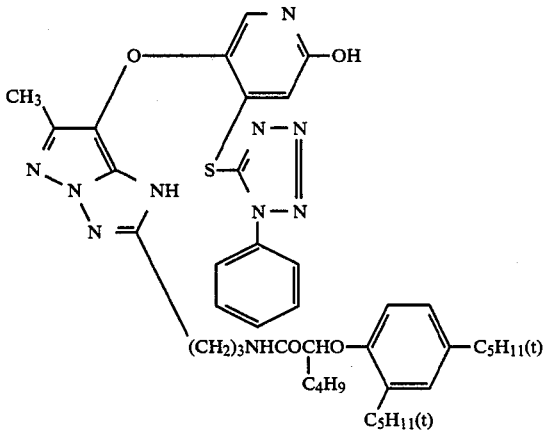

-continued
(70)
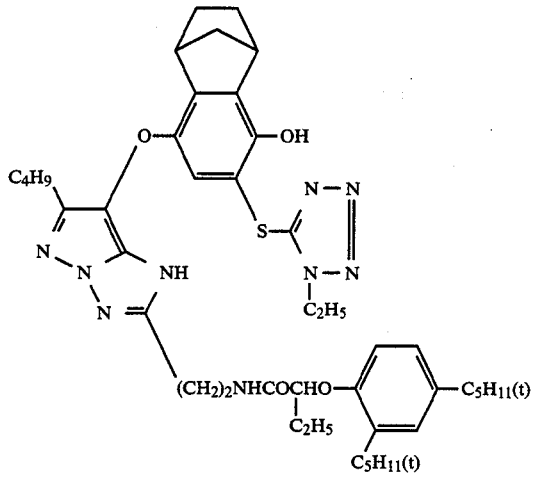
(71)
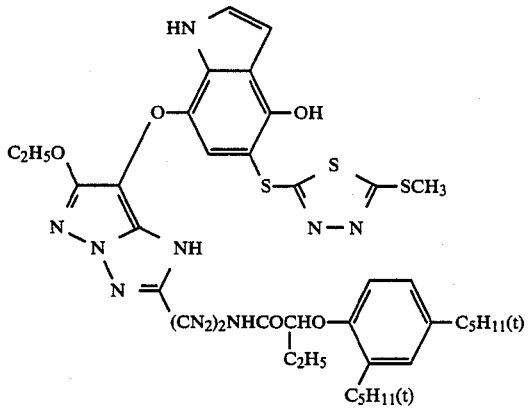
(72)
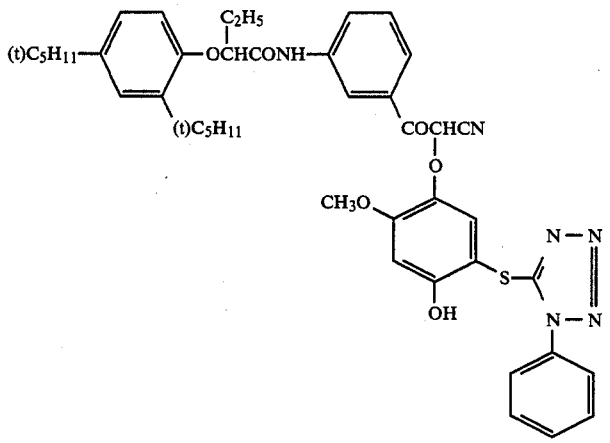

-continued
(73)
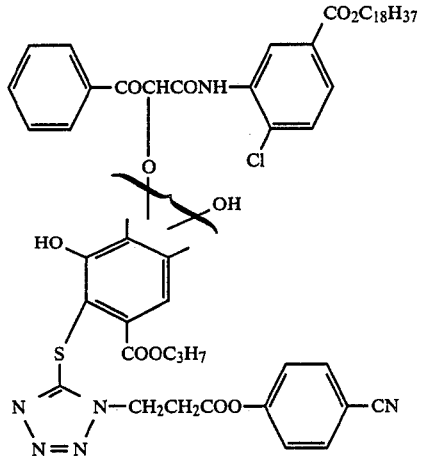
(74)
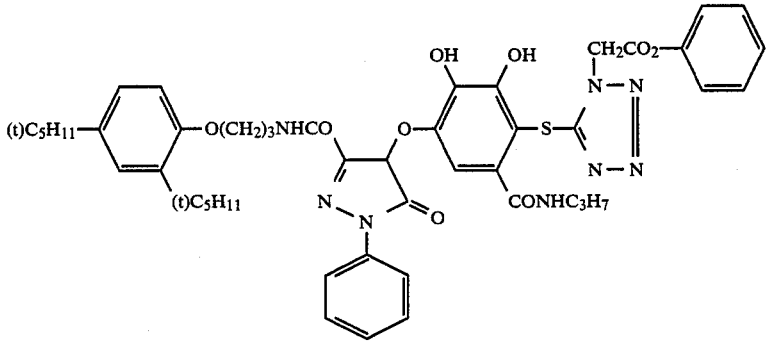
(75)
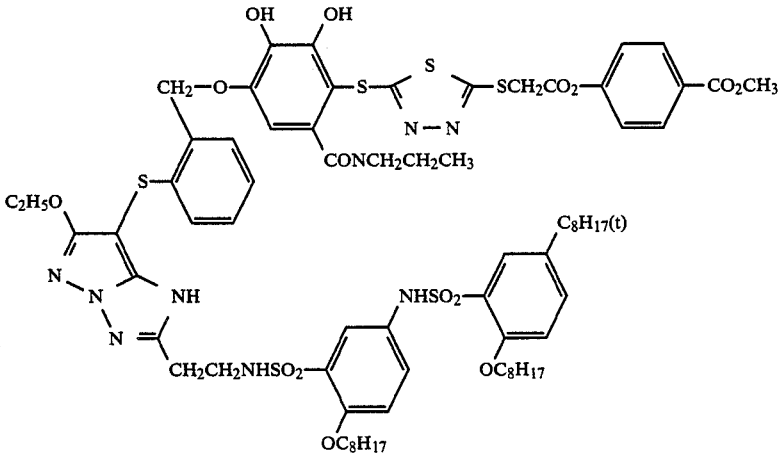
(76)
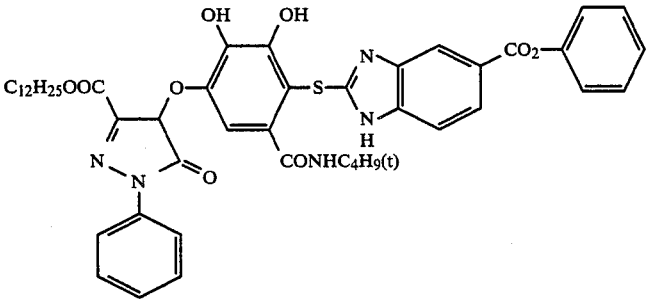

-continued
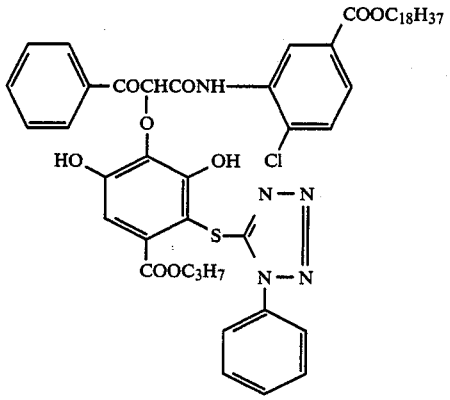
(77)
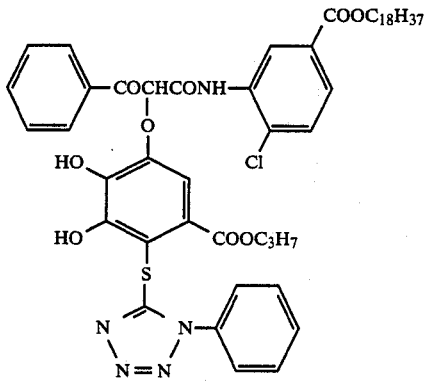
(78)
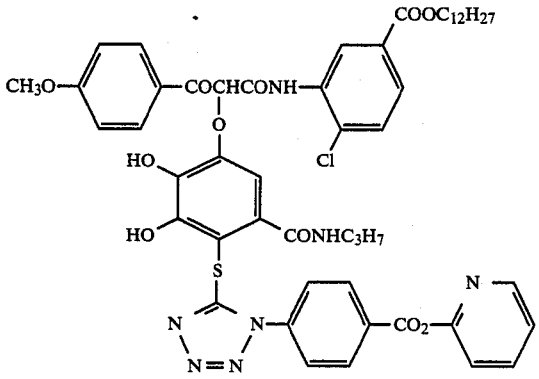
(79)
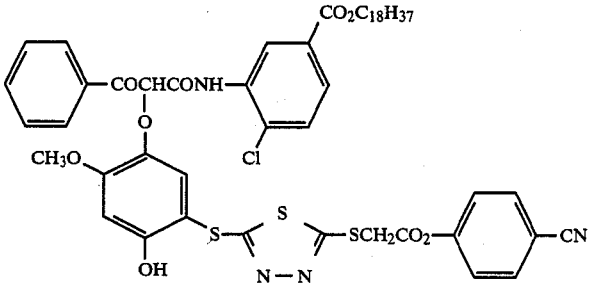
(80)

-continued
(81)
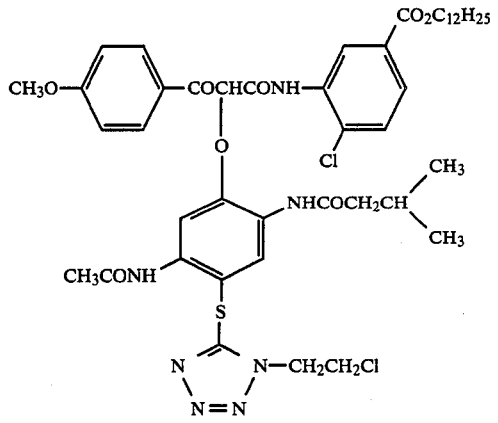
(82)
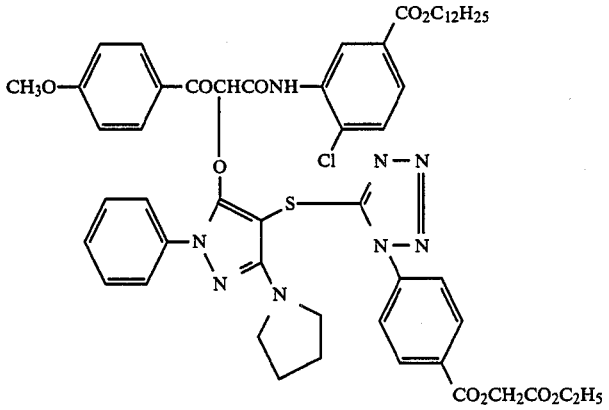
(83)
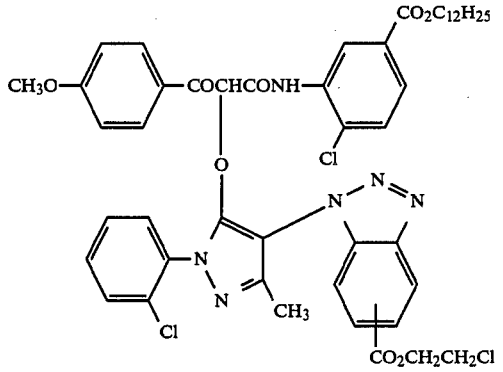
(84)
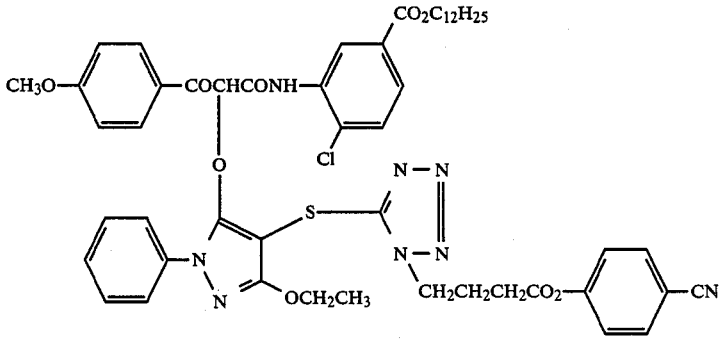

-continued
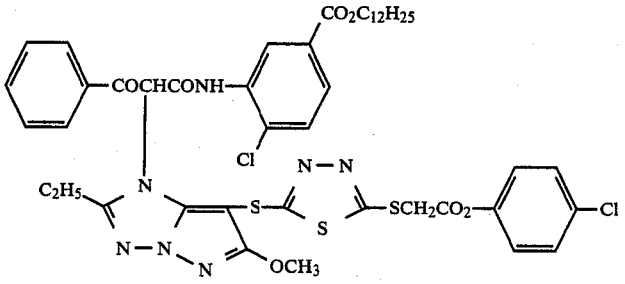
(85)
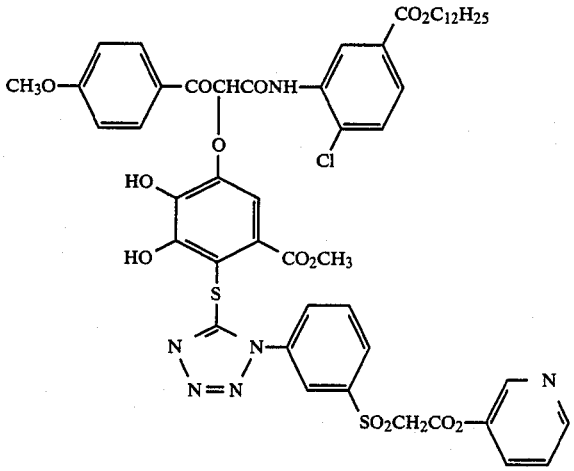
(86)
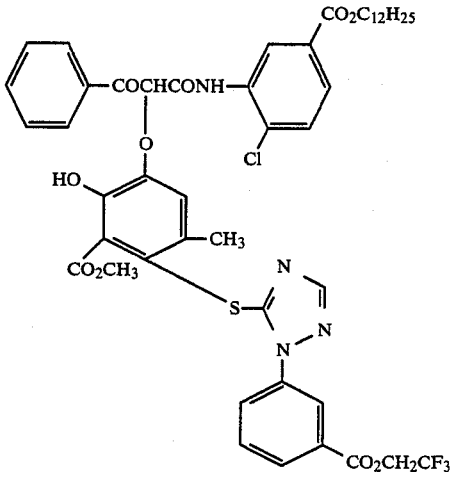
(87)

-continued
(88)
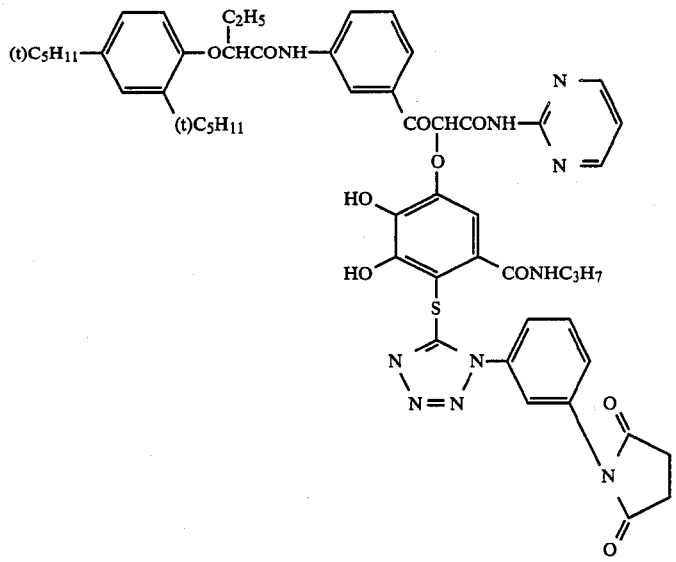
(89)
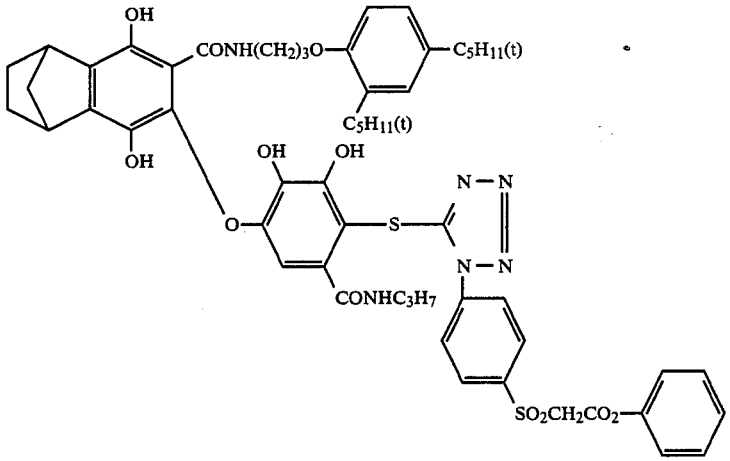
(90)
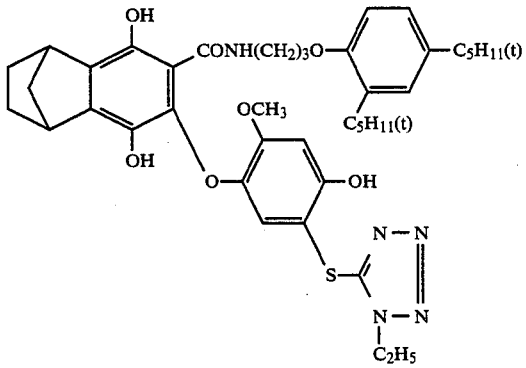

-continued
(91)
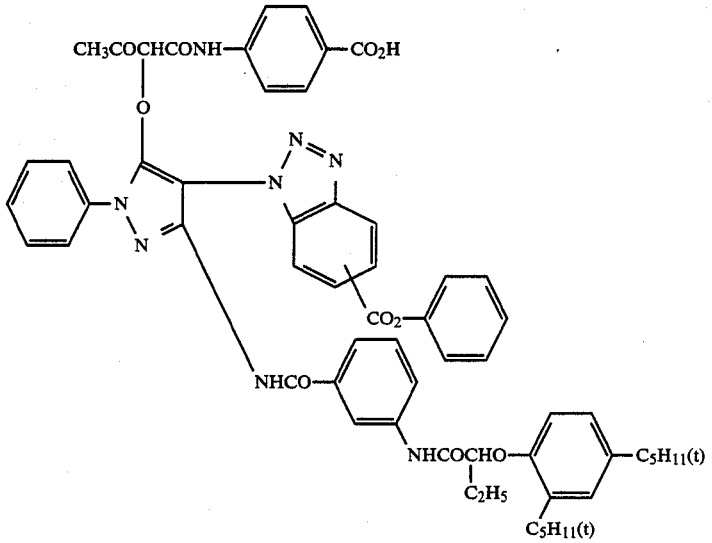
(92)
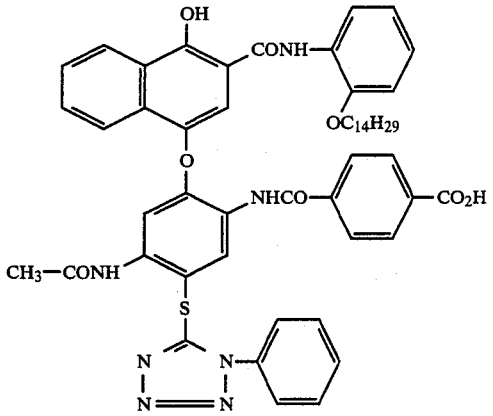
(93)
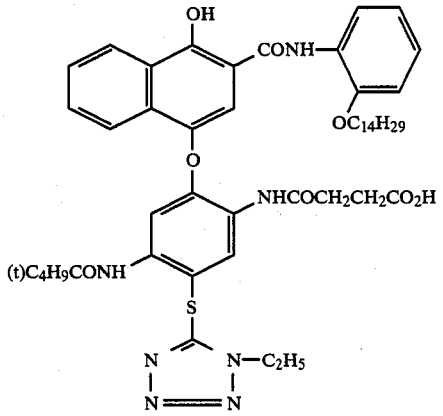

-continued
(94)
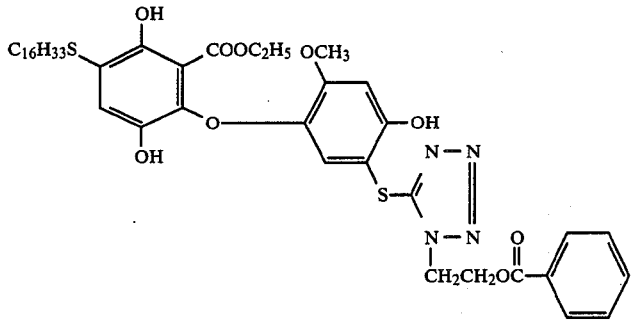
(95)
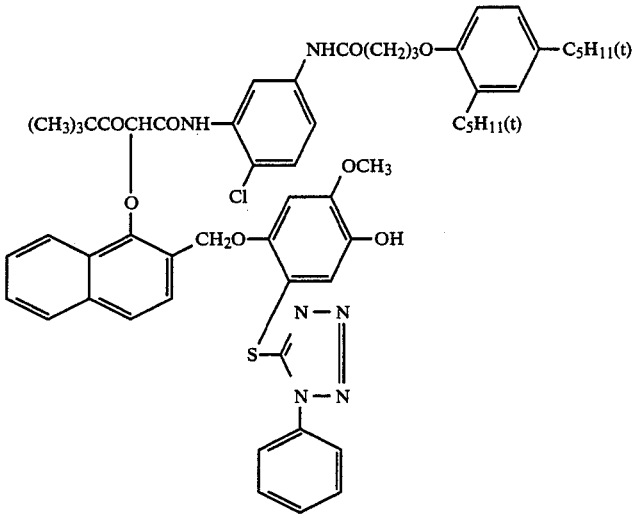
(96)
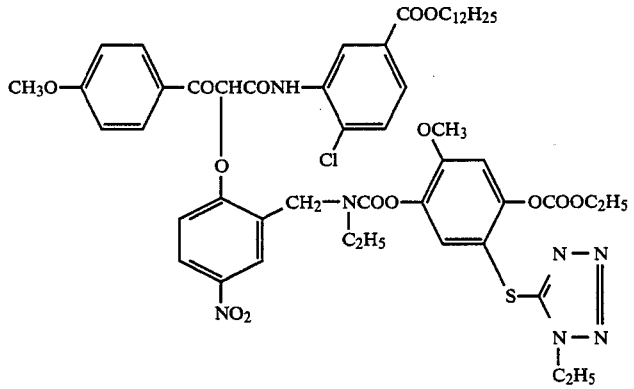
(97)
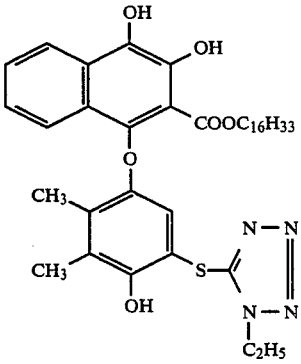

-continued
(98)
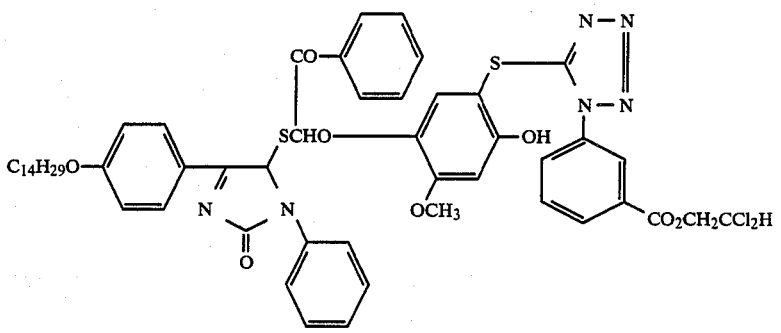
(99)
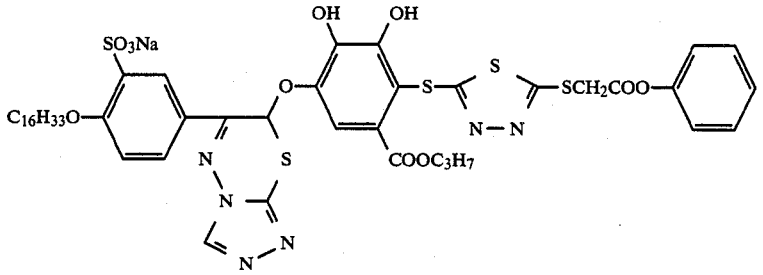
(100)
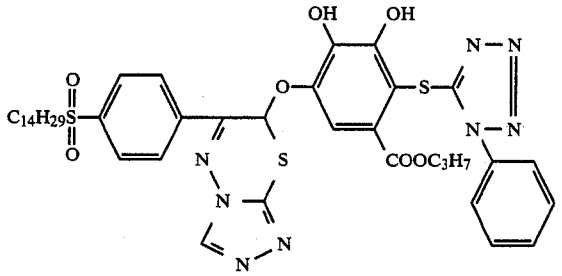
(101)
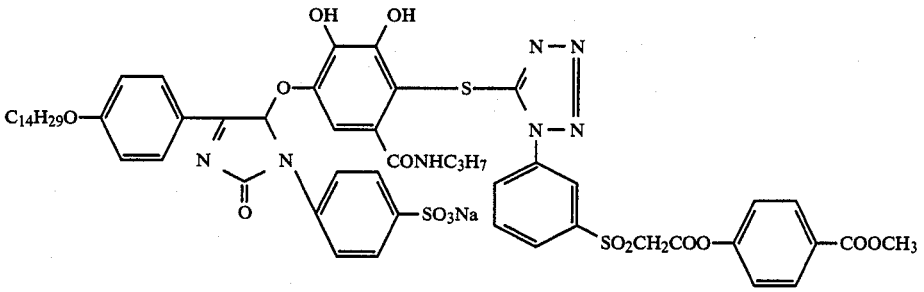
(102)
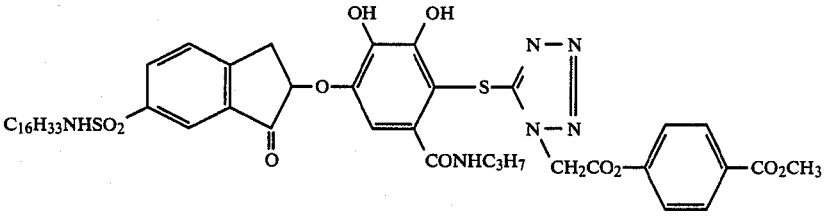
(103)
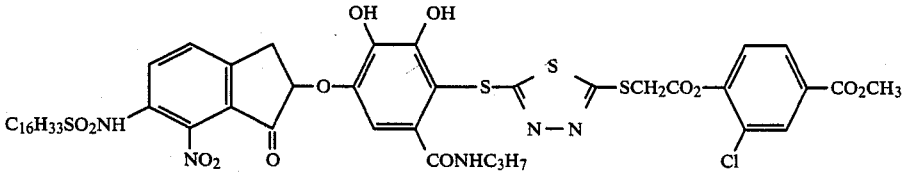

-continued
(104)
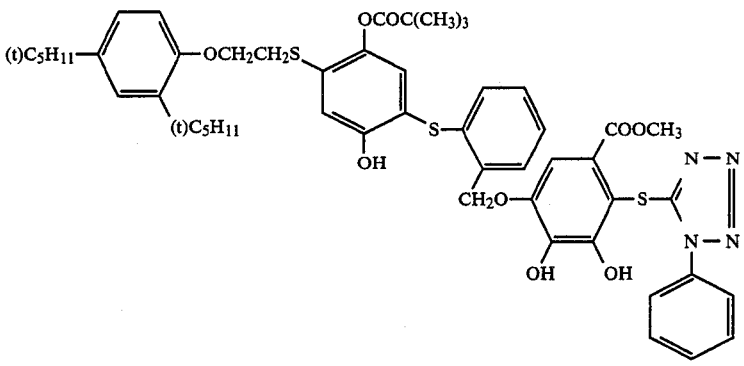
(105)
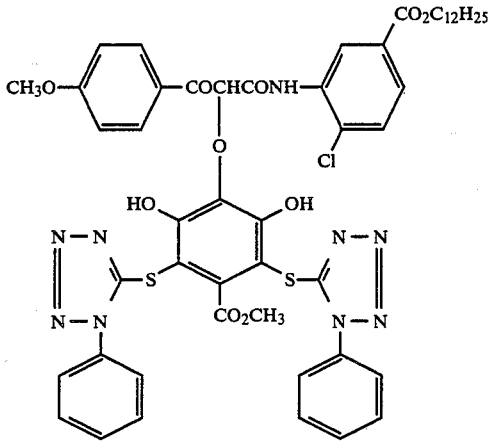
(106)
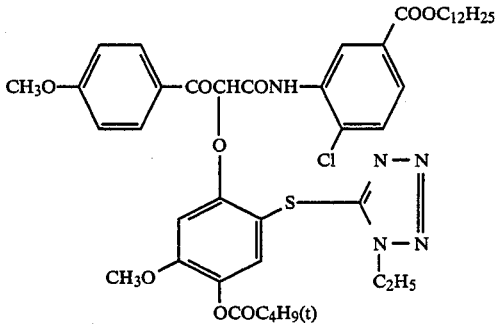
(107)
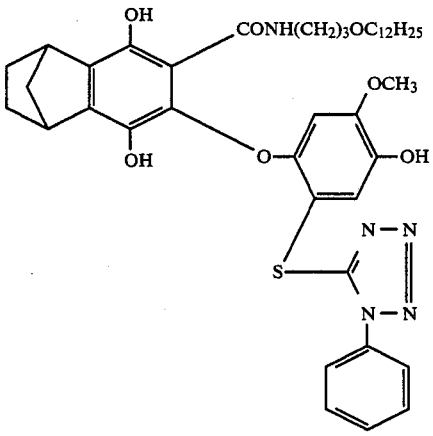

-continued
(108)
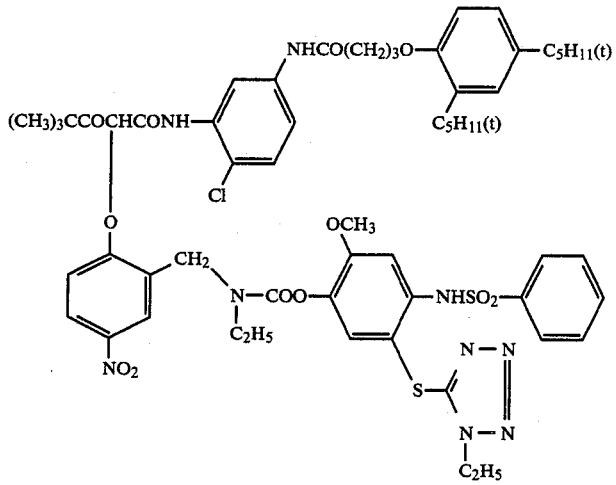
(109)
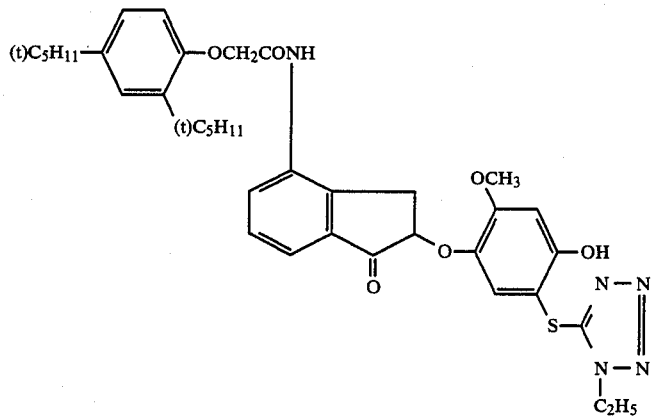
(110)
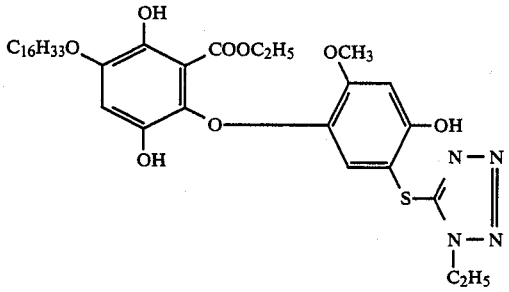
(111)
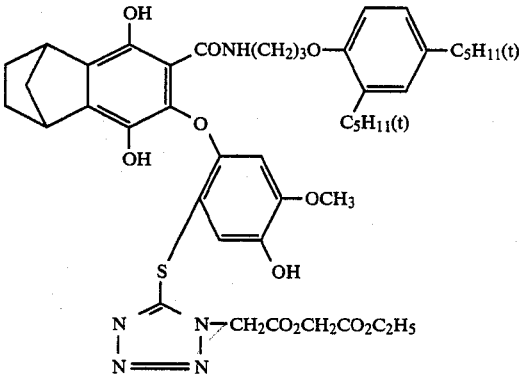

Typical synthesis examples for the aforesaid compounds are shown below but it will be easily understood that other compounds can be similarly synthesized.
SYNTHESIS EXAMPLE 1
Synthesis of Compound (1)
The compound was synthesized by the following synthesis route:
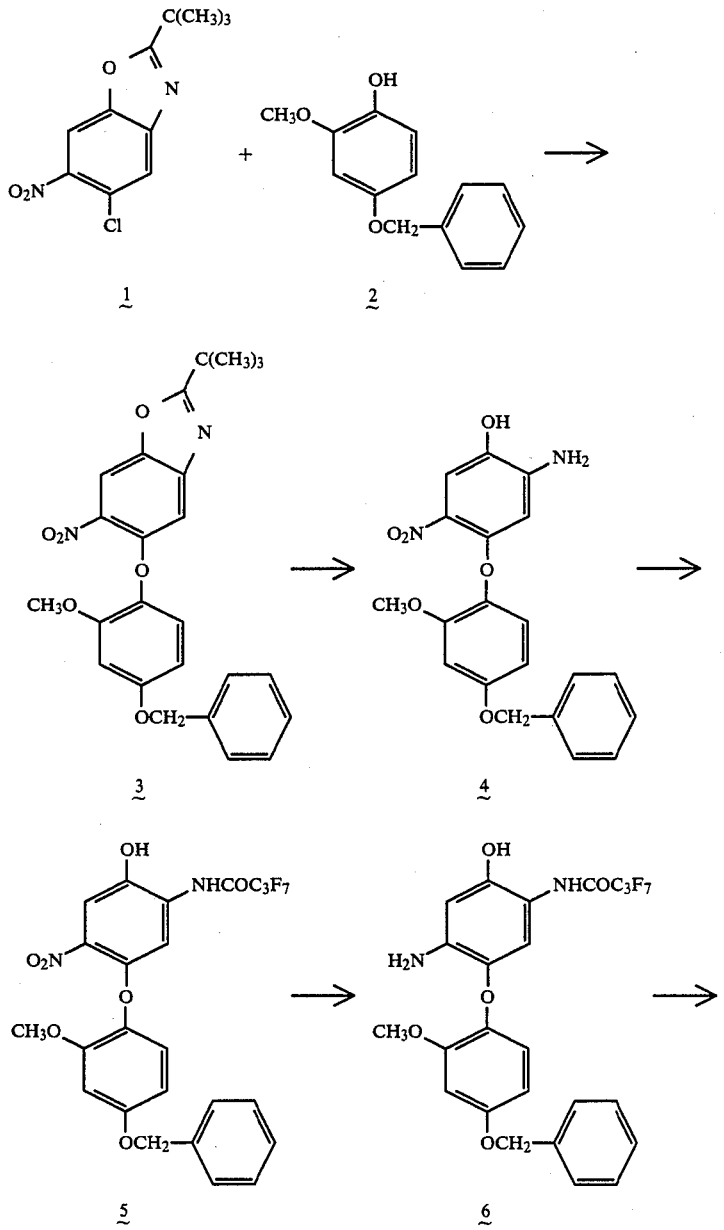

-continued

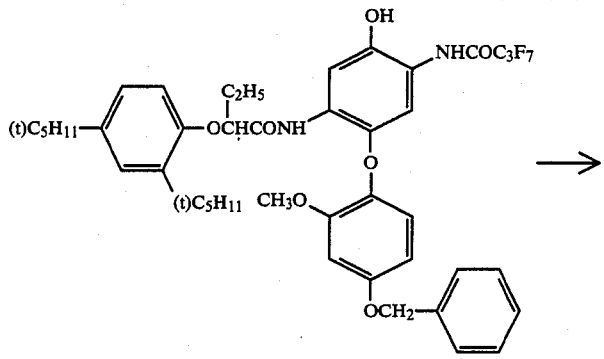

7

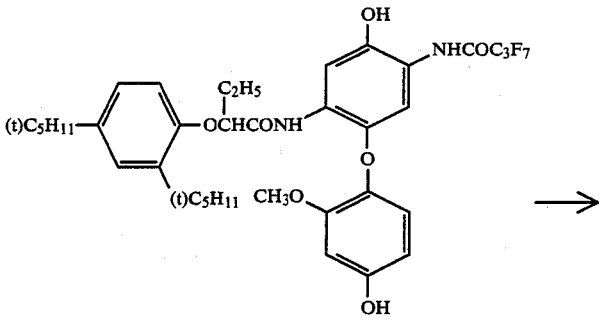

8

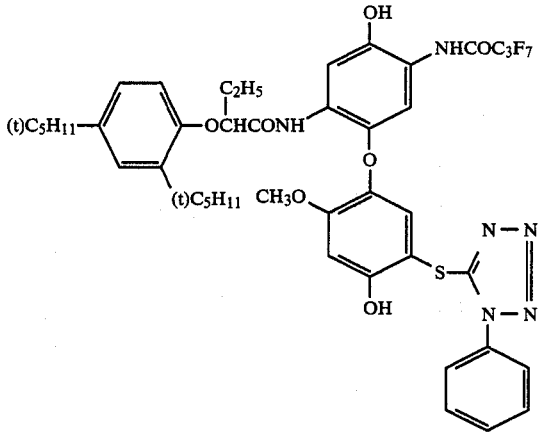

Compound (1)

(1) Step 1 (Synthesis of Compound 3):

To 700 ml of toluene were added 62 g of Compound 2 described in the above route, 18 g of potassium hydroxide, and 10 ml of water, the mixture was refluxed for 1 hour under a nitrogen atmosphere, and water was azeotropically distilled off with toluene. To the residue thus formed was added 200 ml of N,N-dimethylformamide and after heating the mixture to 100° C., 57 g of Compound 1 described in the above route was added thereto. After reacting for 1 hour at 100° C., the reaction mixture was cooled to room temperature, ethyl acetate was added to the reaction mixture, and the resultant mixture was washed with water in a separatory funnel. The ethyl acetate layer thus formed was collected and the solvent was distilled off under reduced pressure to provide 53 g of an oily residue mainly composed of Compound 3.

(2) Step 2 (Synthesis of Compound 4):

In a mixture of 400 ml of ethanol and 120 ml of water was dissolved 53 g of Compound 3 obtained in Step 1 and 40 g of potassium hydroxide was added to the solution. After refluxing the mixture for 4 hours and neutralizing with hydrochloric acid, the reaction mixture obtained was extracted using ethyl acetate and water. The ethyl acetate layer formed was collected and the solvent was distilled off to provide 43 g of an oily residue mainly composed of Compound 4.

(3) Step 3 (Synthesis of Compound 5):

In 300 ml of ethyl acetate was dissolved 43 g of Compound 4 obtained in the aforesaid step and then 69 g of anhydrous heptafluorobutanoic acid was added dropwise to the solution at room temperature. After reacting for 30 minutes, water was added thereto and the mixture thus obtained was washed with water in a separatory funnel. The oil layer formed was collected and after distilling off the solvent, the residue thus formed was subjected to column chromatography for isolation and purification. As the filler for the chromatography, silica gel was used and also as an eluent, chloroform containing 2.5% ethanol was used. Thus, 47 g of the oily Compound 5 was obtained.

(4) Step 4 (Synthesis of Compound 6):

To a mixed solvent of 40 ml of water and 400 ml of isopropanol were added 47 g of Compound 5 obtained above, 36.3 g of an iron powder, and 10 ml of acetic acid and the mixture thus obtained was refluxed for 1 hour. After filtering the reaction mixture thus obtained at hot and then the filtrate obtained was concentrated to about a half thereof. Crystals thus precipirated were collected to provide 44 g of Compound 6.

(5) Step 5 (Synthesis of Compound 7):

To 400 ml of acetonitrile was added 44 g of Compound 6 obtained in the above step and the mixture was refluxed. Thereafter, 28 g of 2-(2,4-di-t-amylphenoxy)-butanoyl chloride was added dropwise to the mixture. After refluxing the mixture for 30 minutes, the reaction mixture obtained was cooled to room temperature and after adding thereto ethyl acetate, the mixture was washed with water in a separatory funnel. The oil layer thus formed was collected, the solvent was distilled off under reduced pressure, and the residue was recrystallized from acetonitrile to provide 60 g of Compound 7.

(6) Step 6 (Synthesis of Compound 8):

To 500 ml of dichloromethane was added 60 g of Compound 7 and then 34.5 g of boron tribromide cooled to −10° C. was added to the mixture. Then, after reacting for 20 minutes at a temperature lower than −5° C., an aqueous solution of sodium carbonate was added thereto until the aqueous layer became neutral. The resultant mixture was placed in a separatory funnel and the oil layer formed was collected. The solvent was distilled off under reduced pressure and the residue was recrystallized from acetonitrile to provide 45.2 g of Compound 8.

(7) Step 7 (Synthesis of Compound (1)):

To 600 ml of acetonitrile was added 45.2 g of Compound 8 obtained in the aforesaid step and then 100 ml of a chloroform solution containing 20.2 g of 1-phenyltetrazolyl-5-sulfonyl chloride was added dropwise to the mixture at room temperature (25° C.). After adding ethyl acetate to the reaction mixture obtained, the resultant mixture was washed with water in a separatory funnel. The oil layer thus formed was collected and the solvent was distilled off. The residue formed was recrystallized from a mixture of hexane and ethyl acetate to provide 45.3 g of Compound (1).

SYNTHESIS EXAMPLE 2

Synthesis of Compound (28)

Compound (28) was prepared by following the same procedure as in Synthesis Example 1 except that 26.7 g of 1-ethoxycarbonylmethoxycarbonylmethyl-5-sulfonyl chloride was used in place of 20.2 g of 1-phenyltetrazolyl-5-sulfonyl chloride in Step (7) of Synthesis Example 1. In this case, however, a mixed solvent of hexane and chloroform was used in place of the mixted solvent of hexane and ethyl acetate in the same step.

SYNTHESIS EXAMPLE 3

Synthesis of Compound (30)

Compound (30) was prepared by the following synthesis route:

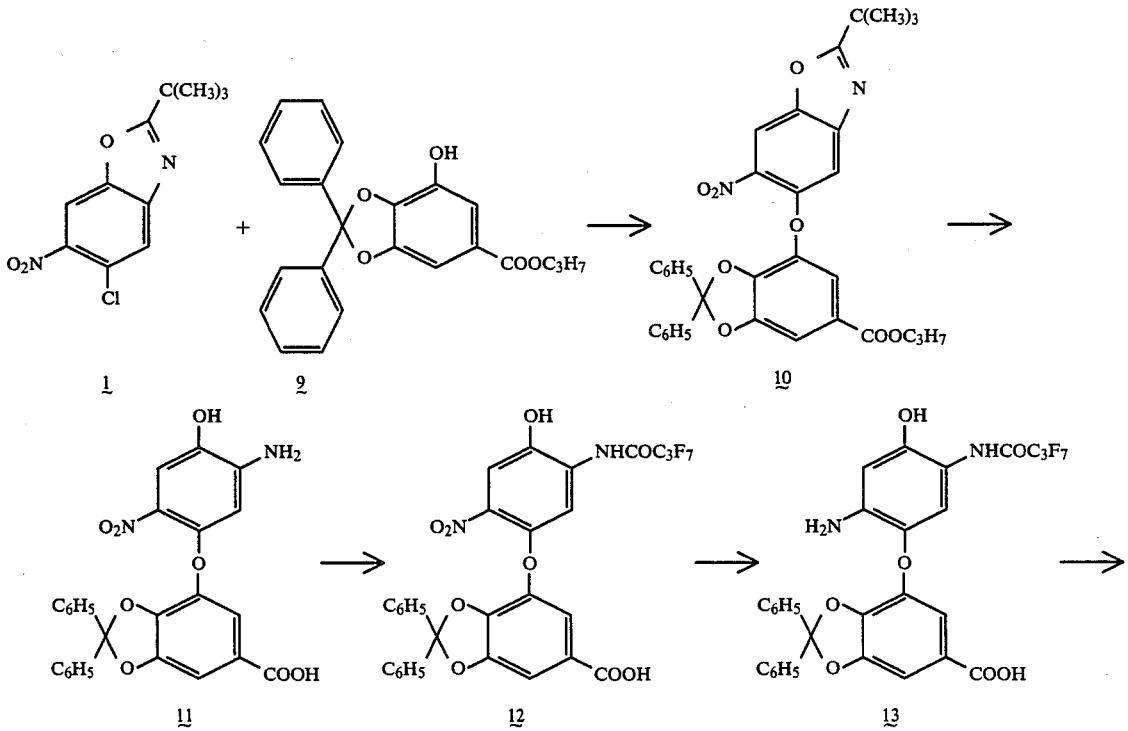

-continued

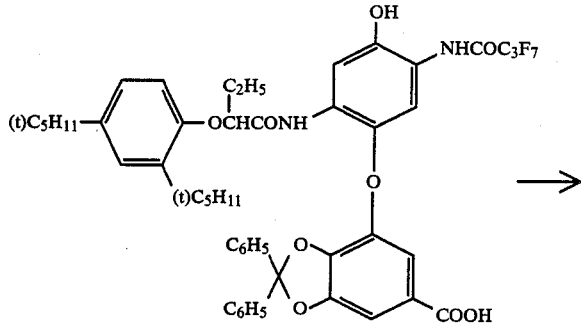

14

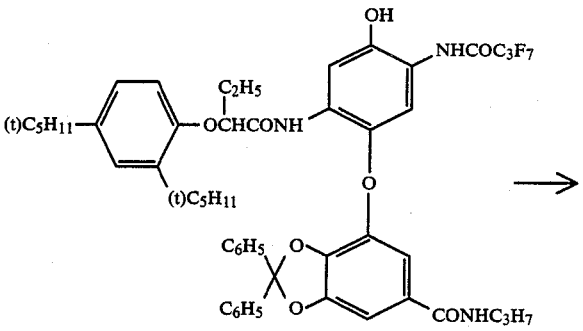

15

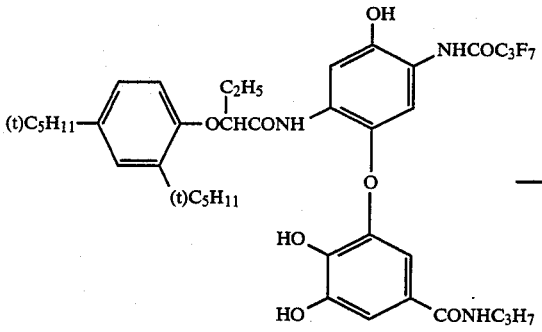

16

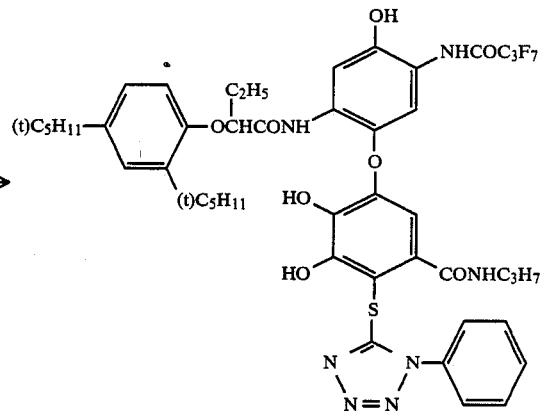

Compound (30)

(1) Step 1 (Synthesis of Compound 10):

To 1 liter of toluene were added 147.7 g of Compound 9 (synthesized by the method described in *Journal of American Chemical Society,* 81, 4606 (1959)), 24.6 g of potassium hydroxide, and 15 ml of water and the mixture was refluxed for 1 hour. Thereafter, water and toluene were azeotropically distilled off. To the residue formed were added 500 ml of N,N-dimethylformamide, 70 g of Compound 1 shown in the above-described synthesis route, and 0.5 g of cuprous chloride and the reaction was carried out for 4 hours at 120° C. After cooling the reaction mixture thus obtained to room temperature, 12 ml of hydrochloric acid, 150 ml of water, and 500 ml of methanol were added thereto and crystals thus precipitated were collected by filtration to provide 120 g of Compound 10.

(2) Step 2 (Synthesis Compound 11):

To a mixture solvent of 300 ml of ethanol and 100 ml of water was added 55.9 g of Compound 10 obtained in the above step and nitrogen gas was passed therethrough. To the solution was added 31.4 g of potassium hydroxide and the mixture was refluxed for 6 hours. The reaction mixture obtained was cooled to room temperature and neutralized with hydrochloric acid. Then, after adding thereto 500 ml of ethyl acetate, the mixture was washed with water in a separatory funnel. The oil layer thus formed was collected and the solvent was distilled off under reduced pressure to provide 46.2 g of Compound 11 as the residue, the whole amount of which was used in the subsequent step.

(3) Step 3 (Synthesis of Compound 12):

In 500 ml of ethyl acetate was dissolved 46.2 g of Compound 11 obtained in the aforesaid step and then 47.3 g of anhydrous heptafluorobutanic acid was added dropwise to the solution at room temperature. After reacting for 40 minutes at the same temperature, the reaction mixture was neutralized by the addition of an aqueous sodium carbonate solution. An oil layer formed was collected by a separatory funnel and washed with water. The oil layer thus formed was separated, the solvent was distilled off under reduced pressure, and chloroform was added to the residue, whereby crystals were deposited. The crystals were removed by filtration and the filtrate thus formed was concentrated to provide 52.5 g of Compound 12, the whole amount of which was used in the subsequent step.

(4) Step 4 (Synthesis of Compound 13):

To a mixed solvent of 280 ml of isopropanol and 40 ml of water were added 52.5 g of Compound 12 obtained in the aforesaid step, 53 g of reduced iorn, 3 g of ammonium chloride, and 3 ml of acetic acid and the mixture was refluxed for 1 hour. The reaction mixture thus obtained was filtered while it was hot and the filtrate formed was concentrated under reduced pressure. When crystals were deposited, the concentration was stopped and the system was cooled. By filtering the crystals thus deposited, 45.2 g of Compound 13 was obtained.

(5) Step 5 (Synthesis of Compound 14):

To 500 ml of acetonitrile was added 45.2 g of Compound 13 and while refluxing the mixture, 28.3 g of 2-(2,4-di-t-acylphenoxy)butanoyl chloride was added dropwise to the mixture. After reacting for 30 minutes under refluxing, the reaction mixture was cooled to room temperature and after adding thereto 500 ml of ethyl acetate, the mixture was washed with water. The oil layer formed was collected and the solvent was distilled off under reduced pressure. The residue was recrystallized from ethyl acetate and n-hexane to provide 56.7 g of Compound 14.

(6) Step 6 (Synthesis of Compound 15):

To a mixed solvent of 250 ml of tetrahydrofuran, 250 ml of acetonitrile, and 10 ml of N,N-dimethylformamide was added 56.7 g of Compound 14 obtained in the above step and then 42.4 g of thionyl chloride was added dropwise to the mixture. After reacting for 30 minutes, the reaction mixture was cooled to −10° C. Then, 67.7 g of propylamine was added dropwise to the solution while keeping the solution at a temperature below 0° C. After reacting for 30 minutes at the same temperature, ethyl acetate was added to the reaction mixture and the resultant mixture was washed with water. The oil layer thus formed was separated and the solvent was distilled off under reduced pressure. The residue formed was recrystallized from a mixed solvent of ethyl acetate and hexane to provide 45.2 g of Compound 15.

(7) Step 7 (Synthesis of Compound 16):

To a mixed solvent of 300 ml of methanol and 15 ml of hydrochloric acid was added 45.2 g of Compound 15 and the mixture was refluxed for 1 hour. After cooling the reaction mixture to room temperature, 200 ml of water was added to the reaction mixture and the crystals thus deposited were collected by filtration to provide 28.6 g of Compound 16.

(8) Step 8 (Synthesis of Compound (30)):

To 600 ml of tetrahydrofuran was added 28.6 g of Compound 16 and after cooling the mixture to −10° C., 4.6 g of aluminum chloride was added to the mixture. To the solution thus formed was added dropwise 60 ml of a dichloromethane solution containing 8.8 g of 1-phenyltetrazolyl-5-sulfonyl chloride. After reacting for 30 minutes at −10° C., ethyl acetate and water were added to the reaction mixture. An oil layer formed was separated in a separatory funnel and washed with water. An oil layer formed was collected, the solvent was distilled off under reduced pressure, the residue thus formed was recrystallized from a mixed solvent of hexane and ethanol to provide 24.9 g of Compound (30).

SYNTHESIS EXAMPLE 4

Synthesis of Compound (31)

Compound (31) was prepared by following the same procedure as in Synthesis Example 3 except that 16.8 of 5-(4-methoxycarbonylphenoxycarbonylmethylthio)-1,3,4-thiadiazolyl-2-sulfonyl chloride was used in place of 8.8 g of 1-phenyltetrazolyl-5-sulfonyl chloride in Step 8 of Synthesis Example 3.

SYNTHESIS EXAMPLE 5

Synthesis of Compound (73)

To a mixed solvent of 50 ml of N,N-dimethylformamide and 100 ml of toluene were added 30.2 g of α-chloro-α-benzoyl-2-chloro-2-octadecyloxycarbonylacetanilide, 24.3 g of 2-{1-[2-(4-cyanophenoxycarbonyl)ethyl]tetrazolyl-5-thio}-3,4,5-trihydroxybenzoic acid propyl ester, and 6.9 g of potassium carbonate and the reaction was carried out for 2 hours at 50° C. After cooling the reaction mixture to room temperature, the reaction mixture was washed with water in a separatory funnel, with diluted hydrochloric acid, and further with water and an oil layer formed was collected and dried with anhydrous sodium sulfate. The solvent was distilled off under reduced pressure and the residue thus formed was recrystallized from a mixed solvent of ethyl acetate and n-hexane to provide desired Compound (73).

It is preferred that the compound shown by formula (I) described above exists in the light-sensitive silver halide emulsion layer(s) or the adjacent layer(s) thereof of the color photographic material in this invention and the addition amount thereof is from $1\times10^{-6}$ to $1\times10^{-3}$ mol/m$^2$, preferably from $3\times10^{-6}$ to $5\times10^{-4}$ mol/m$^2$, more preferably from $1\times10^{-5}$ to $2\times10^{-4}$ mol/m$^2$.

The compound shown by formula (I) can be added to the coating composition for the photographic layer described above in the same manner as the case of adding ordinary couplers to coating compositions.

The processing solution having a bleaching faculty for use in this invention practically means a bleach solution or bleach-fix (blix) solution. As the bleaching agent which is used for the processing solution having a bleaching faculty in this invention, there are aminopolycarboxylic acid ferric complex salts, i.e., the complex salts of ferric ions and aminopolycarboxylic acids or the salts thereof.

Specific examples of these aminopolycarboxylic acids and the salts thereof are as follows.

A-1: Diethylenetriaminepentaacetic acid
A-2: Diethylenetriaminepentaacetic acid pentasodium salt
A-3: Ethylenediamine-N-(β-oxyethyl)-N,N',N'-triacetic acid
A-4: Ethylenediamine-N-(β-oxyethyl)-N,N',N'-triacetic acid trisodium salt
A-5: Ethylenediamine-N-(β-oxyethyl)-N,N',N'-triacid triammonium salt
A-6: 1,2-Diaminopropanetetraacetic acid
A-7: 1,2-Diaminopropanetetraacetic acid disodium salt
A-8: Nitrilotriacetic acid
A-9: Nitrilotriacetic acid sodium salt
A-10: Cyclohexanediaminetetraacetic acid A-11: Cyclohexanediaminetetraacetic acid disodium salt
A-12: N-Methyliminodiacetic acid
A-13: Iminodiacetic acid
A-14: Dihydroxyethylglycine
A-15: Ethyl ether diaminetetraacetic acid
A-16: Glycol ether diaminetetraacetic acid
A-17: Ethylenediaminetetrapropionic acid
A-18: 1,3-Diaminopropanetetraacetic acid
A-19: Ethylenediaminetetraacetic acid As a matter of course, the aminopolycarboxylic acids or the salts thereof are not limited to these compounds.

In the above-illustrated compounds, Compounds A-1, A-2, A-6, A-7, A-10, A-11, A-12, A-16 and A-18 are particularly preferred.

The aminopolycarboxylic acid ferric complex salt may be used in the form of a complex salt or amy be formed in a solution using a ferric salt such as ferric sulfate, ferric chloride, ferric nitrate, ammonium ferric sulfate, ferric phosphate, etc., and an aminopolycarboxylic acid. In the case of using a complex salt, the complex salt may be used solely or as a mixture of two or more complex salts. On the other hand, when the complex salt is formed in a solution using a ferric salt and an aminopolycarboxylic acid, one or more kinds of ferric salts may be used and also one or more kinds of aminopolycarboxylic acids may be used. Also, in any case, aminopolycarboxylic acid(s) may be used in excess of the amount required for forming the ferric complex salt.

A combination of at least one of the aforesaid ferric (Fe(III)) complex salts of the aminopolycarboxylic acids excluding Compound A-19 and the ethylenediaminetetraacetic acid ferric complex salt may be used, or ethylenediaminetetraacetic acid may be incorporated in a processing solution having the bleaching faculty.

Furthermore, the processing solution having a bleaching faculty containing the aforesaid ferric complex salt may further contain a complex salt of a metal ion other than an iron ion, such as a cobalt ion, a nickel ion, a copper ion, etc.

The amount of the bleaching agent is from 0.1 mol to 1 mol, preferably from 0.2 mol to 0.5 mol per liter of the processing solution having a bleaching faculty. Also, the pH of the bleaching solution is from 4.0 to 8.0, preferably from 5.0 to 7.5.

The processing solution having a bleaching faculty for use in this invention further contains a rehalogenating agent such as a bromide (e.g., potassium bromide, sodium bromide, ammonium bromide, etc.) and a chloride (e.g., potassium chloride, sodium chloride, ammonium chloride, etc.) in addition to the bleaching agent and the aforesaid compound. Moreover, the processing solution may contain at least one of inorganic acids, organic acids or the salts thereof having a pH buffer function, such as nitrates (e.g., sodium nitrate, ammonium nitrate, etc.), boric acid, borax, sodium metaborate, acetic acid, sodium acetate, sodium carbonate, potassium carbonate, phosphorus acid, phosphoric acid, sodium phosphate, citric acid, sodium nitrate, tartaric acid, etc.

The processing solution having a bleaching faculty for use in this invention may further contain a fixing agent such as a thiosulfate (e.g., sodium thiosulfate, ammonium thiosulfate, ammonium sodium thiosulfate, potassium thiosulfate, etc.), a thiocyanate (e.g., ammonium thiocyanate, potassium thiocyanate, etc.), thiourea, thioether, etc. The addition amount of the fixing agent is preferably about 3 mols or less, particularly preferably 2 mols or less per mole of the processing solution having a bleaching faculty.

The processing solution having a bleaching faculty for use in this invention may further contain a so-called sulfite ion releasing compound such as a sulfite (sodium sulfite, ammonium sulfite, etc.), a bisulfite, and a bisulfite addition product of an aldehyde (e.g., carbonyl bisulfite, etc.).

Furthermore, the processing solution having a bleaching faculty may contain the aminopolycarboxylic acid or the salt thereof as shown above as Compounds A-1 to A-19, or an organic phosphonic acid compound such as ethylenediaminetetrabismethylenephosphonic acid, diethylenetriaminepentabismethylenephosphonic acid, 1,3-diaminopropanetetrabismethylenephosphonic acid, nitro-N,N,N-trimethylenephosphonic acid, 1-hydroxyethylidene-1,1'-diphosphonic acid, etc.

The processing solution having a bleaching faculty can further contain at least one bleach accelerator selected from compounds having a mercapto group or a disulfide bond, isothiourea, derivatives, and thiazolidine derivatives. The amount of the bleach accelerator is preferably from $1\times10^{-5}$ to $1\times10^{-1}$ mol, more preferably from $1\times10^{-4}$ to $5\times10^{-2}$ mol, per liter of the processing solution.

As described above, the bleach accelerating agent which can be contained in the processing solution having a bleaching faculty is selected from compounds having a mercapto group or a disulfide bond, thiazolidine derivatives, thiourea derivatives, and isothiourea derivatives but the bleach accelerators represented by the following formulae (a) to (g) are preferably used in this invention.

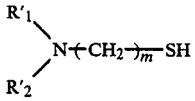

(a)

wherein $R'_1$ and $R'_2$, which may be the same or different, each represents a hydrogen atom, a substituted or unsubstituted lower alkyl group (preferably having 1 to 5 carbon atoms, such as a methyl group, an ethyl group, and a propyl group) or an acyl group (preferably having 1 to 3 carbon atoms, such as an acetyl group and a propionyl group), and m represents an integer of 1 to 3.

The $R'_1$ and $R'_2$ may combine with each other to form a ring.

Particularly preferred for $R'_1$ and $R'_2$ are a substituted or unsubstituted lower alkyl group and examples of the substituent for the alkyl group are a hydroxy group, a carboxy group, a sulfo group, an amino group, etc.

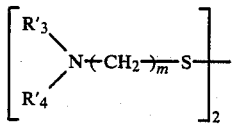

(b)

wherein $R'_3$ and $R'_4$ have the same significance as $R'_1$ and $R'_2$ in formula (a) and m represents an integer of from 1 to 3.

The $R'_3$ and $R'_4$ may combine with each other to form a ring.

Particularly preferred for $R'_3$ and $R'_4$ are a substituted or unsubstituted lower alkyl group and examples of the substituent for the alkyl group are a hydroxy group, a carboxy group, a sulfo group, an amino group, etc.

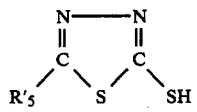
(c)

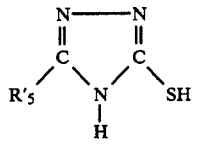
(d)

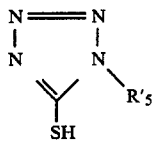
(e)

wherein $R'_5$ represents a hydrogen atom, a halogen atom (e.g., a chlorine atom, a bromine atom, etc.), an amino group, a substituted or unsubstituted lower alkyl group (preferably having 1 to 5 carbon atoms, such as a methyl group, an ethyl group, a propyl group, etc.), or an amino group having an alkyl group (e.g., a methylamino group, an ethylamino group, a dimethylamino group, a diethylamino group, etc.).

Examples of the substituent for the alkyl group represented by $R'_5$ are a hydroxy group, a carboxy group, a sulfo group, an amino group, etc.

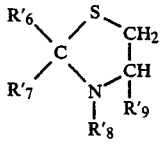
(f)

wherein $R'_6$ and $R'_7$, which may be the same or different, each represents a hydrogen atom, a substituted or unsubstituted alkyl group (preferably a lower alkyl group such as a methyl group, an ethyl group, a propyl group, etc.), a substituted or unsubstituted phenyl group, or a substituted or unsubstituted heterocyclic group (more specifically, a heterocyclic group having at least one hetero atom such as a nitrogen atom, an oxygen atom, a sulfur atom, etc., e.g., a pyridine ring, a thiophene ring, a thiazolidine ring, a benzoxazole ring, a benzotriazole ring, a thiazole ring, an imidazole ring, etc.); $R'_8$ represents a hydrogen atom or a substituted or unsubstituted lower alkyl group (preferably having 1 to 3 carbon atoms, such as a methyl group, an ethyl group, etc.); and $R'_9$ represents a hydrogen atom or a carboxy group.

Examples of the substituents for the groups represented by $R'_6$ to $R'_8$ are a hydroxy group, a carboxy group, a sulfo group, an amino group, a lower alkyl group, etc.

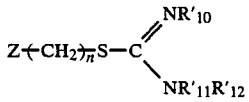
(g)

wherein $R'_{10}$, $R'_{11}$ and $R'_{12}$, which may be the same or different, each represents a hydrogen atom or a lower alkyl group (preferably having 1 to 3 carbon atoms, such as a methyl group, an ethyl group, etc.), the $R'_{10}$ and $R'_{11}$ or $R'_{12}$ may combine with each other to form a ring; Z represents an amino group which may have a substituent (e.g., a lower alkyl group such as a methyl group, etc., or an alkoxyalkyl group such as an acetoxymethyl group, etc.), a sulfonic acid group, or a carboxy group; and n represents an integer of 0 to 20.

$R'_{10}$ to $R'_{12}$ are particularly preferably a hydrogen atom, a methyl group or an ethyl group and Z is preferably an amino group or a dialkylamino group.

Specific examples of the bleach accelerators shown by formulae (a) to (g) described above are illustrated below, but the invention should not be construed as being limited thereto.

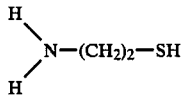
(a)-(1)

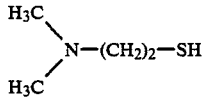
(a)-(2)

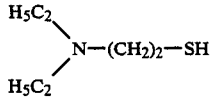
(a)-(3)

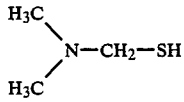
(a)-(4)

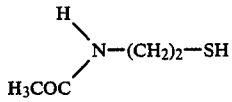
(a)-(5)

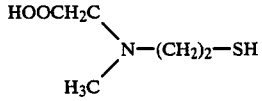
(a)-(6)

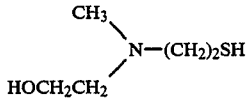
(a)-(7)

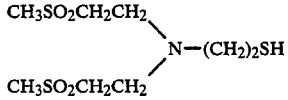
(a)-(8)

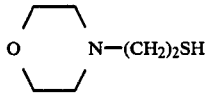
(a)-(9)

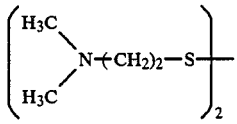
(b)-(1)

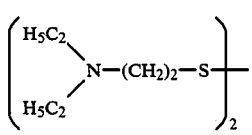
(b)-(2)

-continued
(b)-(3)
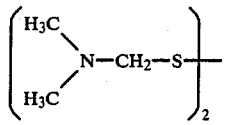
(b)-(4)
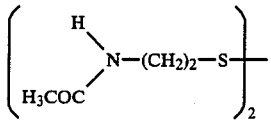
(b)-(5)
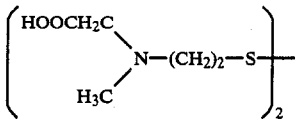
(b)-(6)
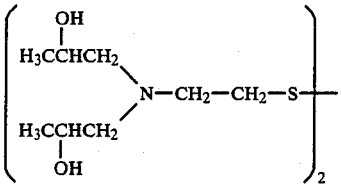
(b)-(7)
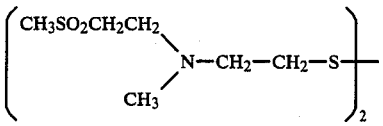
(b)-(8)
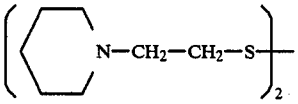
(b)-(9)
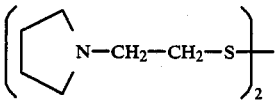
(b)-(10)
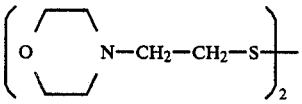
(c)-(1)
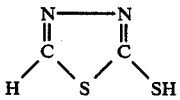
(c)-(2)
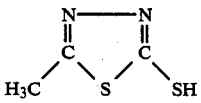
(c)-(3)
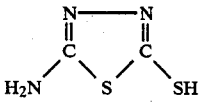
(c)-(4)
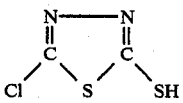
-continued
(d)-(1)
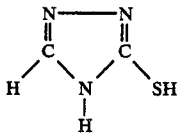
(d)-(2)
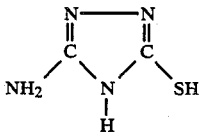
(d)-(3)
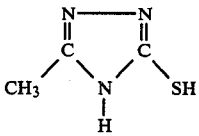
(e)-(1)
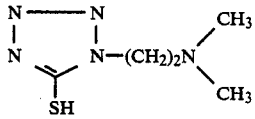
(e)-(2)
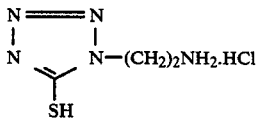
(f)-(1)
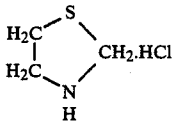
(f)-(2)
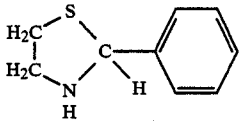
(f)-(3)
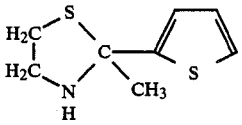
(f)-(4)
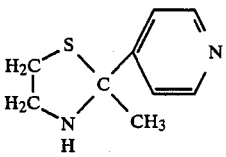
(f)-(5)
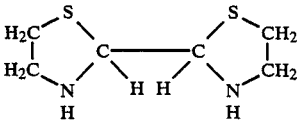
(f)-(6)
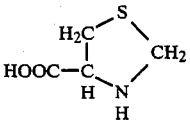

-continued

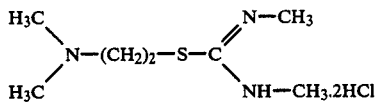
(g)-(1)

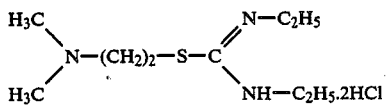
(g)-(2)

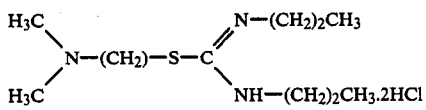
(g)-(3)

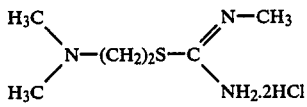
(g)-(4)

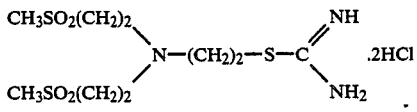
(g)-(5)

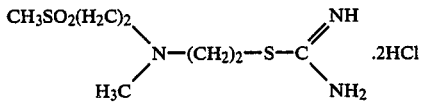
(g)-(6)

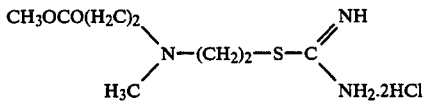
(g)-(7)

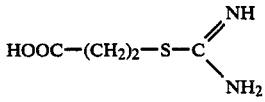
(g)-(8)

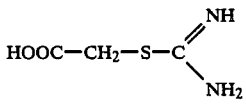
(g)-(9)

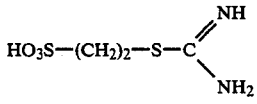
(g)-(10)

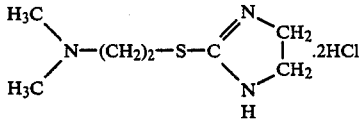
(g)-(11)

The bleach accelerators described above can be prepared by known methods. In particular, the compounds represented by formula (a) described above can be prepared by the methods described in U.S. Pat. No. 4,285,984, G. Schwarzenbach et al., *Helv. Chim. Acta.*, 38, 1147 (1955), and R. O. Clinton et al., *J. Am. Chem. Soc.*, 70, 950 (1948), the compounds represented by formula (b) can be prepared by the methods described in Japanese Patent Application (OPI) No. 95630/78, the compounds represented by formulae (c) and (d) can be prepared by the methods described in Japanese Patent Application (OPI) No. 52534/79, the compounds represented by formula (e) can be prepared by the methods described in Japanese Patent Application (OPI) Nos. 68568/76, 70763/76, and 50169/78, the compounds represented by formula (f) can be prepared by the methods described in Japanese Patent Publication No. 9854/78 and Japanese Patent Application (OPI) No. 214855/84 (corresponding to U.S. Pat. No. 4,508,817), and the compounds represented by formula (g) can be prepared by the methods described in Japanese Patent Application (OPI) No. 94927/78.

The bleach accelerator described above is generally added to the processing solution having a bleaching faculty as a solution thereof in water, an alkaline aqueous solution, an organic acid, an organic solvent, etc., but the agent may be added thereto as a powder thereof without having any adverse influences on the bleach accelerating effect.

In this invention, an additional processing bath or a water wash bath may be employed between the color development bath and the processing bath having a bleaching faculty and in such a case, the aforesaid bleach accelerator may be incorporated in the processing bath or water wash bath. The amount of the bleach accelerator which is used in such a case is the same as the amount in the case of adding it to a bleach solution or a blix solution.

Furthermore, the bleach accelerator can be incorporated in a color photographic light-sensitive material in this invention. In such a case, the bleach accelerator may be incorporated in any one of the blue-sensitive emulsion layer, the green-sensitive emulsion layer and the red-sensitive emulsion layer of the color photographic material or in another gelatin layer such as the protective layer, the interlayer, the subbing layer, etc., of the color photographic material.

The processing bath having a bleaching faculty may be a processing step composed of one processing tank or composed of 2 or more processing tanks. In the latter case, a multistage countercurrent system may be employed with the supply of a replenisher for the processing solution having a bleaching faculty or the processing solution may be successively circulated through plural tanks and the replenisher may be supplied to one of the plural tanks.

The processing solution employed after the processing solution having a bleaching faculty is wash water or a fix solution, or may be the blix solution described in Japanese Patent Application (OPI) Nos. 75352/86 and 75353/86 (each corresponding to European Patent Publication No. A176,056).

For the fix solution, a thiosulfate such as sodium thiosulfate, ammonium thiosulfate, ammonium sodium thiosulfate, potassium thiosulfate, etc., a thiocyanate such as sodium thiocyanate, ammonium thiocyanate, potassium thiocyanate, etc., thiourea, thioether, etc., may be added as a fixing agent. The amount of the fixing agent is from 0.3 mol to 3 mols, preferably from 0.5 mol to 2 mols, per liter of the fix solution.

The fix solution may, if necessary, contain various kinds of additives.

Examples of such additives are pH buffers such as sulfites (e.g., sodium sulfite, ammonium sulfite, etc.), boric acid, borax, sodium hydroxide, potassium hydroxide, sodium carbonate, potassium carbonate, sodium hydrogencarbonate, acetic acid, sodium acetate, etc., various defoaming agents, surface active agents, alkali metal halides such as potassium iodide, potassium bromide, ammonium bromide, etc., ammonium halides, and the bisulfite addition products of hydroxylamine, hydrazine, or an aldehyde compound. These additives may be used solely or as a mixture thereof.

The pH of the fix solution is preferably from 5 to 8, more preferably from 6 to 8.

For a color developer which is used in this invention, an aromatic primary amine color developing agent which is used for various color photographic processes can be used. These color developing agents include aminophenol series derivatives and p-phenylenediamine series derivatives. These compounds are generally used in the form of a salt such as a sulfate or a hydrochloride rather than in a free state owing to the stability. Also, the color developing agent is used in a concentration of from about 0.1 g to about 30 g, preferably from about 1 g to about 15 g, per liter of the color developer.

Examples of the aminophenol series developing agents are o-aminophenol, p-aminophenol, 5-amino-2-oxytoluene, 2-amino-3-oxytoluene, 2-oxy-3-amino-1,4-dimethylbenzene, etc.

Particularly useful aromatic primary amine color developing agents in this invention are N,N-dialkyl-p-phenylenediamine series compounds and the alkyl group and the phenylene group of the compounds may be or may not be substituted. Particularly useful examples of these compounds are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, 4-amino-N-(2-methoxyethyl)-N-ethyl-methylaniline-p-toluenesulfonate, etc.

The alkaline color developer which can be used in this invention can further contain various components, e.g., an alkali agent such as sodium hydroxide, sodium carbonate, potassium carbonate, etc., an alkali metal sulfite, an alkali metal bisulfite, an alkali metal thiocyanate, an alkali metal halide, benzyl alcohol, a water softener, a concentrating agent, etc. The pH of the color developer is usually 7 or more and most generally from about 9 to about 13.

The process of this invention can be used for color reversal photographic processing. As a black-and-white developer which is used in such color reversal photographic processing, a so-called first developer (black-and-white developer) which is usually used for reversal processing of color photographic materials or a black-and-white developer which is used for processing ordinary black-and-white light-sensitive materials can be used in this invention. Also, the black-and-white developer for use in this invention in such a case may contain various kinds of additives.

Specific examples of the additives are a developing agent such as 1-phenyl-3-pyrazolidone, Metol, hydroquinone, etc., a preservative such as a sulfite, etc., a development accelerator composed of an alkali such as sodium hydroxide, sodium carbonate, potassium carbonate, etc., an inorganic or organic development inhibitor such as potassium bromide, 2-methylbenzimidazole, methylbenzothiazole, etc., a water softener such as polyphosphate, etc., and a development inhibitor such as a slight amount of an iodide, a mercapto compound, etc.

The processing process of this invention is usually composed of the steps of color development, bleach, and fix or the steps of color development and blix. In this case, after the fix step or blix step, processing steps such as a water wash and a stabilization step are generally performed but a simple processing step of performing a stabilization step after the fix step or the blix step without performing substantial water wash can be employed in this invention.

The wash water which is used for the wash step can contain, if necessary, known additives. Examples of these additives are a chelating agent such as inorganic phosphoric acids, aminopolycarboxylic acids, organic phosphoric acids, etc., antibacterial and antifungal agents for preventing the generation of various bacteria, algae, and fungi, a hardening agent such as magnesium salts, aluminum salts, etc., and surface active agents for reducing drying load and preventing the occurrence of uneven drying.

Also, the wash water may further contain the compounds described in L. E. West, *Photo. Sci. and Eng.*, Vol. 9, No. 6, 344–359 (1965), etc.

Furthermore, the wash step may be performed using two or more baths and a multistage countercurrent wash step (using 2 to 9 stages) may be employed for saving water.

As the stabilization solution which is used for the stabilization step in this invention, a processing solution for stabilizing color images formed is used. For example, a solution having a buffer faculty having a pH of from 3 to 6 or a solution containing an aldehyde (e.g., formalin) can be used. The stabilization solution may, if necessary, contain an optical whitening agent, a chelating agent, a sterilizer, an antifungal agent, a surface active agent, a hardening agent, etc.

Also, if necessary, the stabilization step may be performed using two or more baths and in this case, a multistage countercurrent stabilization system (using, e.g., 2 to 9 stages) may be employed for saving the replenisher for the stabilization solution, and also the wash step may be omitted.

For the photographic emulsion layers of the color photographic materials which are processed in the process of this invention, a silver halide such as silver bromide, silver iodobromide, silver iodochlorobromide, silver chlorobromide, and silver chloride may be used. A preferred silver halide is silver iodobromide or silver iodochlorobromide containing not more than about 30 mol% silver iodide. A particularly preferred silver halide is silver iodobromide containing from about 2 mol% to about 25 mol% silver iodide.

The silver halide grains in the photographic emulsion may be so-called regular grains having a regular crystal form such as a cube, an octahedron, and a pentadecahedron, irregular grains having an irregular crystal form such as sphere, or may have a crystal defect such as twinning plane, etc. Furthermore, the silver halide grains may be a composite form of these various sorts of grains.

The grain sizes of the silver halide grains may be less than about 0.1 micron or may be as large as up to about 10 microns in the projected area diameter. The silver halide emulsion for use in this invention may be a monodispersed emulsion having a narrow silver halide grain distribution or a polydispersed emulsion having a broad grain distribution.

The silver halide emulsions which can be used in this invention can be produced by the methods described, for example, in *Research Disclosure* (RD), No. 17643, pages 22–23 (December, 1978) "I. Emulsion Preparation and Types", ibid., No. 18716, page 648 (November, 1979).

More specifically, the silver halide emulsion for use in this invention can be prepared using the methods described in P. Glafkides, *Chimie et Physique Photographique,* published by Paul Montel, 1967, G. F. Duffin, *Photographic Emulsion Chemistry,* published by Focal Press, 1966, V. L. Zelikman et al., *Making and Coating Photographic Emulsion,* published by Focal Press, 1964, etc.

That is, the photographic emulsion may be prepared by an acid method, a neutralization method, an ammonia method, etc. Also, as a method of reacting a soluble silver salt and a soluble halide, a single jet method, a double jet method, or a combination thereof may be used. A so-called back mixing method of forming silver halide grains in the presence of excessive silver ions can be used.

As one of the double jet methods, a so-called controlled double jet method of keeping a constant pAg in the liquid phase for forming silver halide grains can be used. According to the method, a silver halide emulsion containing silver halide grains having a regular crystal form and almost uniform grain sizes is obtained.

A mixture of two or more silver halide emulsions separately prepared may be used.

The above-described silver halide emulsion composed of regular silver halide grains is obtained by controlling the pAg and pH during the formation of the grains. Details of the method of producing such a silver halide emulsion are described, for example, in *Photographic Science and Engineering,* Vol. 6, 159–165 (1962), *Journal of Photographic Science,* Vol. 12, 242–251 (1964), U.S. Pat. No. 3,655,394, and British Pat. No. 1,413,748.

Also, as a monodispersed silver halide emulsion, an emulsion composed of silver halide grains having a mean grain size of not less than about 0.1 micron, in which at least 95% by weight of the silver halide grains are in the range of ±40% of the mean grain size, is a typical silver halide emulsion and the monodispersed silver halide emulsion wherein the mean grain size of the silver halide grains is from about 0.25 to about 2 microns and at least about 95% by weight or at least about 95% by number of the silver halide grains is in the range of ±20% of the mean grain size can be used in this invention. The methods of preparing such a monodispersed silver halide emulsion are described in U.S. Pat. Nos. 3,574,628, 3,655,394, and British Pat. No. 1,413,748. Furthermore, the monodispersed silver halide emulsions described in Japanese Patent Application (OPI) Nos. 8600/73, 39027/76, 83097/76, 137133/78, 48521/79, 99419/79, 37635/83, 49938/83, etc., can be used in this invention.

Moreover, a tabular grain silver halide emulsion having an aspect ratio of at least about 5 can be used in this invention. Tabular silver halide grains can be easily prepared by the methods described in Gutoff, *Photographic Science and Engineering,* Vol. 14, 248–257 (1970), U.S. Pat. Nos. 4,434,226, 4,414,310, 4,433,048, 4,439,520, and British Pat. No. 2,112,157. When the tabular grain silver halide emulsion is used, there are advantages that the color sensitizing effect by sensitizing dye(s) is improved and the graininess and the sharpness are increased as described in detail in U.S. Pat. No. 4,434,226 cited above.

The silver halide grains for use in this invention may differ in halogen composition between the inside and the surface portion thereof or may have a layer structure in halogen composition. The silver halide emulsions composed of these silver halide grains are disclosed in British Pat. No. 1,027,146, U.S. Pat. Nos. 3,505,068 and 4,444,877 and Japanese Patent Application (OPI) No. 143331/85. Also, silver halide grains having different halogen compositions and joined to each other by epitaxial junction can be used or silver halide grains joined to a compound other than a silver halide, such as silver rhodanate, lead oxide, etc., may be used. These silver halide emulsions are disclosed in U.S. Pat. Nos. 4,094,684, 4,142,900, 4,459,353, British Pat. No. 2,038,792, U.S. Pat. Nos. 4,349,622, 4,395,478, 4,433,501, 4,463,087, 3,656,962, 3,852,067, Japanese Patent Application (OPI) No. 162540/84, etc.

Also, a mixture of silver halide grains having various crystal forms can be used in this invention.

The silver halide emulsion for use in this invention is usually subjected to physical ripening, chemical ripening, and spectral sensitization. The additives which are used in these steps are described, e.g., in *Research Disclosure,* No. 17643 and ibid., No. 18716 and they are shown in the following table.

In addition, other photographic additives which can be used for the color photographic materials in this invention are also described in the aforesaid two *Research Disclosures* and they are also shown in the same table.

| Additives | RD 17643 | RD 18716 |
|---|---|---|
| 1. Chemical Sensitizer | Page 23 | Page 648, right column |
| 2. Sensitivity Increasing Agent | | Same as above |
| 3. Spectral Sensitizer and Super Color Sensitizer | Pages 23–24 | Page 648, right column to page 649, right column |
| 4. Whitening Agent | Page 24 | |
| 5. Antifoggant and Stabilizer | Pages 24–25 | Page 649, right column |
| 6. Light Absorbent, Filter Dye, and Ultraviolet Absorbent | Page 25–26 | Page 649, right column to page 650, left column |
| 7. Antistaining Agent | Page 25, right column | Page 650, left column to right column |
| 8. Dye Image Stabilizer | Page 25 | |
| 9. Hardening Agent | Page 26 | Page 651, left column |
| 10. Binder | Page 26 | Same as above |
| 11. Plasticizer and Lubricant | Page 27 | Page 650, right column |
| 12. Coating Aid and Surface Active Agent | Pages 26–27 | Same as above |
| 13. Antistatic Agent | Page 27 | Same as above |

RD: Research Disclosure

For the color photographic materials which are processed by the process of this invention, various kinds of color couplers can be used and specific examples of the color couplers are described, for example, in *Research Disclosure,* No. 17643, VII-C to G. As dye-forming couplers, the couplers giving three primary colors (i.e., yellow, magenta and cyan) by the subtractive color process by color development are important and specific examples of the nondiffusible 4-equivalent or 2-equivalent couplers which can be preferably used in this invention are as follows in addition to the couplers described in the patents cited in *Research Disclosure,* No. 17643, VII-C and D.

As yellow couplers which can be used in this invention, there are hydrophobic acylacetamide series yellow couplers having a ballast group as the typical examples. Specific examples thereof are described in U.S. Pat. Nos. 2,407,210, 2,875,057 and 3,265,506. In this invention, the use of 2-equivalent yellow couplers is preferred and examples of these couplers are the oxygen atom-releasing type yellow couplers described in U.S. Pat. Nos. 3,408,194, 3,447,928, 3,933,501 and 4,022,620 and the nitrogen atom-releasing type yellow couplers described in Japanese Patent Publication No. 10739/83, U.S. Pat. Nos. 4,401,752, 4,326,024, *Research Disclosure,* No. 18053 (April, 1979), British Pat. No. 1,425,020, West German Patent (Offenlegungsshrift (OLS)) Nos. 2,219,917, 2,261,361, 2,329,587 and 2,433,812. In these couplers, α-pivaloylacetanilide series yellow couplers are excellent in fastness, in particular, the light fastness of colored dyes, while α-benzoylacetanilide series yellow couplers give high coloring density.

As magenta couplers which can be used in this invention, there are hydrophobic indazolone series and cyanoacetyl series magenta couplers having a ballast group and preferably 5-pyrazolone series and pyrazoloazole series magenta couplers having a ballast group.

As the 5-pyrazolone series magenta couplers, the couplers having an arylamino group or an acylamino group at the 3-position thereof are preferred from the viewpoint of the hue and coloring density of colored dyes. Specific examples thereof are described in U.S. Pat. Nos. 2,311,082, 2,343,703, 2,600,788, 2,908,573, 3,062,653, 3,152,896, and 3,936,015. As the releasing group for the 2-equivalent 5-pyrazolone series couplers, the nitrogen atom-releasing groups described in U.S. Pat. No. 4,310,619 and the arylthio groups described in U.S. Pat. No. 4,351,897 are particularly preferred. Also, the 5-pyrazolone series magenta couplers having a ballast group described in European Pat. No. 73,636 gives high coloring density.

As the pyrazoloazole series magenta couplers, there are the pyrazolobenzimidazoles described in U.S. Pat. No. 3,061,432 and preferably the pyrazolo[5,1-c][1,2,4]triazoles described in U.S. Pat. No. 3,725,067, the pyrazolotetrazoles described in *Research Disclosure,* No. 24220 (June, 1984) and Japanese Patent Application (OPI) No. 33552/85, and the pyrazolopyrazoles described in *Research Disclosure,* No. 24230 (June, 1984) and Japanese Patent Application (OPI) No. 43659/85. The imidazo[1,2-b]pyrazoles described in U.S. Pat. No. 4,500,630 are preferred from the viewpoint that the colored dyes formed have less yellow side-absorption and have high light fastness and the pyrazolo[1,5-b][1,2,4]triazoles described in U.S. Pat. No. 4,530,654 are particularly preferred from the same reason.

As the cyan couplers which can be used in this invention, there are hydrophobic and nondiffusible naphthol series and phenol series couplers, for example, the napthol series couplers described in U.S. Pat. No. 2,474,293, preferably the oxygen atom-releasing type 2-equivalent naphthol series couplers described in U.S. Pat. Nos. 4,052,212, 4,146,396, 4,228,233 and 4,296,200. Also, examples of the phenol series cyan couplers are described in U.S. Pat. Nos. 2,369,929, 2,801,171, 2,772,162, 2,895,826, etc.

Cyan couplers capable of forming cyan dyes having fastness to moisture and heat are preferably used in this invention and specific examples of these cyan couplers are the phenol series cyan couplers having an alkyl group having 2 or more carbon atoms at the metaposition of the phenol nucleus described in U.S. Pat. No. 3,772,002, the 2,5-diacrylamino-substituted phenol series couplers described in U.S. Pat. Nos. 2,772,162, 3,758,308, 4,126,396, 4,334,011, 4,327,173, West German Patent Application (OLS) No. 3,329,729, and European Pat. No. 121,365, and the phenol series couplers having a phenylureido group at the 2-position and an acylamino group at the 5-position described in U.S. Pat. Nos. 3,446,622, 4,333,999, 4,451,559, and 4,427,767. The cyan couplers having a sulfonamido group or an amido group at the 5-position of the naphthol nucleus described in European Pat. No. 161,626A are excellent in the fastness of colored dyes and are preferably used in this invention.

In the case of photographing (in camera type) color photographic materials, it is preferred for correcting the unnecessary absorption of colored dyes to apply masking by using colored couplers for the color photographic materials. Typical colored couplers are the yellow-colored magenta couplers described in U.S. Pat. No. 4,163,670 and Japanese Patent Publication No. 39413/82 and the magenta-colored cyan couplers described in U.S. Pat. Nos. 4,004,929, 4,138,258, and British Pat. No. 1,146,368. Other colored couplers which can be used in this invention are described in *Research Disclosure,* No. 17643, VII-G.

In this invention, the graininess of the color images formed can be improved by using couplers giving colored dyes having a proper diffusibility together with the aforesaid color couplers. Specific examples of these couplers are the magenta couplers described in U.S. Pat. No. 4,366,237 and British Pat. No. 2,125,570 and the yellow couplers, magenta couplers, and cyan couplers described in European Pat. No. 96,570 and West German Patent Application (OLS) No. 3,234,533.

The dye-forming couplers and the specific couplers described above may form a dimer or higher oligomer or polymer. Specific examples of polymerized dye-forming couplers are described in U.S. Pat. Nos. 3,451,820 and 4,080,211. Specific examples of polymerized magenta couplers are described in British Pat. No. 2,102,173 and U.S. Pat. No. 4,367,282.

In this invention, the couplers shown by formulae (I) or (II) described hereinbefore can be used with couplers releasing a photographically useful residue with coupling. For example, DIR couplers releasing a development inhibitor described in *Research Disclosure,* No. 17643, VII-F can be advantageously used in this invention.

Preferred examples of the aforesaid couplers which can be used together with the couplers shown by formulae (I) or (II) in this invention are the couplers of the type that the development inhibitor released therefrom is inactivated in the color developer as described in Japanese Patent Application (OPI) No. 151944/82, the timing couplers described in U.S. Pat. No. 4,248,962 and Japanese Patent Application (OPI) No. 154234/82, and the reaction type couplers described in Japanese Patent Application (OPI) No. 184248/85. Particularly preferred couplers of the aforesaid type are the developer inactivation type DIR couplers described in Japanese Patent Application (OPI) Nos. 151944/82, 217932/83, 218644/85, 225156/85, 221750/85 and 233650/85 and the reaction type DIR couplers described In Japanese Patent Application (OPI) No. 184248/85.

For the color photographic materials which are processed in this invention, couplers imagewise releasing a nucleating agent or a development inhibitor, or the precursor thereof at development can be used. Specific examples of such a coupler are described in British Pat. Nos. 2,097,140 and 2,131,188. Couplers releasing a nucleating agent having an adsorptive action for silver halide can be preferably used in this invention and specific examples of such a coupler are described in Japanese Patent Application (OPI) Nos. 157638/84 and 170840/84.

For the color photographic materials which are processed by the process of this invention, various sorts of supports can be used according to the purpose of the color photographic materials and examples of such supports are described, for example, in *Research Disclosure,* No. 17643, page 28 and ibid., No. 18716, page 647, right column to page 648, left column.

The following examples are intended to describe this invention in more detail but not to limit it in any way.

EXAMPLE 1

A multilayer color photographic material (Sample 101) was prepared by forming the following layers on a cellulose triacetate film support having a subbing layer.

| | |
|---|---|
| Layer 1: Antihalation Layer | |
| Black Colloid Silver | 0.18 g/m$^2$ as silver |
| Gelatin | 1.40 g/m$^2$ |
| Layer 2: Interlayer | |
| 2,5-Di-t-pentadecylhydroquinone | 0.18 g/m$^2$ |
| Coupler C-1 | 0.07 g/m$^2$ |
| Coupler C-3 | 0.02 g/m$^2$ |
| Ultraviolet Absorbent U-1 | 0.08 g/m$^2$ |
| Ultraviolet Absorbent U-2 | 0.08 g/m$^2$ |
| Solvent HBS-1 | 0.10 g/m$^2$ |
| Solvent HBS-2 | 0.02 g/m$^2$ |
| Gelatin | 1.04 g/m$^2$ |
| Layer 3: First Red-Sensitive Emulsion Layer | |
| Silver Iodobromide Emulsion (silver iodide: 6 mol %, mean grain size: 0.8 μm) | 0.50 g/m$^2$ as silver |
| Sensitizing Dye IX | 6.9 × 10$^{-5}$ mol/mol of silver halide |
| Sensitizing Dye II | 1.8 × 10$^{-5}$ mol/mol of silver halide |
| Sensitizing Dye III | 3.1 × 10$^{-4}$ mol/mol of silver halide |
| Sensitizing Dye IV | 4.0 × 10$^{-5}$ mol/mol of silver halide |
| Coupler C-2 | 0.146 g/m$^2$ |
| Solvent HBS-1 | 0.005 g/m$^2$ |
| Compound (35) | 0.0050 g/m$^2$ |
| Gelatin | 1.20 g/m$^2$ |
| Layer 4: Second Red-Sensitive Emulsion Layer | |
| Silver Iodobromide Emulsion (silver iodide: 5 mol %, mean grain size: 0.85 μm) | 1.15 g/m$^2$ as silver |
| Sensitizing Dye IX | 5.1 × 10$^{-5}$ mol/mol of silver halide |
| Sensitizing Dye II | 1.4 × 10$^{-5}$ mol/mol of silver halide |
| Sensitizing Dye III | 2.3 × 10$^{-4}$ mol/mol of silver halide |
| Sensitizing Dye IV | 3.0 × 10$^{-5}$ mol/mol of silver halide |
| Coupler C-2 | 0.060 g/m$^2$ |
| Coupler C-3 | 0.008 g/m$^2$ |
| Compound (35) | 0.004 g/m$^2$ |
| Solvent HBS-1 | 0.005 g/m$^2$ |
| Gelatin | 1.50 g/m$^2$ |
| Layer 5: Third Red-Sensitive Emulsion Layer | |
| Silver Iodobromide Emulsion (silver iodide: 10 mol %, mean grain size: 1.5 μm) | 1.50 g/m$^2$ as silver |
| Sensitizing Dye IX | 5.4 × 10$^{-5}$ mol/mol of silver halide |
| Sensitizing Dye II | 1.4 × 10$^{-5}$ mol/mol of silver halide |
| Sensitizing Dye III | 2.4 × 10$^{-4}$ mol/mol of silver halide |
| Sensitizing Dye IV | 3.1 × 10$^{-5}$ mol/mol of silver halide |
| Coupler C-5 | 0.012 g/m$^2$ |
| Coupler C-3 | 0.003 g/m$^2$ |
| Coupler C-4 | 0.004 g/m$^2$ |
| Solvent HBS-1 | 0.32 g/m$^2$ |
| Gelatin | 1.63 g/m$^2$ |
| Layer 6: Interlayer | |
| Gelatin | 1.06 g/m$^2$ |
| Layer 7: First Green-Sensitive Emulsion Layer | |
| Silver Iodobromide Emulsion (silver iodide: 6 mol %, mean grain size: 0.8 μm) | 0.35 g/m$^2$ as silver |
| Sensitizing Dye V | 3.0 × 10$^{-5}$ mol/mol of silver halide |
| Sensitizing Dye VI | 1.0 × 10$^{-4}$ mol/mol of silver halide |
| Sensitizing Dye VII | 3.8 × 10$^{-4}$ mol/mol of silver halide |
| Coupler C-6 | 0.120 g/m$^2$ |
| Coupler C-1 | 0.021 g/m$^2$ |
| Coupler C-7 | 0.030 g/m$^2$ |
| Coupler C-8 | 0.025 g/m$^2$ |
| Solvent HBS-1 | 0.20 g/m$^2$ |
| Gelatin | 0.70 g/m$^2$ |
| Layer 8: Second Green-Sensitive Emulsion Layer | |
| Silver Iodobromide Emulsion (silver iodide: 5 mol %, mean grain size: 0.85 μm) | 0.75 g/m$^2$ as silver |
| Sensitizing Dye V | 2.1 × 10$^{-5}$ mol/mol of silver halide |
| Sensitizing Dye VI | 7.0 × 10$^{-5}$ mol/mol of silver halide |
| Sensitizing Dye VII | 2.6 × 10$^{-4}$ mol/mol of silver halide |
| Coupler C-6 | 0.021 g/m$^2$ |
| Coupler C-8 | 0.004 g/m$^2$ |
| Coupler C-1 | 0.002 g/m$^2$ |
| Coupler C-7 | 0.003 g/m$^2$ |
| Solvent HBS-1 | 0.15 g/m$^2$ |
| Gelatin | 0.80 g/m$^2$ |
| Layer 9: Third Green-Sensitive Emulsion Layer | |
| Silver Iodobromide Emulsion (silver iodide: 10 mol %, mean grain size: 1.5 μm) | 1.80 g/m$^2$ as silver |
| Sensitizing Dye V | 3.5 × 10$^{-5}$ mol/mol of silver halide |
| Sensitizing Dye VI | 8.0 × 10$^{-5}$ mol/mol of silver halide |
| Sensitizing Dye VII | 3.0 × 10$^{-4}$ mol/mol of silver halide |
| Coupler C-6 | 0.011 g/m$^2$ |
| Coupler C-1 | 0.001 g/m$^2$ |
| Solvent HBS-2 | 0.69 g/m$^2$ |
| Gelatin | 1.74 g/m$^2$ |
| Layer 10: Yellow Filter Layer | |
| Yellow Colloid Silver | 0.05 g/m$^2$ as silver |
| 2,5-Di-t-pentadecylhydroquinone | 0.03 g/m$^2$ |
| Gelatin | 0.95 g/m$^2$ |
| Layer 11: First Blue-Sensitive Emulsion Layer | |
| Silver Iodobromide Emulsion (silver iodide: 6 mol %, mean grain size: 0.6 μm) | 0.24 g/m$^2$ as silver |
| Sensitizing Dye VIII | 3.5 × 10$^{-4}$ mol/mol of silver halide |
| Coupler C-9 | 0.27 g/m$^2$ |

-continued

| | |
|---|---|
| Coupler C-8 | 0.005 g/m$^2$ |
| Solvent HBS-1 | 0.28 g/m$^2$ |
| Gelatin | 1.28 g/m$^2$ |
| Layer 12: Second Blue-Sensitive Emulsion Layer | |
| Silver Iodobromide Emulsion (silver iodide: 10 mol %, mean grain size: 1.0 μm) | 0.45 g/m$^2$ as silver |
| Sensitizing Dye VIII | 2.1 × 10$^{-4}$ mol/mol of silver halide |
| Coupler C-9 | 0.098 g/m$^2$ |
| Solvent HBS-1 | 0.03 g/m$^2$ |
| Gelatin | 0.46 g/m$^2$ |
| Layer 13: Third Blue-Sensitive Emulsion Layer | |
| Silver Iodobromide Emulsion (silver iodide: 10 mol %, mean grain size: 1.8 μm) | 0.77 g/m$^2$ as silver |
| Sensitizing Dye VIII | 2.2 × 10$^{-4}$ mol/mol of silver halide |
| Coupler C-9 | 0.036 g/m$^2$ |
| Solvent HBS-1 | 0.07 g/m$^2$ |
| Gelatin | 0.69 g/m$^2$ |
| Layer 14: First Protective Layer | |
| Silver Iodobromide Emulsion (silver iodide: 1 mol %, mean grain size: 0.07 μm) | 0.5 g/m$^2$ as silver |
| Ultraviolet Absorbent U-1 | 0.11 g/m$^2$ |
| Ultraviolet Absorbent U-2 | 0.17 g/m$^2$ |
| Solvent HBS-1 | 0.90 g/m$^2$ |
| Layer 15: Second Protective Layer | |
| Polymethyl Methacrylate Particles (diameter: about 1.5 μm) | 0.54 g/m$^2$ |
| Formaldehyde Scavenger S-1 | 0.15 g/m$^2$ |
| Formaldehyde Scavenger S-2 | 0.10 g/m$^2$ |
| Gelatin | 0.72 g/m$^2$ |

In addition, each of the layers described above further contains Gelatin Hardening Agent H-1 and a surface active agent in addition to the aforesaid components.

Samples 102 to 105:

Samples 102 to 105 were prepared by following the same procedure as in the case of preparing Sample 101 described above except that Compound (35) of this invention added to Layer 3 and Layer 4 in Sample 101 was replaced with Compound (45) of this invention, Compound (30) of this invention, Comparison Compound C-10 shown below, and Comparison Compound C-11 shown below, respectively.

Each of the color photographic materials thus prepared was imagewise exposed to a tungsten lamp the color temperature of which was adjusted to 4,800° K. with filter at 25 CMS and then processed according to the following processing steps at 38° C.

| Processing Step | Processing Time |
|---|---|
| Color Development | 3 min 15 sec |
| Bleach | 3 min |
| Fix | 3 min 15 sec |
| Wash | 1 min 30 sec |
| Stabilization | 45 sec |

The compositions of the processing solutions used in the aforesaid processing steps were as follows.

| | |
|---|---|
| Color Developer: | |
| Diethylenetriaminepentaacetic Acid | 1.0 g |
| 1-Hydroxyethylidene-1,1-diphosphonic Acid | 2.0 g |

-continued

| | |
|---|---|
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 l |
| pH | 10.0 |
| Bleach Solution: | |
| Bleaching Agent (A) | (compound and amount are shown in Table 1 below) |
| Bleaching Agent (B) | (shown in Table 1) |
| Chelating Compound (A) | (shown in Table 1) |
| Chelating Compound (B) | (shown in Table 1) |
| Ammonium Bromide | 150 g |
| Ammonium Nitrate | 10 g |
| Bleach Accelerator (shown in Table 1) | 5 × 10$^{-3}$ mol |
| Water to make | 1 liter |
| pH | 6.0 |

In addition, Chelating Compound (A) is the aminopolycarboxylic acid the same as that for the aminopolycarboxylic acid ferric ammonium salt of Bleaching Agent (A) and Chelating Compound (B) is the same as above for Bleaching Agent (B).

| | |
|---|---|
| Fix Solution: | |
| Ethylenediaminetetraacetic Acid Disodium Salt | 1.0 g |
| Sodium Sulfite | 4.0 g |
| Aqueous Solution of Ammonium Thiosulfate (70%) | 250.0 ml |
| Sodium Bisulfate | 4.6 g |
| Water to make | 1.0 liter |
| pH | 6.6 |
| Wash Solution: | |
| Ethylenediaminetetraacetic Acid Disodium Salt | 0.4 g/l |
| Water to make | 1.0 g/l |
| pH | 7.5 |
| Stabilization Solution: | |
| Formalin (40%) | 2.0 ml |
| Polyoxyethylene p-Monononylphenyl Ether (average polymerization degree: about 10) | 0.3 g |
| Water to make | 1.0 liter |

The bleaching agents, the chelating agents (described above), and the bleach accelerators used for the bleach soltutions are shown in Table 1 together with the amounts thereof. In addition, the ferric complex salts for the bleaching agents shown in Table 1 were all used as the ammonium salts thereof. Also, in Table 1 below, Process A is the processing steps including the bleach step using the bleach solution containing no bleach accelerator and Process A is denoted as Process (1) to Process (8) according to the kind of bleaching agent(s) and chelating agent(s) contained in each bleaching solution. Process B and Process C are the processing steps as in Process (1) to (8) of Process A using, however, each bleaching solution containing the bleach accelerator shown in the table.

For each color photographic material thus processed, the amount of residual silver at the highest colored density portion was measured by fluorescent X-ray analysis and the results obtained are shown in Table 2.

TABLE 1

| Process No. | Process A: Bleaching Agent (A) and Chelating Compound (A): Ferric Complex Salt for Bleaching Agent and Chelating Compound | Amount of Bleaching Agent (mol) | Amount of Chelating Compound (mol) | Bleaching Agent (B) and Chelating Compound (B): Ferric Complex Salt for Bleaching Agent and Chelating Compound | Amount of Bleaching Agent (mol) | Amount of Chelating Compound (mol) | Process B: Process No. | Process B: Bleach Accelerator | Process C: Process No. | Process C: Bleach Accelerator |
|---|---|---|---|---|---|---|---|---|---|---|
| (1) | Ethylenediamine-tetraacetic Acid | 0.3 | 0.03 | — | — | — | (1) | (b)-1 | (1) | (d)-1 |
| (2) | Diethylenetriamine-pentaacetic Acid | " | " | — | — | — | (2) | " | (2) | " |
| (3) | 1,3-Diaminopropane-tetraacetic Acid | " | " | — | — | — | (3) | " | (3) | " |
| (4) | Cyclohexanediamine-tetraacetic Acid | " | " | — | — | — | (4) | " | (4) | " |
| (5) | Glycol Ether Tetraacetic Acid | " | " | — | — | — | (5) | " | (5) | " |
| (6) | N—Methylimino-diacetic Acid | " | " | — | — | — | (6) | " | (6) | " |
| (7) | 1,3-Diaminopropane-tetraacetic Acid | 0.24 | 0.024 | Ethylenediamine-tetraacetic Acid | 0.04 | 0.006 | (7) | " | (7) | " |
| (8) | 1,3-Diaminopropane-tetraacetic Acid | " | " | Cyclohexanediamine tetraacetic Acid | " | " | (8) | " | (8) | " |

TABLE 2

Residual Silver Amount ($\mu g/cm^2$)

| Sample No. | Process (1) A | Process (1) B | Process (1) C | Process (2) A | Process (2) B | Process (2) C | Process (3) A | Process (3) B | Process (3) C | Process (4) A | Process (4) B | Process (4) C | Remarks |
|---|---|---|---|---|---|---|---|---|---|---|---|---|---|
| 101 | 10.8 | 4.7 | 4.0 | 5.8 | 1.8 | 1.6 | 3.0 | 0.8 | 0.4 | 1.1 | 0.4 | 0.1 | Invention |
| 102 | 11.1 | 4.9 | 4.1 | 6.1 | 2.0 | 1.9 | 3.5 | 0.7 | 0.6 | 1.4 | 0.2 | 0.4 | " |
| 103 | 14.5 | 5.2 | 4.1 | 6.4 | 2.1 | 1.5 | 3.9 | 0.7 | 0.5 | 1.5 | 0.1 | 0.5 | " |
| 104 | 13.6 | 6.3 | 6.0 | 11.4 | 4.3 | 4.0 | 9.2 | 4.2 | 3.8 | 7.4 | 4.1 | 3.9 | Comparison |
| 105 | 14.1 | 6.2 | 5.9 | 11.5 | 3.8 | 3.3 | 9.8 | 3.9 | 4.0 | 7.5 | 4.8 | 4.2 | " |

| Sample No. | Process (5) A | Process (5) B | Process (5) C | Process (6) A | Process (6) B | Process (6) C | Process (7) A | Process (7) B | Process (7) C | Process (8) A | Process (8) B | Process (8) C | Remarks |
|---|---|---|---|---|---|---|---|---|---|---|---|---|---|
| 101 | 3.6 | 1.0 | 0.7 | 5.6 | 2.1 | 2.0 | 2.9 | 1.0 | 0.5 | 1.5 | 0.5 | 0.2 | Invention |
| 102 | 4.0 | 0.8 | 0.8 | 6.5 | 2.2 | 2.4 | 3.6 | 0.9 | 0.6 | 1.9 | 0.3 | 0.3 | " |
| 103 | 4.2 | 1.1 | 0.7 | 6.3 | 2.4 | 2.1 | 3.8 | 1.1 | 0.7 | 2.0 | 0.3 | 0.5 | " |
| 104 | 9.5 | 5.1 | 4.9 | 12.0 | 4.5 | 4.2 | 10.0 | 4.5 | 3.9 | 7.6 | 4.2 | 4.0 | Comparison |
| 105 | 9.9 | 5.7 | 4.8 | 11.7 | 4.2 | 4.0 | 10.3 | 4.1 | 4.2 | 8.0 | 4.9 | 4.5 | " |

As is clear from the results shown in Table 2 described above, it can be seen that the amount of residual silver is less in the case of processing the color photographic materials containing the couplers for use in this invention shown by formulae (I) or (II) described above as compared to the case of processing color photographic materials containing conventional hydrolyzable type DIR couplers and further this tendency (difference in residual silver) is not so remarkable in Process (1)-A but is remarkable in other processes.

Furthermore, when the bleaching time was prolonged to 6 min and 30 sec, the residual silver amount after processing Samples 101 to 105 became about 5 $\mu g/cm^2$ on Process (1)-A and there were almost no differences between the case of this invention and comparison cases. On the other hand, when the bleaching time was also prolonged to 6 min and 30 sec on other processes, the residual silver amount of each sample became less than 1 $\mu g/cm^2$, which showed the completion of the bleach, and the difference of the residual silver amount was not observed.

EXAMPLE 2

In the same manner as in Example 1, multilayer color photographic materials (Samples 201 to 203) were prepared.

Sample 201:

| | |
|---|---|
| Layer 1: Antihalation Layer | |
| Black Colloid Silver | 0.15 $g/m^2$ as silver |
| Ultraviolet Absorbent U-1 | 0.5 $g/m^2$ |
| Ultraviolet Abosrbent U-2 | 0.2 $g/m^2$ |
| Solvent HBS-3 | 0.4 $g/m^2$ |
| Gelatin | 1.5 $g/m^2$ |
| Layer 2: Interlayer | |
| Coupler C-7 | 0.10 $g/m^2$ |
| Coupler C-3 | 0.11 $g/m^2$ |
| 2,5-Di-t-octylhydroquinone | 0.05 $g/m^2$ |
| Solvent HBS-1 | 0.10 $g/m^2$ |
| Gelatin | 1.50 $g/m^2$ |
| Layer 3: First Red-Sensitive Emulsion Layer | |
| Silver Iodobromide Emulsion (silver iodide: 5 mol %, mean grain size: 0.4 $\mu m$, monodispersed emulsion having variation coefficient on grain size of 17%) | 0.9 $g/m^2$ as silver |
| Coupler C-12 | 0.35 $g/m^2$ |
| Coupler C-13 | 0.37 $g/m^2$ |
| Coupler C-3 | 0.12 $g/m^2$ |
| Compound (30) | 0.052 $g/m^2$ |
| Solvent HBS-3 | 0.30 $g/m^2$ |
| Sensitizing Dye I | $4.5 \times 10^{-4}$ mol/mol of silver halide |
| Sensitizing Dye II | $1.4 \times 10^{-5}$ mol/mol of silver halide |
| Sensitizing Dye III | $2.3 \times 10^{-4}$ mol/mol of silver halide |
| Sensitizing Dye IV | $3.0 \times 10^{-5}$ mol/mol of silver halide |

-continued

| | |
|---|---|
| Gelatin | 1.50 g/m$^2$ |
| Layer 4: Second Red-Sensitive Emulsion Layer | |
| Silver Iodobromide Emulsion (silver iodide: 6 mol %, mean grain size: 1.0 μm, monodispersed emulsion having variation coefficient on grain size of 16%) | 1.0 g/m$^2$ as silver |
| Sensitizing Dye I | 3.0 × 10$^{-4}$ mol/mol of silver halide |
| Sensitizing Dye II | 1.0 × 10$^{-5}$ mol/mol of silver halide |
| Sensitizing Dye III | 1.5 × 10$^{-4}$ mol/mol of silver halide |
| Sensitizing Dye IV | 2.0 × 10$^{-5}$ mol/mol of silver halide |
| Coupler C-4 | 0.078 g/m$^2$ |
| Coupler C-3 | 0.045 g/m$^2$ |
| Solvent HBS-1 | 0.010 g/m$^2$ |
| Gelatin | 0.80 g/m$^2$ |
| Layer 5: Interlayer | |
| 2,5-Di-t-octylhydroquinone | 0.12 g/m$^2$ |
| Solvent HBS-1 | 0.20 g/m$^2$ |
| Gelatin | 1.0 g/m$^2$ |
| Layer 6: First Green-Sensitive Emulsion Layer | |
| Silver Iodobromide Emulsion (silver iodide: 6 mol %, mean grain size: 0.4 μm, monodispersed emulsion having variation coefficient on grain size of 17%) | 0.5 g/m$^2$ as silver |
| Sensitizing Dye V | 6.0 × 10$^{-5}$ mol/mol of silver halide |
| Sensitizing Dye VI | 2.0 × 10$^{-4}$ mol/mol of silver halide |
| Sensitizing Dye VII | 4.0 × 10$^{-4}$ mol/mol of silver halide |
| Coupler C-6 | 0.27 g/m$^2$ |
| Coupler C-1 | 0.072 g/m$^2$ |
| Coupler C-7 | 0.12 g/m$^2$ |
| Coupler C-8 | 0.010 g/m$^2$ |
| Solvent HBS-1 | 0.15 g/m$^2$ |
| Gelatin | 0.70 g/m$^2$ |
| Layer 7: Second Green-Sensitive Emulsion Layer | |
| Silver Iodobromide Emulsion (silver iodide: 7 mol %, mean grain size: 0.9 μm, monodispersed emulsion having variation coefficient on grain size of 18%) | 0.80 g/m$^2$ as silver |
| Sensitizing Dye V | 4.0 × 10$^{-5}$ mol/mol of silver halide |
| Sensitizing Dye VI | 1.5 × 10$^{-4}$ mol/mol of silver halide |
| Sensitizing Dye VII | 3.0 × 10$^{-4}$ mol/mol of silver halide |
| Coupler C-6 | 0.071 g/m$^2$ |
| Coupler C-1 | 0.021 g/m$^2$ |
| Coupler C-7 | 0.016 g/m$^2$ |
| Solvent HBS-2 | 0.10 g/m$^2$ |
| Gelatin | 0.91 g/m$^2$ |
| Layer 8: Interlayer | |
| 2,5-Di-t-octylhydroquinone | 0.05 g/m$^2$ |
| Solvent HBS-2 | 0.10 g/m$^2$ |
| Gelatin | 0.70 g/m$^2$ |
| Layer 9: Donor Layer of Superposition Effect for Red-Sensitive Layer | |
| Silver Iodobromide Emulsion (silver iodide: 4 mol %, mean grain size: 0.4 μm, monodispersed emulsion having variation coefficient on grain size of 15%) | 0.40 g/m$^2$ as silver |
| Sensitizing Dye X | 5.0 × 10$^{-4}$ mol/mol of silver halide |
| Coupler C-8 | 0.051 g/m$^2$ |
| Coupler C-14 | 0.095 g/m$^2$ |
| Solvent HBS-1 | 0.15 g/m$^2$ |
| Solvent HBS-2 | 0.15 g/m$^2$ |
| Gelatin | 0.60 g/m$^2$ |
| Layer 10: Yellow Filter Layer | |
| Yellow Colloid Silver | 0.85 g/m2 as silver |
| 2,5-Di-t-octylhydroquinone | 0.15 g/m$^2$ |
| Solvent HBS-1 | 0.20 g/m$^2$ |
| Gelatin | 0 80 g/m$^2$ |
| Layer 11: First Blue-Sensitive Emulsion Layer | |
| Silver Iodobromide Emulsion (silver iodide: 4 mol %, mean grain size: 0.3 μm, monodispersed emulsion having variation coefficient on grain size of 16%) | 0.45 g/m$^2$ as silver |
| Sensitizing Dye VIII | 7.0 × 10$^{-4}$ mol/mol of silver halide |
| Coupler C-9 | 1.10 g/m$^2$ |
| Compound (30) | 0.050 g/m$^2$ |
| Solvent HBS-1 | 0.40 g/m$^2$ |
| Gelatin | 1.5 g/m$^2$ |
| Layer 12: Second Blue-Sensitive Emulsion Layer | |
| Silver Iodobromide Emulsion (silver iodide: 8 mol %, mean grain size: 0.7 μm, monodispersed emulsion having variation coefficient on grain size of 19%) | 0.5 g/m$^2$ as silver |
| Sensitizing Dye VIII | 1.5 × 10$^{-4}$ mol/mol of silver halide |
| Coupler C-9 | 0.31 g/m$^2$ |
| Solvent HBS-1 | 0.12 g/m$^2$ |
| Gelatin | 0.88 g/m$^2$ |
| Layer 13: Interlayer | |
| Ultraviolet Absorbent U-1 | 0.12 g/m$^2$ |
| Ultraviolet Absorbent U-2 | 0.16 g/m$^2$ |
| Solvent HBS-3 | 0.12 g/m$^2$ |
| Gelatin | 0.75 g/m$^2$ |
| Layer 14: Protective Layer | |
| Silver Iodobromide Emulsion (silver iodide: 4 mol %, mean grain size: 0.08 μm, having variation coefficient on grain size of 10%) | 0.15 g/m$^2$ as silver |
| Polymethyl Methacrylate Particles (diameter of 1.5 μm) | 0.008 g/m$^2$ |
| Formaldehyde Scavenger S-1 | 0.05 g/m$^2$ |
| Formaldehyde Scavenger S-2 | 0.15 g/m$^2$ |
| Gelatin | 0.80 g/m$^2$ |

In addition, each layer further contained Gelatin Hardening Agent H-1 and a surface active agent in addition to the aforesaid components.

Sample 202:

Sample 202 was prepared by following the same procedure as above except that Compound (28) was used in place of Compound (30) in layer 3 of Sample 201 and Compound (33) was used in place of Compound (30) in Layer 11.

Sample 203:

Sample 203 was prepared by following the same procedure as above except that Comparison Coupler C-11 was used in place of Compound (30) for Layer 3 and Layer 11 of Sample 201 in an amount of ½ mol times the amount of Compound (30).

The compounds used for preparing the samples in Example 1 and Example 2 are as follows.

Ultraviolet Absorbent U-1

-continued
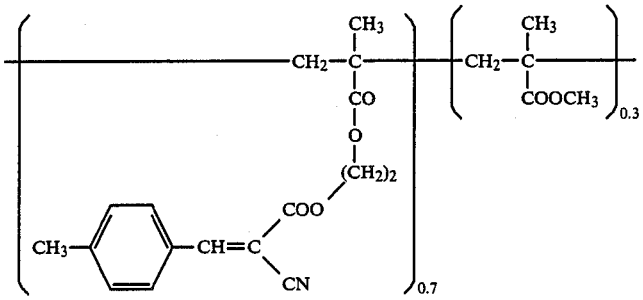
Ultraviolet Absorbent U-2
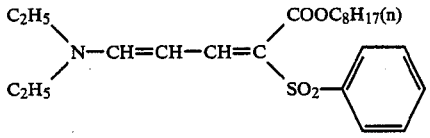
Coupler C-1
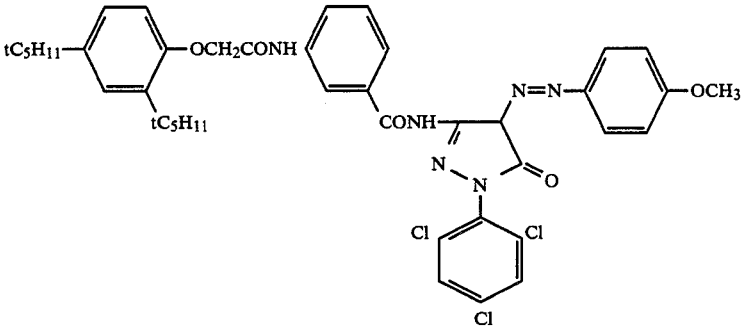
Coupler C-2
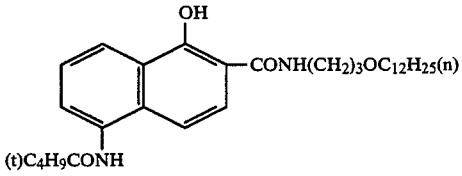
Coupler C-3
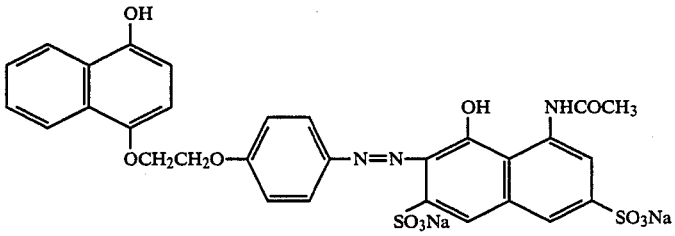
Coupler C-4
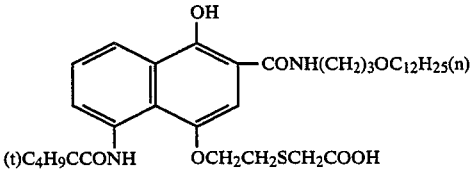
Coupler C-5

-continued
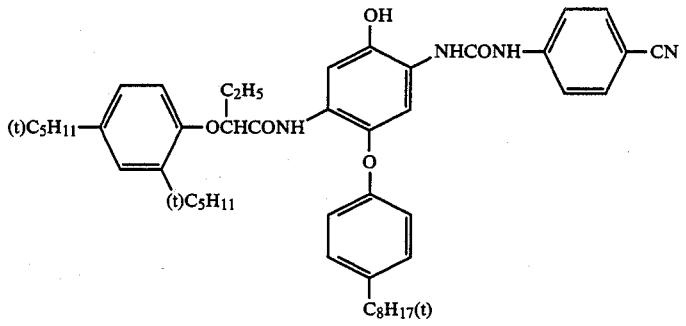
Coupler C-6
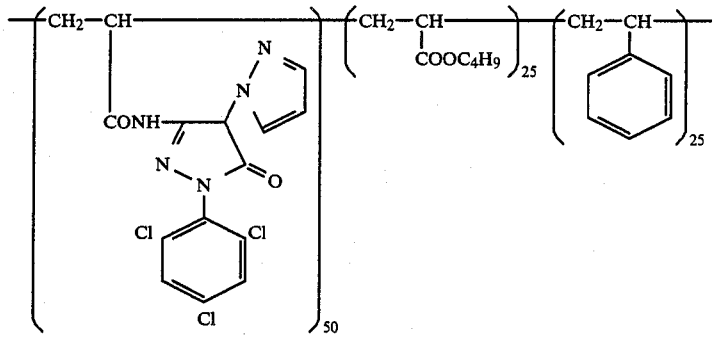
Average molecular weight: 30,000
Coupler C-7
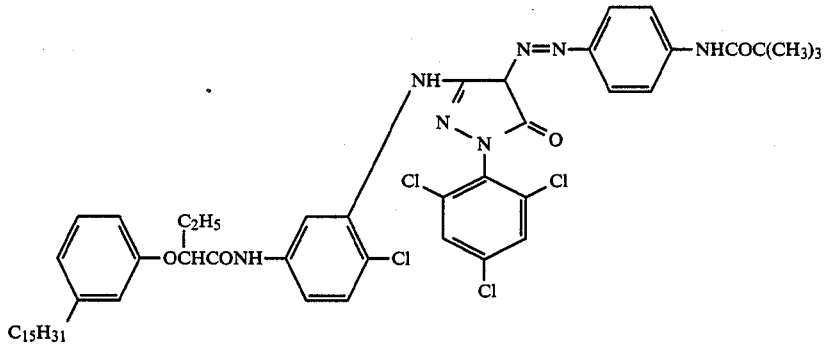
Coupler C-8
(coupler described in U.S. Pat. No. 4,477,563)
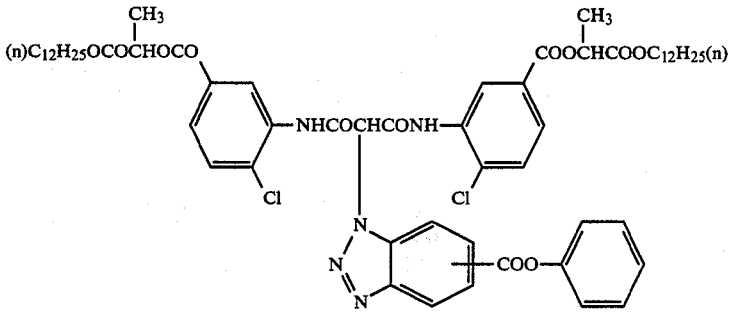
Coupler C-9
Coupler C-10
(coupler described in U.S. Pat. No. 4,477,563)

-continued
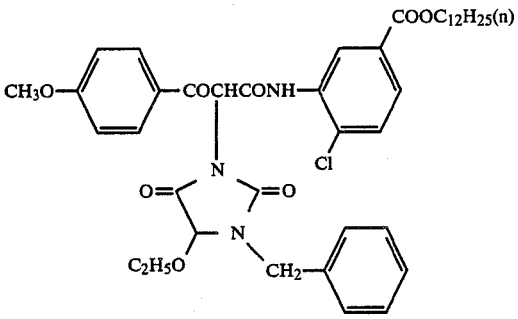
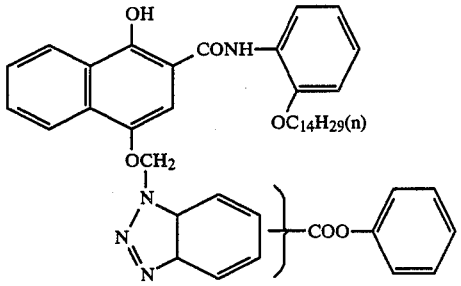
Coupler C-11
(coupler described in U.S. Pat. No. 3,227,554)
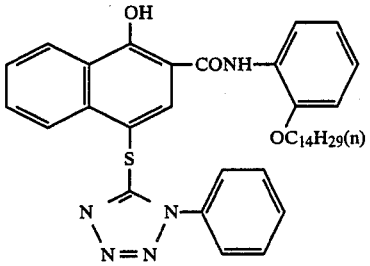
Coupler C-12
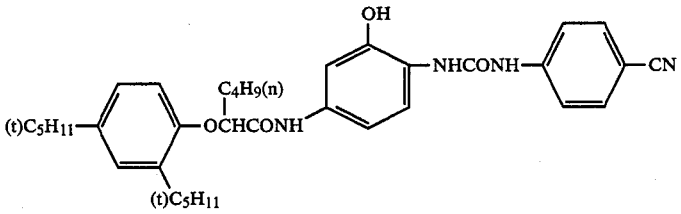
Coupler C-13
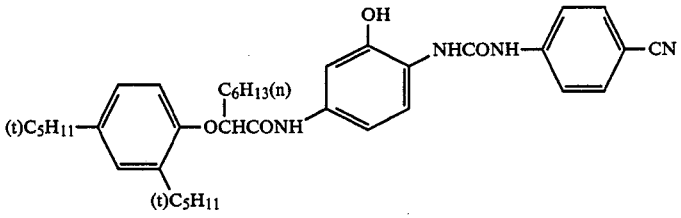
Coupler C-14
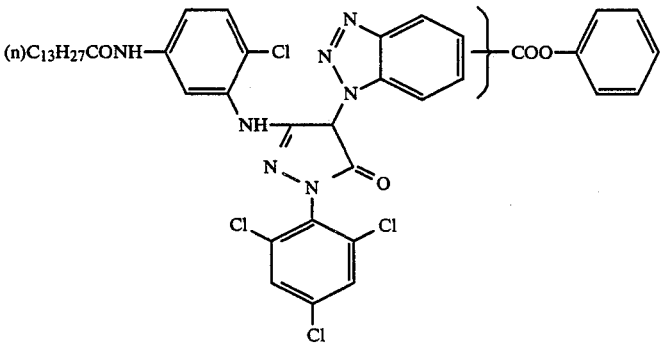
Formaldehyde Scavenger S-1
Formaldehyde Scavenger S-2

-continued
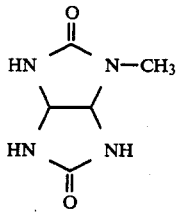
HBS-1
Tricresyl Phosphate
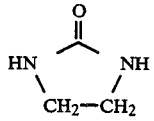
HBS-2
Dibutyl Phthalate
HBS-3
Tri-n-hexyl Phosphate
Gelatin Hardening Agent H-1
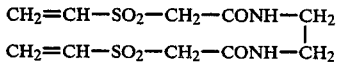
Sensitizing Dye I
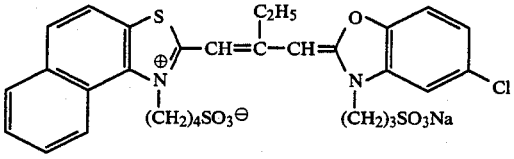
Sensitizing Dye II
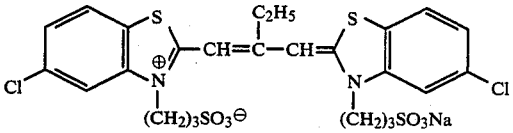
Sensitizing Dye III
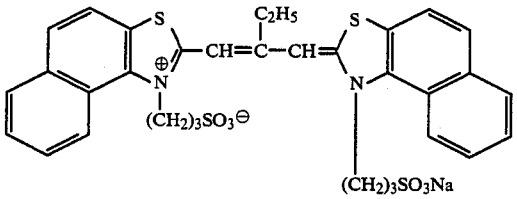
Sensitizing Dye IV
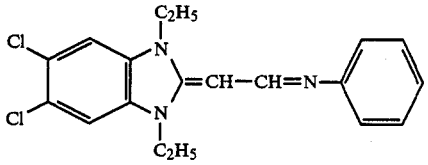
Sensitizing Dye V
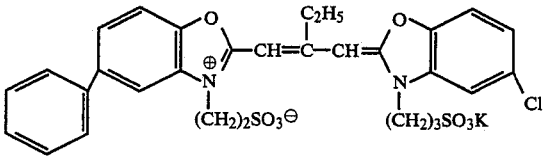
Sensitizing Dye VI
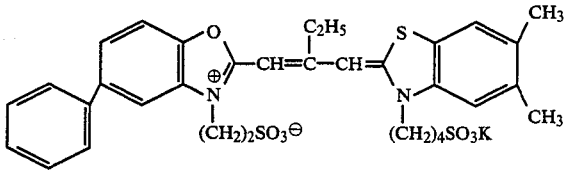
Sensitizing Dye VII
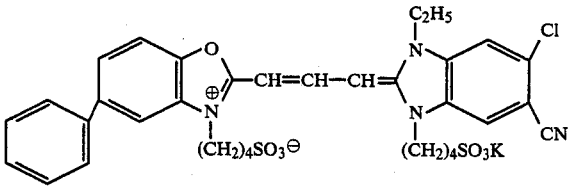
Sensitizing Dye VIII
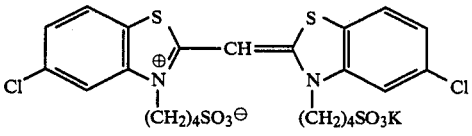
Sensitizing Dye IX
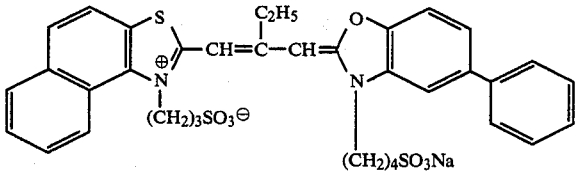
Sensitizing Dye X -continued

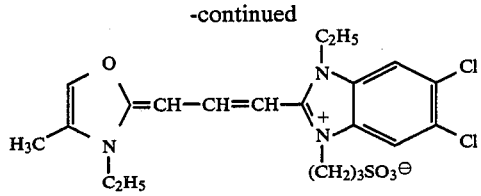

The samples thus prepared were image exposed and processed using each of the bleach solutions in Example 1. In the processing, the color developer and the fix solution had the same compositions as in Example 1 but a wash solution having the following composition was used in this case.

| Wash Solution: | |
|---|---|
| Ethylenediaminetetraacetic Acid Disodium Salt | 0.4 g |
| 5-Chloro-2-methyl-4-isothiazolin-3-one | 50 mg |
| Water to make | 1 liter |
| pH | 7.5 |

For each of the samples thus processed, the amount of residual silver was measured as in Example 1 and the results thus obtained are shown in Table 3 below.

TABLE 3

| Residual Silver Amount ($\mu g/cm^2$) | | | | | | | | | | | | | |
|---|---|---|---|---|---|---|---|---|---|---|---|---|---|
| Sample | Process (1) | | | Process (2) | | | Process (3) | | | Process (4) | | | |
| No. | A | B | C | A | B | C | A | B | C | A | B | C | Remarks |
| 201 | 13.2 | 5.8 | 5.0 | 7.5 | 3.3 | 3.0 | 5.2 | 1.3 | 1.4 | 3.2 | 1.0 | 1.2 | Invention |
| 202 | 13.6 | 5.9 | 5.3 | 8.2 | 3.0 | 3.4 | 5.8 | 1.5 | 1.1 | 3.6 | 1.1 | 1.3 | " |
| 203 | 15.3 | 7.3 | 7.2 | 12.8 | 9.3 | 8.9 | 10.9 | 7.7 | 7.6 | 8.6 | 5.6 | 5.8 | Comparison |
| Sample | Process (5) | | | Process (6) | | | Process (7) | | | Process (8) | | | |
| No. | A | B | C | A | B | C | A | B | C | A | B | C | Remarks |
| 201 | 5.6 | 1.6 | 1.7 | 6.4 | 2.8 | 2.5 | 5.6 | 1.6 | 1.5 | 3.0 | 1.0 | 1.2 | Invention |
| 202 | 5.8 | 1.9 | 1.8 | 6.3 | 2.7 | 2.6 | 5.4 | 1.8 | 1.7 | 3.3 | 1.2 | 1.2 | " |
| 203 | 11.4 | 8.3 | 8.0 | 11.3 | 8.2 | 8.1 | 10.3 | 7.0 | 7.1 | 8.2 | 5.0 | 5.5 | Comparison |

As shown in Table 3, almost the same results as in Example 1 were obtained.

EXAMPLE 3

Multilayer color photographic materials (Samples 101 to 105) were prepared in the same manner as in Example 1 and after imagewise exposure, they were processed at 38° C. by the following processing steps.

| Processing Step | Processing Time |
|---|---|
| Color Developer | 3 min 15 sec |
| Blix | 4 min |
| Wash | 1 min 30 sec |
| Stabilization | 45 sec |

The compositions of the processing solutions used for the processing were as follows.

| Color Developer: | |
|---|---|
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |

-continued

| | |
|---|---|
| Water to make | 1.0 liter |
| pH | 10.0 |
| Blix Solution | |
| Bleaching Agent (D) | (shown in Table 4 below together with the amount) |
| Bleaching Agent (E) | Same as above |
| Chelating Compound (D) | Same as above |
| Chelating Compound (E) | Same as above |
| Bleach Accelerator (shown in Table 4) | $5 \times 10^{-3}$ mol/liter |
| Sodium Sulfite | 15.0 g |
| Aqueous Solution of Ammonium Thiosulfate (70%) | 250.0 g |
| Water to make | 1.0 liter |
| pH | 6.8 |

In addition, Chelating Compound (D) is the aminopolycarboxylic acid the same as that for the aminopolycarboxylic acid ferric ammonium complex salt of Bleaching Agent (D) and Chelating Compound (E) is the same as above for Bleaching Agent (E).

| Wash Solution: | |
|---|---|
| Ethylenediaminetetraacetic Acid Disodium Salt | 0.4 g/liter |
| Water to make | 1.0 liter |
| pH | 7.5 |
| Stabilization Solution: | |
| Formalin (40%) | 2.0 ml |
| Polyoxyethylene p-Monononylphenyl Ether (average polymerization degree: about 10) | 0.3 g |
| Water to make | 1.0 liter |

The bleaching agents, chelating compounds, and bleach accelerators used in the bleaching solutions are shown in Table 4. In addition, Process D in Table 4 below is the processing steps including the bleach step using the bleach solution containing no bleach accelerator and is denoted as Process (9) to Process (16) according to the kinds of bleaching agent(s) and chelating compound(s) contained in each bleaching solution. Process E and Process F are the processing steps as in Process (9) to (16) of Process D using, however, each bleaching solution containing the bleach accelerator shown in Table 4. Also, the ferric complex salts shown in Table 4 were all used as the ammonium salts.

For the samples thus processed, the amount of residual silver at the highest colored density portion was measured by fluorescent X-ray analysis and the results are shown in Table 5.

TABLE 4

| | Process D | | | | | | | | | |
|---|---|---|---|---|---|---|---|---|---|---|
| | Bleaching Agent (D) and Chelating Compound (D) | | | Bleaching Agent (E) and Chelating Compound (E) | | | Process E | | Process F | |
| Process No. | Ferric Complex Salt for Bleaching Agent and Chelating Compound | Amount of Bleaching Agent (mol) | Amount of Chelating Compound (mol) | Ferric Complex Salt for Bleaching Agent and Chelating Compound | Amount of Bleaching Agent (mol) | Amount of Chelating Compound (mol) | Process No. | Bleach Accelerator | Process No. | Bleach Accelerator |
| (9) | Ethylenediamine-tetraacetic Acid | 0.2 | 0.02 | — | — | — | (9) | (b)-1 | (9) | (d)-1 |
| (10) | Diethylenetriamine-pentaacetic Acid | " | " | — | — | — | (10) | " | (10) | " |
| (11) | 1,3-Diaminopropane-tetraacetic Acid | " | " | — | — | — | (11) | " | (11) | " |
| (12) | Cyclohexanediamine-tetraacetic Acid | " | " | — | — | — | (12) | " | (12) | " |
| (13) | Glycol Ether Tetraacetic Acid | " | " | — | — | — | (13) | " | (13) | " |
| (14) | N—Methylimino-diacetic Acid | " | " | — | — | — | (14) | " | (14) | " |
| (15) | 1,3-Diaminopropane-tetraacetic Acid | 0.16 | 0.016 | Ethylenediamine-tetraacetic Acid | 0.04 | 0.004 | (15) | " | (15) | " |
| (16) | 1,3-Diaminopropane-tetraacetic Acid | " | " | Cyclohexanediamine-tetraacetic Acid | " | " | (16) | " | (16) | " |

TABLE 5

| | Residual Silver Amount ($\mu g/cm^2$) | | | | | | | | | | | | |
|---|---|---|---|---|---|---|---|---|---|---|---|---|---|
| Sample | Process (9) | | | Process (10) | | | Process (11) | | | Process (12) | | | |
| No. | D | E | F | D | E | F | D | E | F | D | E | F | Remarks |
| 101 | 12.3 | 6.7 | 5.9 | 8.3 | 4.1 | 3.9 | 6.3 | 3.8 | 3.5 | 4.1 | 2.3 | 2.1 | Invention |
| 102 | 12.4 | 6.5 | 6.1 | 8.2 | 4.4 | 3.6 | 6.5 | 3.9 | 3.6 | 4.4 | 2.6 | 2.5 | " |
| 103 | 12.7 | 6.9 | 6.0 | 8.8 | 5.0 | 3.8 | 6.9 | 3.5 | 3.3 | 4.7 | 3.0 | 2.9 | " |
| 104 | 15.3 | 7.2 | 7.5 | 13.0 | 6.8 | 6.0 | 11.9 | 5.9 | 5.5 | 8.3 | 4.7 | 4.5 | Comparison |
| 105 | 14.9 | 7.5 | 7.7 | 13.3 | 6.9 | 6.3 | 11.0 | 5.8 | 5.7 | 8.5 | 4.4 | 4.6 | " |
| Sample | Process (13) | | | Process (14) | | | Process (15) | | | Process (16) | | | |
| No. | D | E | F | D | E | F | D | E | F | D | E | F | Remarks |
| 101 | 6.7 | 4.2 | 4.0 | 9.2 | 4.8 | 4.5 | 6.5 | 4.0 | 3.7 | 3.8 | 2.0 | 1.8 | Invention |
| 102 | 6.9 | 4.6 | 4.3 | 8.8 | 4.3 | 4.0 | 6.3 | 4.1 | 3.7 | 4.0 | 2.1 | 1.7 | " |
| 103 | 9.0 | 5.0 | 4.6 | 9.4 | 5.1 | 4.8 | 6.8 | 4.5 | 3.9 | 4.2 | 2.2 | 2.1 | " |
| 104 | 12.5 | 6.2 | 6.0 | 13.3 | 7.0 | 6.7 | 12.3 | 6.2 | 5.8 | 8.0 | 4.3 | 4.0 | Comparison |
| 105 | 12.3 | 6.5 | 6.1 | 13.8 | 9.3 | 6.9 | 12.0 | 6.1 | 5.7 | 8.2 | 4.4 | 4.1 | " |

As is clear from the results shown in Table 5 above, it can be seen that the amount of residual silver is less in the case of processing the samples containing the couplers for use in this invention shown by formulae (I) or (II) described above as compared with the case of processing the samples containing conventional hydrolyzable type DIR couplers and the tendency is not so remarkable in the case of Process (9)-A but is remarkable in other processes.

EXAMPLE 4

Multilayer color photographic materials (Samples 201 to 203) prepared in the same manner as in Example 2 was imagewise exposed and processed using the blix solutions as in Example 3. In this case, the color developer having the same composition as Example 3 was used but the wash solution having the following composition was used.

| Wash Solution: | | |
|---|---|---|
| Ethylenediaminetetraacetic Acid Disodium Salt | 0.4 | g/liter |
| 5-Chloro-2-methyl-4-isothiazolin-3-one | 50 | mg/liter |
| Water to make | 1.0 | liter |
| pH | 7.5 | |

For the samples thus processed, the amount of residual silver was measured as in Example 3 and the results obtained are shown in Table 6 below.

TABLE 6

| | Residual Silver Amount ($\mu g/cm^2$) | | | | | | | | | | | | |
|---|---|---|---|---|---|---|---|---|---|---|---|---|---|
| Sample | Process (9) | | | Process (10) | | | Process (11) | | | Process (12) | | | |
| No. | D | E | F | D | E | F | D | E | F | D | E | F | Remarks |
| 201 | 13.8 | 7.2 | 7.1 | 9.6 | 4.9 | 4.6 | 7.1 | 4.0 | 4.1 | 5.2 | 3.0 | 3.1 | Invention |
| 202 | 14.0 | 7.0 | 7.3 | 9.4 | 4.4 | 4.5 | 7.3 | 3.9 | 3.8 | 5.1 | 2.5 | 2.7 | " |
| 203 | 17.1 | 8.0 | 8.1 | 14.0 | 6.3 | 6.0 | 12.8 | 6.3 | 6.9 | 9.4 | 5.3 | 5.1 | Comparison |
| Sample | Process (13) | | | Process (14) | | | Process (15) | | | Process (16) | | | |

TABLE 6-continued

| | Residual Silver Amount ($\mu g/cm^2$) | | | | | | | | | | | | |
|---|---|---|---|---|---|---|---|---|---|---|---|---|---|
| No. | D | E | F | D | E | F | D | E | F | D | E | F | Remarks |
| 201 | 8.2 | 5.0 | 4.7 | 11.0 | 5.5 | 5.3 | 7.6 | 4.4 | 4.7 | 4.9 | 2.7 | 2.9 | Invention |
| 202 | 8.0 | 4.8 | 4.5 | 11.5 | 5.1 | 4.5 | 7.4 | 4.6 | 4.9 | 4.7 | 2.5 | 2.8 | " |
| 203 | 13.1 | 6.8 | 7.1 | 15.0 | 7.5 | 7.3 | 13.1 | 6.2 | 6.1 | 11.0 | 4.6 | 5.0 | Comparison |

As shown in Table 6 above, results almost the same as those for Example 3 were obtained.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide color photographic material which comprises processing, after color development, a silver halide color photographic material with a processing solution having a bleaching faculty and containing an aminopolycarboxylic acid ferric complex salt as an oxidizing agent, said color photographic material comprising a support having thereon at least one light-sensitive silver halide emulsion layer and at least one compound releasing by the reaction with an oxidation product of a developing agent a group releasing or forming a development inhibitor by the reaction with another molecule of an oxidation product of a developing agent.

2. The process for processing a silver halide color photographic material as claimed in claim 1, wherein said at least one compound is represented by formula (I):

$$A—PDI \qquad (I)$$

wherein A represents a group releasing PDI by the reaction with an oxidation product of a developing agent and PDI represents said group forming a development inhibitor by the reaction with another molecule of an oxidation product of a developing agent after being cleaved from A.

3. The process for processing a silver halide color photographic material as claimed in claim 2, wherein the compound represented by the formula (I) is a compound represented by formula (II):

$$A\text{-}(L_1)_v B\text{-}(L_2)_w DI \qquad (II)$$

wherein A represents a group releasing $(L_1)_v B\text{-}(L_2)_w DI$ by the reaction with an oxidation product of a developing agent; $L_1$ represents a group releasing $B(L_2)_w DI$ after being cleaved from A; B represents a group releasing $(L_2)_w DI$ by the reaction with another molecule of an oxidation product of a developing agent after being cleaved from $(L_1)_v$; $L_2$ represents said group releasing DI after being cleaved from B; DI represents a development inhibitor; and v and w each represents 0 or 1.

4. The process for processing a silver halide color photographic material as claimed in claim 3, wherein the group represented by A represents a coupler residue or an oxidation reduction group.

5. The process for forming a silver halide color photographic material as claimed in claim 4, wherein the oxidation reduction group represented by A is a group represented by formula (III):

$$A_1—P\text{-}(X{=}Y)_n Q—A_2 \qquad (III)$$

wherein P and Q each represents an oxygen atom or a substituted or unsubstituted imino group; at least one of n Xs and Ys represents a methine group having a group of $\text{-}(L_1)_v B\text{-}(L_2)_w DI$ as a substituent, and the other of X and Y represents a substituted or unsubstituted methine group or a nitrogen atom; n represents an integer from 1 to 3 (n Xs and n Ys each may be the same or different); $A_1$ and $A_2$ each represents a hydrogen atom or a group capable of being eliminated with an alkali; and any two substituents of P, X, Y, Q, $A_1$ and $A_2$ may be divalent groups and connected to each other to form a cyclic structure.

6. The process for processing a silver halide color photographic material as claimed in claim 5, wherein the cyclic structure formed by $(X{=}Y)_n$ is a benzene ring or a pyridine ring.

7. The process for processing a silver halide color photographic material as claimed in claim 3, wherein the group represented by $L_1$ or $L_2$ is a group represented by the following formulae (T-1) to (T-4):

$$*\text{-}(W—\underset{R_2}{\overset{R_1}{C}})_t\text{-}** \qquad (T\text{-}1)$$

wherein the mark * represents the position at which the group is connected to the left side group in formula (II); the mark ** represents the position at which the group is connected to the right side group in formula (II), W represents an oxygen atom, a sulfur atom, or a group represented by $$—\underset{R_3}{N}—$$

(wherein $R_3$ represents an organic substituent); $R_1$ and $R_2$ each represents a hydrogen atom or a substituent; t represents 1 or 2, when t represents 2, two $R_1$s and two $R_2$s each may be the same or different; and any two or $R_1$, $R_2$ and $R_3$ may be connected to each other to form a cyclic structure;

$$*—Nu—Link—E—** \qquad (T\text{-}2)$$

wherein the mark * represents a position bonding the left side of the group in formula (II); the mark  represents a position bonding the right side of the group in formula (II); Nu represents a nucleophilic group; E represents an electrophilic group which can cleave the linkage to the mark  by the nucleophilic attack from Nu; and Link represents a linkage group sterically connecting Nu and E so that they can cause an intramolecular nucleophilic reaction;

$$*—O\text{-}(\underset{R_1}{\overset{}{C}}{=}\underset{R_2}{C})_t CH_2—** \qquad (T\text{-}3)$$

wherein the mark *, the mark **, $R_1$, $R_2$ and t have the same significance as defined above for formula (T-1); and $$*-O-\overset{O}{\overset{\|}{C}}-** \text{ or } *-S-\overset{S}{\overset{\|}{C}}-** \quad \text{(T-4)}$$

wherein the mark * and the mark ** have the same significance as defined above for formula (T-1).

8. The process for processing a silver halide color photographic material as claimed in claim 3, wherein the group B capable of forming an oxidation reduction group is a group represented by formula (B-1):

$$*-P(X'=Y')_nQ-A_2 \quad \text{(B-1)}$$

wherein the mark * represents the position at which the group is connected to $A(L_1)_v$; $A_2$, P, Q and n each has the same meaning as defined in formula (III); at least one of n X's and Y's represents a methine group having a group of $(L_2)_w$DI as a substituent, and the other of X's and Y's represents a substituted or unsubstituted methine group or a nitrogen atom; and any two substituents of $A_2$, P, Q, X' and Y' may be divalent groups and connected to each other to form a cyclic structure.

9. The process for processing a silver halide color photographic material as claimed in claim 3, wherein the compound represented by formula (II) is a polymer formed from the monomer compound represented by the following formula (P-1) and having the recurring unit represented by the following formula (P-2), and a copolymer of the compound shown by formula (II) and at least one non-coloring monomer having an ethylene group which does not have the ability to cause coupling with the oxidation product of an aromatic primary amine developing agent:

$$CH_2=\overset{R}{\overset{|}{C}}(A_4)_i(A_5)_j(A_3)_kQ \quad \text{(P-1)}$$

$$(CH_2-\overset{R}{\overset{|}{C}})_{(A_4)_i(A_5)_j(A_3)_kQ} \quad \text{(P-2)}$$

wherein R represents a hydrogen atom, a lower alkyl group having 1 to 4 carbon atoms, or a chlorine atom; $A_3$ represents —CONH—, —NHCONH—, —NHCOO—, —COO—, —$SO_2$—, —CO—, —NHCO—, —$SO_2$NH—, —NH$SO_2$—, —OCO—, —OCONH—, —S—, —NH—, or —O—; $A_4$ represents —CONH— or —COO—; $A_5$ represents a straight chain or branched, substituted or unsubstituted alkylene group having 1 to 10 carbon atoms, a substituted or unsubstituted aralkylene group, or a substituted or unsubstituted arylene group; Q represents a residue as defined for formula (II) described above and may be bonded to any moiety represented by A, $L_1$, B or $L_2$ in formula (II); and i, j and k represent 0 or 1 excluding the case that i, j and k are simultaneously 0.

10. The process for processing a silver halide color photographic material as claimed in claim 3, wherein the DI in formula (II) is a development inhibitor represented by the following formulae (D-1) to (D-11):

(D-1)

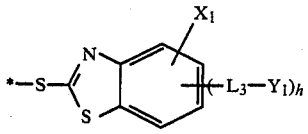

(D-2)

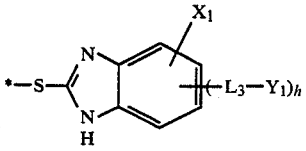

(D-3)

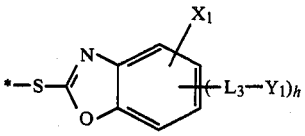

(D-4)

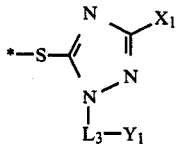

(D-5)

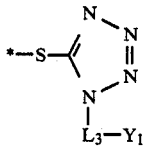

(D-6)

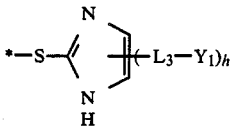

(D-7)

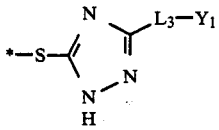

(D-8)

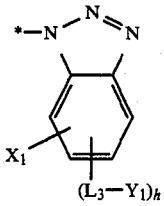

(D-9)

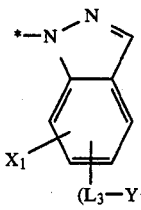

(D-10)

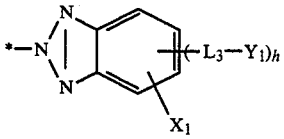

-continued (D-11)

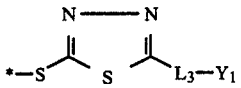

11. The process for processing a silver halide color photographic material as claimed in claim 1, wherein said aminopolycarboxylic acid ferric complex salt as a bleaching agent is a complex salt of ferric ions and aminopolycarboxylic acids or the salt thereof.

12. The process for processing a silver halide color photographic material as claimed in claim 11, wherein said aminopolycarboxylic acids or the salts thereof are selected from diethylenetriaminepentaacetic acid, diethylenetriaminepentaacetic acid pentasodium salt, ethylenediamine-N-(β-oxyethyl)-N,N',N'-triacetic acid, ethylenediamine-N-(β-oxyethyl)-N,N',N'-triacetic acid trisodium salt, ethylenediamine-N-(β-oxyethyl)-N,N',N'-triacid triammonium salt, 1,2-diaminopropanetetraacetic acid, 1,2-aminopropanetetraacetic acid disodium salt, nitrilotriacetic acid, nitrilotriacetic acid sodium salt, cyclohexanediaminetetraacetic acid, cyclohexanediaminetetraacetic acid disodium salt, N-methyliminodiacetic acid, iminodiacetic acid, dihydroxyethylglycine, ethyl ether diaminetetraacetic acid, glycol ether diaminetetraacetic acid, ethylenediaminetetrapropionic acid, 1,3-diaminopropanetetraacetic acid, and ethylenediaminetetraacetic acid.

13. The process for processing a silver halide color photographic material as claimed in claim 12, wherein said aminopolycarboxylic acids or the salts thereof are selected from diethylenetriaminepentaacetic acid, diethylenetriaminepentaacetic acid pentasodium salt, 1,2-diaminopropanetetraacetic acid, 1,2-diaminopropanetetraacetic acid disodium salt, cyclohexanediaminetetraacetic acid, cyclohexanediaminetetraacetic acid disodium salt, N-methyliminodiacetic acid, glycol ether diaminetetraacetic acid, and 1,3-diaminopropanetetraacetic acid.

14. The process for processing silver halide color photographic material as claimed in claim 11, wherein the bleaching agent is used in an amount of from 0.1 mol to 1 mol per liter of the processing solution having a bleaching faculty.

15. The process for processing a silver halide color photographic material as claimed in claim 14, wherein the bleaching agent is used in an amount of from 0.2 mol to 0.5 mol per liter of the processing solution having a bleaching faculty.

16. The process for processing silver halide color photographic material as claimed in claim 14, wherein said processing solution having a bleaching faculty further contains a bleaching accelerator selected from compounds having a mercapto group or a disulfide bond, thiazolidine derivatives, thiourea derivatives and isothiourea derivatives.

17. The process for processing silver halide color photographic material as claimed in claim 16, wherein said bleaching accelerator is represented by the following formula (a) to (g):

(a)

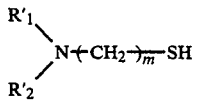

wherein $R'_1$ and $R'_2$, which may be the same or different, each represents a hydrogen atom, a substituted or unsubstituted lower alkyl group or an acyl group, $R'_1$ and $R'_2$ may combine with each other to form a ring; and m represents an integer of 1 to 3;

(b)

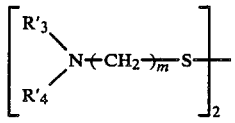

wherein $R'_3$ and $R'_4$ have the same significance as $R'_1$ and $R'_2$ in formula (a), $R'_3$ and $R'_4$ may combine with each other to form a ring; and m represents an integer of from 1 to 3;

(c)

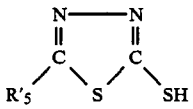

(d)

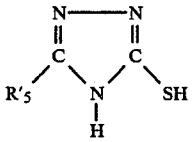

(e)

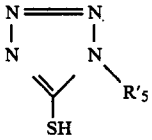

wherein $R'_5$ represents a hydrogen atom, a halogen atom, an amino group, a substituted or unsubstituted lower alkyl group or an amino group having an alkyl group;

(f)

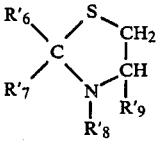

wherein $R'_6$ and $R'_7$, which may be the same or different, each represents a hydrogen atom, a substituted or unsubstituted alkyl group, a substituted or unsubstituted phenyl group, or a substituted or unsubstituted heterocyclic group; $R'_8$ represents a hydrogen atom or a substituted or unsubstituted lower alkyl group; and $R'_9$ represents a hydrogen atom or a carobxy group;

(g)

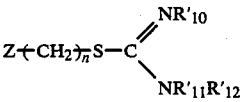

wherein $R'_{10}$, $R'_{11}$ and $R'_{12}$, which may be the same or different, each represents a hydrogen atom or a lower alkyl group, and $R'_{10}$ and $R'_{11}$ or $R'_{12}$ may combine with each other to form a ring; Z represents an amino group which may have a substituent, a sulfonic acid group, or a carboxy group; and n represents an integer of 0 to 20.

18. The process for processing a silver halide color photographic material as claimed in claim 17, wherein said bleaching accelerator is used in an amount of from $1\times10^{-5}$ to $1\times10^{-1}$ mol per liter of the processing solution.

19. The process for processing a silver halide color photographic material as claimed in claim 18, wherein said bleaching accelerator is used in an amount of from $1\times10^{-4}$ to $5\times10^{-2}$ mol per liter of the processing solution.

* * * * *